US010589165B2

(12) United States Patent
Hart et al.

(10) Patent No.: US 10,589,165 B2
(45) Date of Patent: Mar. 17, 2020

(54) SNOW SPORT EQUIPMENT WAXING DEVICE AND METHOD

(71) Applicant: SKIQUIKY, LLC, Blackfoot, ID (US)

(72) Inventors: Jonathan Hart, Salt Lake City, UT (US); Naeem Rahim, Pocatello, ID (US); Fahim Rahim, Pocatello, ID (US); Jonathan E. Hunt, Pocatello, ID (US); Chris Witham, Midvale, UT (US); Devin Owen Howells, Salt Lake City, UM (US); Peter Journell, Salt Lake City, UT (US); Robert S. Gipple, Taylorsville, UT (US); Adam C. Eisenbarth, Park City, UT (US)

(73) Assignee: SKIQUICKY, INC., Blackfoot, ID (US)

( * ) Notice: Subject to any disclaimer, the term of this patent is extended or adjusted under 35 U.S.C. 154(b) by 86 days.

(21) Appl. No.: 15/089,286

(22) Filed: Apr. 1, 2016

(65) Prior Publication Data

US 2016/0287973 A1 Oct. 6, 2016

Related U.S. Application Data

(63) Continuation of application No. 14/545,164, filed on Apr. 1, 2015, now Pat. No. 9,724,592.

(51) Int. Cl.

| | |
|---|---|
| ***A63C 11/08*** | (2006.01) |
| ***B05D 5/08*** | (2006.01) |
| ***B05D 3/00*** | (2006.01) |

(52) U.S. Cl.

CPC ..... *A63C 11/08* (2013.01); *B05D 3/002* (2013.01); *B05D 5/08* (2013.01)

(58) Field of Classification Search

CPC ..... A63C 11/00; A63C 11/02; A63C 11/04; A63C 11/08; A63C 11/021; A63C 11/023; A63C 11/028

See application file for complete search history.

(56) References Cited

U.S. PATENT DOCUMENTS 2,234,487 A 3/1941 Davis
4,061,356 A * 12/1977 Salomon ..... A63C 7/1013 280/605

(Continued)

FOREIGN PATENT DOCUMENTS

CH 175057 A 2/1935
CH 687175 A5 10/1996

(Continued)

OTHER PUBLICATIONS

USPTO, Non-Final Office Action, U.S. Appl. No. 14/545,164, see document for other details.

(Continued)

*Primary Examiner* — James A Shriver, II
*Assistant Examiner* — Vaughn Coolman
(74) *Attorney, Agent, or Firm* — Flaig Law Office, PLLC; Jason Flaig

(57) ABSTRACT

Automated systems, methods and devices for refinishing surfaces on equipment (such as skis and snowboards), engaging the equipment and retracting ski brake arms are disclosed. The disclosure includes applying wax on at least skis and snowboards and may provide kiosks where skiers and boarders can deposit their equipment in a track and have appropriate wax for current snow conditions applied to the equipment.

20 Claims, 32 Drawing Sheets

(56) References Cited

U.S. PATENT DOCUMENTS

| | | | | | |
|---|---|---|---|---|---|
| 4,103,916 | A * | 8/1978 | Krob | A63C 7/1026 | 280/605 |
| 4,135,728 | A * | 1/1979 | Salomon | A63C 7/102 | 280/605 |
| 4,496,167 | A * | 1/1985 | Krob | A63C 7/1013 | 280/605 |
| 4,577,586 | A | 3/1986 | Morris et al. | | |
| 4,813,371 | A | 3/1989 | Dakof et al. | | |
| 4,815,509 | A * | 3/1989 | Owen | A63C 11/00 | 206/315.1 |
| 4,899,692 | A | 2/1990 | Suzuki | | |
| 4,905,625 | A | 3/1990 | Funke | | |
| 5,042,839 | A * | 8/1991 | Ciari | A63C 5/06 | 15/237 |
| 5,209,780 | A | 5/1993 | Partel | | |
| 5,265,901 | A * | 11/1993 | Gorza | A63C 7/1013 | 280/605 |
| 5,324,062 | A * | 6/1994 | Rigal | A63C 7/1013 | 280/605 |
| 5,412,883 | A * | 5/1995 | Wulf | A43B 5/04 | 280/613 |
| 5,497,982 | A * | 3/1996 | Stoltz | A63C 11/04 | 269/242 |
| 5,516,141 | A * | 5/1996 | Stritzl | A63C 7/104 | 188/6 |
| 5,597,344 | A | 1/1997 | Bocquet | | |
| 5,620,519 | A | 4/1997 | Affeldt | | |
| 5,642,897 | A * | 7/1997 | Couderc | A63C 5/075 | 280/605 |
| 6,162,115 | A | 12/2000 | Schudrich | | |
| 6,644,683 | B1 * | 11/2003 | Hauglin | A43B 5/0411 | 280/613 |
| 6,659,494 | B1 | 12/2003 | Martin | | |
| 6,663,094 | B2 * | 12/2003 | Weissenborn | A63C 11/26 | 269/131 |
| 7,090,227 | B2 * | 8/2006 | Morin | A63C 5/031 | 280/14.1 |
| 7,458,598 | B2 * | 12/2008 | Giffin | A63C 9/02 | 280/605 |
| 7,887,084 | B2 | 2/2011 | Howell | | |
| 8,342,495 | B2 * | 1/2013 | Weissenborn | A63C 11/26 | 269/101 |
| 8,827,302 | B2 | 9/2014 | Fritschi et al. | | |

FOREIGN PATENT DOCUMENTS

| | | | |
|---|---|---|---|
| DE | 2164596 | A1 | 6/1973 |
| DE | 3237753 | A1 | 4/1984 |
| DE | 8533909 | U1 | 6/1986 |
| DE | 8701613 | U1 | 3/1987 |
| DE | 3833103 | A1 | 4/1990 |
| DE | 9403293 | U1 | 5/1994 |
| DE | 29705702 | U1 | 5/1997 |
| EP | 0195729 | A1 | 9/1986 |
| EP | 0349352 | A2 | 1/1990 |
| EP | 0555164 | A1 | 8/1993 |
| EP | 0671189 | A1 | 9/1995 |
| EP | 1685880 | A1 | 8/2006 |
| EP | 1847305 | A1 | 10/2007 |
| EP | 2614864 | A1 | 7/2013 |
| EP | 2679340 | A2 | 1/2014 |
| JP | H0213484 | A | 1/1990 |
| JP | 2011050722 | A | 3/2011 |
| WO | WO9818530 | A1 | 5/1998 |
| WO | WO 2016161365 | A1 | 10/2016 |

OTHER PUBLICATIONS

Patent Cooperation Treaty, Notification of Transmittal of the International Preliminary Report on Patentability, dated May 2, 2017, EPO, see document for other details.

Patent Cooperation Treaty, Invitation to Pay Additional Fees and Where Applicable, Protest Fee, Jun. 14, 2016, see document for other details.

Patent Cooperation Treaty, Notification of Transmittal of the International Search Report and the Written Opinion of the . . . see document for other details.

Pirmin Brunner, Frei Patentanwaltsburo, Communication pursuant to Rule 114(2) EPC, dated Aug. 13, 2018, European Patent Office, 80298 Munich, Germany, see document for details.

European Patent Office, EPO Form 2906 01.91TRI, regarding Application No. 16717038, Mar. 11, 2019, see document for details.

European Patent Office, Search Results Under Rule 164(2)(b) EPC, EPO Form P0459R, regarding Application No. 16717038, Mar. 3, 2019, see document for details.

Yewebdar T Tadesse, Applicant-Initiated Interview Summary, USPTO form PTOL-413, regarding U.S. Appl. No. 14/545,164, Mar. 30, 2017, see document for details.

Yewebdar T Tadesse, Office Action, regarding U.S. Appl. No. 14/545,164, dated May 22, 2017, see document for details.

Yewebdar T Tadesse, Notice of Allowability, regarding U.S. Appl. No. 14/545,164, dated Jun. 26, 2017, see document for details.

* cited by examiner 510
506
160
110
158
707
508
304
318
320
322
314
312
310
306
308
302
316
324
101
707
310
510
508
158
304
101
506

SNOW SPORT EQUIPMENT WAXING DEVICE AND METHOD

CROSS-REFERENCES TO RELATED APPLICATION

This application claims the benefit of and priority to and is a continuation-in-part of prior U.S. Non-Provisional Utility application Ser. No. 14/545,164, entitled "SNOW SPORT EQUIPMENT WAXING DEVICE AND METHOD" and filed on Apr. 1, 2015, the entire content of the above document is hereby incorporated herein by reference as part of this application.

BACKGROUND

Technical Field

The disclosure relates at least to devices, methods and systems for waxing snow sport equipment, retracting ski brake arms and engaging equipment.

Discussion of Related Field

Waxing is a surface treatment used on winter sports equipment such as skis or snowboards. It consists of applying a layer of ski wax on the surfaces that come into contact with the snow (e.g., soles or sliding surfaces). Ski wax improves the smoothness of the treated surface and maximizes performance of the treated equipment. Various waxes can be applied for top performance in various snow conditions, such as icy or loose powder.

Wax can be manually applied cold on the sole of sporting equipment by spraying liquid ski wax or rubbing solid wax along the surface of the sole. The wax adheres to the surface of the sole. Subsequent scraping may be used to remove excess ski wax and level the layer of wax along the sole. Alternatively, hot wax may be manually applied to the sole when wax is heated past its melting point and is then deposited on the sole by, e.g., rollers or is dripped on the sole and smoothed by a heated plate.

Waxing of winter sporting equipment is usually performed manually by applying the wax on the sole to be treated and removing excess wax, particularly from edges of the equipment. This may be done using an iron to spread melted wax on the sole and a spatula to remove excess, or by heating the equipment itself and applying solid wax which then locally melts upon contacting the heated equipment. This can require substantial time investment for proper wax application, scraping off excess, and brushing to smooth the wax surface to prepare equipment for optimal performance.

Semi-automated waxing devices apply wax by passing skis or snowboards over a stationary roller which dips into a reservoir of melted wax. Equipment can be heated in advance of wax being deposited on them to allow for better wax absorption on porous equipment soles. These waxing devices then can scrape off excess wax with brushes and/or scraping mechanisms. These waxing devices require a great deal of space for operation since skis are passed over the roller so twice the lateral length of skis is required for operation. They are generally intended for use in professional equipment technician shops and ill-suited for public use. This requires foresight for those participating in winter sports to plan ahead on tuning up their equipment and trying to select wax products for snow conditions in the future. State of the art waxing devices are also unfit for use in outdoor environments and require professional oversight and training for use.

In either manual or semi-automated waxing, it is beneficial to select appropriate wax products to match snow conditions for optimal performance and desired results. However, when waxing equipment in advance one has to effectively make a best guess as to snow conditions in the future when participation in skiing or snowboarding will occur. This can lead to selection of improper wax with inaccurate characteristics for conditions the day of use. Also, either manual waxing or waxing performed by a technician requires substantial time investment by equipment owners which can be cumbersome.

A substantial unmet need in the art is for an automated device for applying wax to winter sport equipment that can be used publicly, requires a limited amount of space for operation, and assists in proper selection of wax for snow conditions.

The disclosure overcomes the problems of the prior art by providing an automated device which cleans winter sporting equipment, applies wax, and scrapes off excess wax while contained in a housing that requires limited space and assists in the selection of wax based on the most current snow conditions. The disclosure also provides for a public kiosk where skiers and snowboarders can insert their equipment and have it waxed on-site. This does not require either a significant time investment in manual waxing or cumbersome acts of bringing equipment to a technician ahead of time.

Ski brakes are designed to extend beyond the plane of the sole of skis and stop skis from sliding down the mountain when a skier's ski boots are removed from the skis. Although useful for stopping run away skis, unretracted ski brakes get in the way of performing various maintenance and other functions on the skis. Such functions may include cleaning, waxing, scraping, brushing, heating, tuning, sanding, sharpening, filling, repairing, etc.

In order to service skis, individuals maneuver the brakes into a retracted position. Ski brakes are often retracted manually and then secured in the retracted position with rubber bands and/or other objects and/or with an individual's hand. Individuals may also insert or load ski boots into the ski binding in order to retract the ski brakes. The use of rubber bands or other objects is problematic because rubber bands and other objects may break, get in the way of servicing the equipment, and/or be unable to retain the brakes in a retracted position for a sufficient amount of time to complete the services desired to be performed. The use of an individual's hand is problematic because the amount of force required to contract the brake arms and to maintain that contraction may exceed the individual's hand strength. Even if the individual's hand strength is sufficient for retracting and maintaining the retraction during a particular service, the individual's hand may experience fatigue if multiple services are performed if hot wax, chemicals and/or sharp objects are used, such may pose safety risks to individuals using such. Having an individual secure the brakes in a retracted position may require two people to service the equipment—one to secure the brakes and another to perform the service. Each of these approaches may result in dissatisfaction and/or inconsistency in the services sought to be performed and may require significant amounts of time. The use of a ski boot is problematic because it may require individuals to remove their ski boots and/or to carry extra boots to be inserted or loaded into the ski bindings. In addition, ski brakes may be removed in order to aid in servicing the equipment. Such may take time and tools, each of which may be inconvenient.

There is a lack of an automated process which engages the brake arms and maintains them in a retraction position and moves them out of the way while the skis and/or other equipment are automatically cleansed, brushed, waxed, scraped, heated, sanded, tuned, sharpened, filled, repaired, etc. in a way that minimizes user's involvement and minimizes the time it takes to accomplished the desired services.

In one or more embodiments, the disclosure overcomes the present problems by automatically engaging the ski bindings after the skis have been loaded into the disclosure, by retracting the ski brakes, and/or by temporarily maintaining the ski brakes in a retracted position to allow the skis and/or other equipment to be cleaned, waxed, scraped, brushed and/or for other services to be performed on the equipment. In one or more embodiments, the disclosure provides a counter force to the force exerted on the equipment by apparatuses while the equipment is being serviced.

SUMMARY

In one aspect an automated device for waxing snow sport equipment may include: a mounting mechanism for securing at least one pair of skis or at least one snowboard; a cleaning portion for cleaning said at least one pair of skis or snowboard; a waxing portion for depositing wax upon at least a portion of a sole of said at least one pair of skis or snowboard, a scraping portion for removing excess wax deposited by the waxing portion; wherein said automated device may include a motor capable of displacing said cleaning portion, said waxing portion, and said scraping portion along said at least one pair of skis or snowboard to provide automatic waxing of said at least one pair of skis or snowboard.

Implementations may include one or more of the following features. The automated device for waxing snow sport equipment may include a mounting mechanism, a motor, a cleaning portion, a waxing portion, and a scraping portion all disposed within a housing. The automated device for waxing snow sport equipment may include a housing including a user interface which allows a user to select wax type, select wax application process steps, and perform payment for waxing said at least one pair of skis or snowboard. The automated device for waxing snow sport may include a housing including multiple types of wax which may be selectively applied to said at least one pair of skis or snowboard by said waxing portion. The automated device for waxing snow sport equipment may include a housing including a system which selects the appropriate wax from the multiple types of wax for ski or snowboard conditions at the time of the device's use. The automated device for waxing snow sport equipment may include a programmable processor and an interface for receiving real-time information on ski or snowboard conditions. The automated device for waxing snow sport equipment may include a scraping portion including a receptacle for collecting any excess wax removed by said scraping portion, a heating device for melting said collected excess wax, and a wax dispensing device for reusing said melted collected excess wax in subsequent wax applications. The automated device for waxing snow sport equipment may include a waxing portion including at least one roller for applying hot wax to at least a portion of a sole of said at least one pair of skis or snowboard. The automated device for waxing snow sport equipment may include a locking mechanism for securing said at least one pair of skis or snowboard on said mounting mechanism and providing adequate exposure and resistive force to allow said cleaning portion, said waxing portion, and said scraping portion to effectively clean, wax, and scrape said at least one pair of skis or snowboard. The automated device for waxing snow sport equipment may include a cleaning portion, a waxing portion, and a scraping portion aligned on a carriage such that said motor displaces said carriage to clean, wax, and scrape a portion of a sole of said at least one pair of skis or snowboard in a single pass of said carriage. The automated device for waxing snow sport equipment may include a cleaning portion, a waxing portion, and a scraping portion aligned on a carriage such that said motor displaces said carriage in a first pass to align said cleaning portion with said at least one pair of skis or snowboard, said motor displaces said carriage in a second pass to align said waxing portion with said at least one pair of skis or snowboard, and said motor displaces said carriage in a third pass to align said scraping portion with said at least one pair of skis or snowboard. The automated device for waxing snow sport equipment may include a mechanism for displacing said cleaning portion, said waxing portion, and said scraping portion on said carriage such that said cleaning portion aligns with said at least one pair of skis or snowboard during said first pass, said waxing portion aligns with said at least one pair of skis or snowboard during said second pass, and said scraping portion aligns with said at least one pair of skis or snowboard during said third pass. The automated device for waxing snow sport equipment may include a cleaning portion, a waxing portion, and a scraping portion aligned on a carriage such that said motor displaces at least two of said cleaning portion, waxing portion, and scraping portion in a single step. The automated device for waxing snow sport equipment may include a brushing portion for brushing wax after said scraping portion scrapes said at least one pair of skis or snowboard in multiple steps.

In one aspect a method for using an automated method for waxing snow sport equipment may include: securing at least one pair of skis or snowboard on a mounting mechanism; displacing a carriage at least once along said at least one pair of skis or snowboard to perform: cleaning said at least one pair of skis or snowboard; applying wax to at least a portion of the sole of said at least one pair of skis or snowboard; removing excess wax deposited during the applying wax step; and releasing said at least one pair of skis or snowboard from said mounting mechanism upon said wax being substantially cooled.

Implementations may include one or more of the following steps: The securing step may include inserting one end of said at least one pair of skis or snowboard in a lower portion track and displacing an upper portion track to contact a second end of said at least one pair of skis or snowboard and lock said at least one pair of skis or snowboard during said cleaning, applying wax, and removing excess wax steps. The method for using an automated method for waxing snow sport equipment may include automatically performing said securing step upon insertion of said at least one pair of skis or snowboard. The step of displacing a carriage may include performing all of said steps of cleaning, applying wax, and scraping excess wax in a single pass of said carriage along said at least one pair of skis or snowboard. The step of displacing a carriage may include performing each of said steps of cleaning, applying wax, and scraping excess wax in separate passes of said carriage along said at least one pair of skis or snowboard. The step of displacing a carriage may include performing at least two of said steps of cleaning, applying wax, and scraping excess wax in a single pass of said carriage along said at least one pair of skis or snowboard. The applying wax step may include rolling heated wax along at least a portion of a sole of said at least one pair of skis or snowboard. The removing excess wax step may include a step of brushing. The waxing step may include selecting a type of wax from a variety of wax types. The step of selecting a type of wax may be performed based at least in part on current ski conditions.

In another aspect a brake engagement device for retracting ski brake arms, may include: an engagement surface configured to engage at least one ski; wherein each ski may include at least one ski binding and at least a first surface and a second surface; wherein each ski binding may include at least one heel piece; wherein each heel piece may include at least one heel cup, at least one heel pedal, and at least one brake arm; and wherein the engagement surface is configured to fit between each heel cup and each brake pedal and to rotate around at least one axis to engage each brake pedal and secure each brake arm in a retracted position.

Implementations may include one or more of the following features. The brake engagement device is configured to move along a track in order to engage each heel piece. The brake engagement device is configured to automatically locate each heel piece. The engagement surface is spring loaded and configured to automatically adjust to the different geometrically situated surfaces located on each ski as the engagement surface encounters said surfaces. The brake engagement device is configured to automatically fit the engagement surface between each heel cup and each brake pedal and to automatically rotate around the at least one axis to engage each brake pedal and secure each brake arm in a retracted position. The engagement surface compresses each brake pedal as the engagement surface rotates around at least one fulcrum point provided by each heel cup. The engagement surface is configured to provide a first surface force against at least one surface of each ski while a first opposing surface force is provided by a source other than the brake engagement device on at least another surface of each ski. The brake engagement device may include at least one support arm pivotably configured to the engagement surface for at least aiding in the engagement surface's movement. The brake engagement device may include at least one engagement arm configured to the engagement surface for at least aiding in the engagement surface's movement. The brake engagement device may include: at least one side plate; at least one support arm; and at least one engagement arm; wherein the at least one engagement arm is configured to the engagement surface; wherein the at least one engagement arm is pivotably configured to the at least one support arm such that the at least one engagement arm may rotate around the at least one axis; wherein the at least one support arm is pivotably configured to the at least one side plate such that the at least one support arm may rotate around an alternate axis; and wherein the at least one support arm's ability to rotate around the alternate axis and the at least one engagement arm's ability to rotate around the at least one axis allows the brake engagement device adjust to and engage skis and ski bindings of various dimensions. The brake engagement device may include at least one support bar to engage at least one surface of the at least one ski and prevent it from rotating at least in one direction while the engagement surface compresses each brake pedal as the engagement surface rotates around at least one fulcrum point provided by each heel cup. The brake engagement device may include: a shaft configured to the engagement surface, wherein the shaft rotates the engagement surface around the at least one axis; a sliding mechanism pivotably configured to the shaft; wherein the sliding mechanism is configured to slide the shaft at least in two directions relative to each ski to allow the brake engagement device to adapt to skis and ski bindings of various dimensions; wherein the sliding mechanism positions the engagement surface between each heel cup and each brake pedal; and wherein the shaft rotates the engagement surface around the at least one axis and causes the engagement surface to engage each brake pedal, retract each brake arm, and maintain each brake arm in a retracted position.

In another aspect a method for retracting ski brake arms, may include: loading at least one ski onto a mounting mechanism to be engaged by a brake engagement device; wherein each ski may include at least one ski binding, wherein each ski binding may include at least one heel piece, wherein each heel piece may include at least one heel cup, at least one heel pedal, and at least one brake arm; seating the engagement surface of the brake engagement device between each heel cup and each brake pedal; and articulating the engagement surface onto each brake pedal by rotating the engagement surface around at least one axis to secure each brake arm in a retracted position.

Implementations may include one or more of the following features. The mounting mechanism may include a wall. Each ski is loaded onto the wall such that each brake arm engages the wall; and articulating a tip engagement device around at least one axis such that a first bar engages the sole of each ski with a force towards the sole of each ski and around at least one axis such that a second bar engages the top of each ski with a force towards the top of each ski, and pressing each brake arm towards the wall and moving each brake arm at least towards a retracted position. The method may include maintaining the engagement of the sole of each ski with a force toward the sole and maintaining the engagement of the top of each ski with a force toward the top. The method may include displacing the brake engagement device along a track to allow the engagement surface to engage each heel piece; and further displacing the brake engagement device along the track to position the engagement surface over each heel cup; wherein both said displacing steps are performed after the loading step but before the seating and articulating steps. The method may include reversing the direction of the brake engagement device to displace the engagement surface against each heel cup. The method may include maintaining the securement of each brake arm in a retracted position.

In another aspect a method for disengaging the retraction of ski brake arms, may include: loading at least one ski onto a mounting mechanism to be engaged by a brake engagement device; wherein each ski may include at least one ski binding, wherein each ski binding may include at least one heel piece, wherein each heel piece may include at least one heel cup, at least one heel pedal, and at least one brake arm; seating the engagement surface of the brake engagement device between each heel cup and each brake pedal; articulating the engagement surface onto each brake pedal by rotating the engagement surface around at least one axis to secure each brake arm in a retracted position; and disengaging and displacing the engagement surface so that distance is created between the engagement surface and each heel cup.

Implementations may include one or more of the following features. The method may include: articulating the engagement surface around at least one axis such that a front portion of the engagement surface rotates towards the top of each ski and a rear portion of the engagement surface rotates away from each heel cup, thereby positing the engagement surface such that its rear portion is above its front portion. The method may include: displacing the engagement surface towards home position such that the engagement surface articulates over each heel piece.

In another aspect a tip engagement device for locating and engaging elongated recreational equipment, may include: a first bar; a second bar; and a shield; wherein the shield engages the tip of at least one ski or at least one snowboard and causes the tip engagement device to rotate such that the first bar engages the sole of the at least one ski or at least one snowboard and provides a force toward the sole of the at least one ski or at least one snowboard and such that the second bar engages the top of the at least one ski or at least one snowboard and provides a force towards the top of the at least one ski or at least one snowboard, and wherein when the first bar provides a force toward the sole of at least one ski or at least one snowboard and the second bar provides a force toward the top of at least one ski or at least one snowboard, the camber of at least one ski or at least one snowboard is at least reduced and each ski or each snowboard is brought into substantially a single plane.

Implementations may include one or more of the following features. The tip engagement device is configured to move along a track in order to at least engage the tip of at least one ski or at least one snowboard. The tip engagement device is configured to automatically adjust to various ski and snowboard dimensions by causing the first bar to rotate at least until the second bar engages the top of at least one ski or at least one snowboard. The tip engagement device may include a casing; at least one stationary arm; and at least one swing arm; wherein the at least one stationary arm is pivotably configured to the at least one swing arm such that the at least one swing arm freely hangs from the at least one stationary arm and rotates around an axis; and wherein the swing arm is pivotably configured to the casing such that the casing rotates around an alternate axis. The first bar is configured to locate and engage the tip of each ski or each snowboard as the tip engagement device moves toward each ski or each snowboard; and wherein once the first bar locates and engages the tip of each ski or each snowboard, the casing rotates around the first bar and the at least one swing arm rotates around an axis and the at least one swing arm rotates around the at least one stationary arm via the alternate axis, the first bar temporarily securing the tip of each ski in position and the second bar presses against at least one surface of each ski and reduces the camber of each ski to substantially a single plane.

In another aspect a method for engaging skis or snowboards, may include: loading at least one ski or at least one snowboard onto a mounting mechanism to be engaged by a tip engagement device, and articulating a tip engagement device around at least one axis such that a first bar engages the sole of each ski with a force towards the sole of each ski or each snowboard and around at least one axis such that a second bar engages the top of each ski or each snowboard with a force towards the top of each ski or each snowboard, and at least reducing the camber of each ski or each snowboard and bring each ski or each snowboard into substantially a single plane.

Implementations may include one or more of the following features. The method may include displacing the tip engagement device along a track to engage the tip of each ski or each snowboard. The method may include maintaining the engagement of the sole of each ski or each snowboard with a force toward the sole and maintaining the engagement of the top of each ski or each snowboard with a force toward the top. The method may include displacing the tip engagement device so that it articulates around at least one axis such that second bar is away from the top of each ski or each snowboard and such that first bar is disengaged from the sole of each ski or each snowboard. The method may include articulating an engagement surface around at least one axis against the top of each ski or each snowboard so as to provide that each ski or each snowboard is properly positioned; and maintaining said engagement of the engagement surface on the top of each ski or each snowboard.

In one aspect a system, may include: a mounting mechanism for inserting at least one ski or at least snowboard into the system; a brake engagement device; a carriage may include at least one of the following: a brushing portion, a waxing portion, a scraping portion and at least one heating element for performing at least one of the following functions on each ski or each snowboard: cleaning, waxing, heating, scraping and brushing; and a track configured to move the brake engagement device and the carriage along the track.

Implementations may include one or more of the following features. Brake engagement device moves along track to secure each brake arm in a retracted position. The system may include a tip engagement device which may include: a first portion; a second portion; and a third portion; wherein the third portion engages the tip of at least one ski or at least one snowboard and causes the tip engagement device to rotate such that the first portion engages the sole of the at least one ski or at least one snowboard and provides an upward force against the sole the same and such that the second portion engages the top of the at least one ski or at least one snowboard and provides a downward force against the sole the same; and wherein when the first portion provides an upward force against the sole of at least one ski or at least one snowboard and the second portion provides a downward force against the top of at least one ski or at least one snowboard, the camber of at least one ski or at least one snowboard is at least reduced and each ski or each snowboard is brought into substantially a single plane. The system may include: a wall which may include at least one surface upon which each ski or each snowboard may be inserted; wherein the wall is configured to rotate away from each ski or each snowboard so that the carriage may engage each ski or each snowboard. The at least one surface of the wall provides force to each brake arm while a counter force is exerted on each brake arm to aid in the retraction of each brake arm. The system may include a mounting block which may include at least one surface for providing a supporting force to each ski or each snowboard.

These general and specific aspects may be implemented by using systems, apparatuses, devices, means, methods and/or structures, and/or any combination thereof.

Certain implementations may provide one or more of the following advantages. Embodiments may not achieve any or all of the listed advantages. Further, this is not an exhaustive list of all possible advantages of the disclosure. One or more embodiments of the disclosure may be configured to be and/or provide users the following.

In one or more embodiments, the disclosure provides an automated device for applying wax to winter sport equipment. In one or more embodiments, the disclosure provides an automated device which cleans winter sporting equipment, applies wax, and scrapes off excess wax. In one or more embodiments, the disclosure provides the ability to at least perform one of the following services on the equipment: clean, brush, wax, scrape, heat, sand, tune, sharpen, fill and repair and/or perform other services on the equipment in one or more embodiments, the disclosure reduces the amount of space required for operation. In one or more embodiments, the disclosure assists in proper selection of wax for snow conditions in one or more embodiments, the disclosure is provided in a housing that requires limited space and assists in selection of wax based on most current snow conditions. In one or more embodiments, the disclosure provides for a public kiosk where skiers and snowboarders can insert their equipment and have it waxed on-site. In one or more embodiments, the disclosure reduces the amount of time it takes to accomplish the desired services (e.g. wax the equipment). In one or more embodiments, the disclosure minimizes a user's involvement it takes to accomplish the desired services. In one or more embodiments, the disclosure provides an automated process which retracts brake arms and maintains them in a retracted position and moves them out of the way while the equipment is automatically serviced. In one or more embodiments, the disclosure provides a counter force to the force exerted on the equipment by apparatuses while the equipment is being serviced.

Other aspects and advantages of embodiments of the present disclosure may become apparent from the following detailed description, accompanying drawings and/or claims.

BRIEF DESCRIPTION OF THE DRAWINGS

Various embodiments of the disclosure will now be discussed with reference to the appended drawings. It is appreciated that these drawings depict only typical embodiments of the disclosure and are not to be considered limiting of its scope.

DETAILED DESCRIPTION

Figure 1:
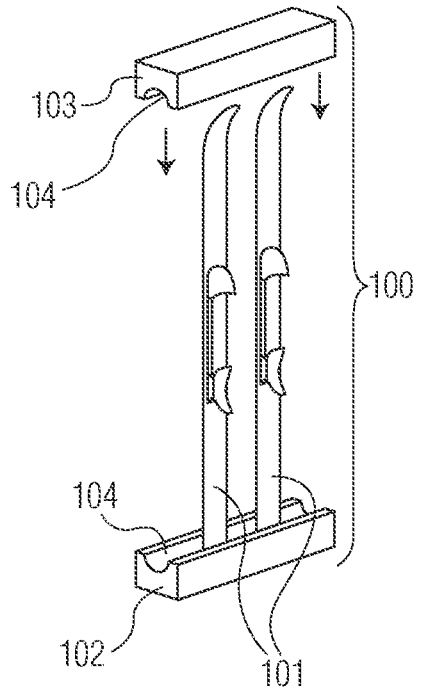
FIG. 1 depicts one embodiment of a rack for securing a pair of skis or a snowboard.

The following description illustrates principles of the disclosure which may be applied in various ways to provide different embodiments. There may be many different forms of embodiments of the disclosure, and as such, embodiments should not be limited to those set forth herein and shown in the accompanying drawings. While exemplary embodiments of the disclosure may be shown and described herein, changes and modifications may be made without departing from its scope and concepts. That which is set forth herein and shown in the accompanying drawings is offered to illustrate the principles of the disclosure and not as limitations. Other variations of the disclosure may be included within the principles of the disclosure.

The descriptions of the disclosure expressly, inherently and/or illustrated herein, may be implemented in none, one and/or more than one embodiment. Regardless of whether disclosed expressly, inherently and/or illustrated herein, the disclosure may be configurable, adaptable and customizable to meet the various needs of various users in various circumstances and/or to be compatible and/or used in conjunction with various systems, apparatuses, articles, devices, means, methods and/or structures.

The disclosure may be configured in various ways, by various means and/or various methods, with various parts, to various dimensions (such as but limited to shapes, lengths, widths, heights, depths, and/or sizes) and/or with and/or from various materials, and/or any combination thereof. The specific parts, materials, members, devices, systems and/or components of the disclosure may be configured together and/or separate and/or with other materials, members, devices, systems and/or components and/or any combination thereof.

In one or more embodiments, the materials used to configure the disclosure may include metals (such as aluminum like extrusion aluminum, iron, copper, etc.), nonmetals, metalloids, ceramics, polymers and plastics (such as rubbers, PVC, PC, etc.), alloys, woods and natural products, and the like other materials. The materials used may have various characteristics. For example, in one or more embodiments, the materials may be able to withstand extremely high and/or low temperatures, rain, snow, sleet, hail, wind, storms, sun, and various other weather conditions. The materials may be able to withstand such conditions for years. Materials may include hoses, piping, clamps, fittings, valves, barbs, ties, tubing, cables, wires, ropes, tape, chains, straps, nuts, bolts, axels, shafts, gears, sprockets, bearings, bushings, flanges, pulleys, counter weights, motors, cylinders, pneumatic pumps, power sources, electronics, wires and the like and other materials, means and/or combinations thereof. The disclosure may be configured by various ways which may include welding, melting, burning, gluing, cementing, screwing, fitting, snapping, clamping, clipping, pining, bolting, screwing, nailing, chaining, adhering, pressing, cutting, lasering, fastening, hooking, attaching, securing, connecting, pinching, cleaving, clinging, clasping, latching, machining, sticking, sliding, locking, tying, welding and the like and other ways.

The drawings herein may but do not necessarily illustrate the disclosure to scale. The drawings herein may but do not necessarily depict the exact positions, shapes, sizes, layouts, designs, angles and/or other dimensions and/or configurations in which the disclosure may be implemented.

The disclosure may include various hardware components and software which may enable it to perform the described and other functions. For example, in one or more embodiments, the disclosure may include a server system and/or other computing resources remotely located and accessed through one or more networks, such as, wide area networks, local area networks, public networks, private networks and/or hybrid networks, and/or other network types, and/or any combinations of the same, along with all related software and/or hardware, whether developed later or known at the time of filing. Computing resources may communicate via the Internet. In one or more embodiments, the disclosure may include one or more websites designed to be a location wherein users may input information, retrieve information, and/or initiate instructions for action. The websites may be hosted on at least one web server accessible via a network such as, the Internet. In one or more embodiments, the disclosure may include software applications, such as, web applications, native applications, and/or mobile applications which may receive user input, retrieve information from a server system, send information to a server system, initiate instructions for action, and/or be embedded in device and/or system hardware. In one or more embodiments, the disclosure may use operating systems, along with all related software and/or hardware. In one or more embodiments, the disclosure may include memory systems, along with all related software and/or hardware, such as RAM, hard drives flash memory, cache memory, and/or any other device and/or means for storing data, and/or any combinations thereof, whether developed later or known at the time of filing. In one or more embodiments, the disclosure may include processing systems, along with all related software and/or hardware, including, for example, CPUs. In one or more embodiments, the disclosure may include electronic mediums to exchange data between the system and/or components. In one or more embodiments, the disclosure may be capable of receiving input and/or generating output. The input provided to the system may be made through input devices and/or other means, along with all related software and/or hardware, such as, keyboards, mice, voice command, action translation technology, CD's, DVD's, USB storage devices, wirelessly, user interfaces, and/or other means for inputting data into the system, whether developed later or known at the time of filing. The output generated may be stored on any storage medium, printed, displayed on any display device, distributed in any way (such as, to mobile devices, online, over networks, via text, email, phone, etc.), accessed in any way (such as, remotely), and/or used in any way, whether developed later or known at the time of filing.

The disclosure may be used for various uses and/or for various purposes. For example, in one or more embodiments, the disclosure may be used to wax snow sport equipment and/or retract ski brake arms.

FIG. 1 depicts one embodiment of a mounting mechanism 100 for securing at least one pair of skis 101 or one or more snowboards (not shown) according to the disclosure. At least one ski, such as a pair of skis 101, at least one snowboard, and/or the other elongated recreational equipment, and all components and accessories which may be configured thereto, are generally and collectively referred to herein as the "equipment". Although FIG. 1 and other figures and descriptions contained herein may show and/or describe the disclosure engaging and/or servicing a pair of skis (such as pair of skis 101), the disclosure may engage and/or perform services on one or more skis and/or other equipment (such as snowboards) at a time. In one or more embodiment, sensors may determine the type of equipment inserted into mounting mechanism 100. In one or more embodiment, a user may indicate the type of equipment inserted into mounting mechanism 100 via a user interface 211 (as discussed below). In one or more embodiments, the disclosure may service telemark skis (that is, free-heel skis with no heel pieces) and/or alpine skis (that is, skis with heel pieces).

Mounting mechanism 100 could be, for example, a track, a clamp, a flat surface, a strap, an elastic cord, or any other mechanism for securing elongated curved surfaces such as skis 101. A user of an automated waxing device may open a housing or kiosk to access mounting mechanism 100 or mounting mechanism 100 may be free standing. In the example of FIG. 1, a user can insert a bottom end of skis 101 in lower track portion 102 of mounting mechanism 100. This lower track portion 102 can be fixed or have some mobility to provide appropriate resistance to support at least one pair of skis 101 or one or more snowboards (not shown). Upper track portion 103 of mounting mechanism 100 can be manually lowered to secure skis 101 or can be automatically lowered by a motor until skis 101 are secured and then temporarily fixed in place. This allows a variety of ski and snowboard heights and widths to be accommodated by an automated waxing device during cleaning, waxing, and scraping. Lower track portion 102 and upper track portion 103 may also have various indentations 104 to aid in securing at least one pair of skis 101 or one or more snowboards (not shown). The indentations in lower track portion 102 and upper track portion 103 expose at least a significant portion of the sole of skis 101 for cleaning, application of wax, and scraping. Mounting mechanism 100 may also include a locking mechanism for locking skis 101 in place during operation of the automatic waxing device. The locking mechanism may secure the at least one pair of skis or at least one snowboard and provide adequate exposure and resistive force to allow the cleaning device, the waxing mechanism, and the scraping mechanism to effectively clean, wax, and scrape the at least one pair of skis or at least one snowboard. The locking mechanism will release when skis 101 are dry and ready for removal by a user. Upper track portion 103 and lower track portion 102 may also include materials along their inner surface which provide some elasticity to assist in holding skis 101 in place without damaging them, for example, rubber, polystyrene, or foam rubber.

Figure 2:
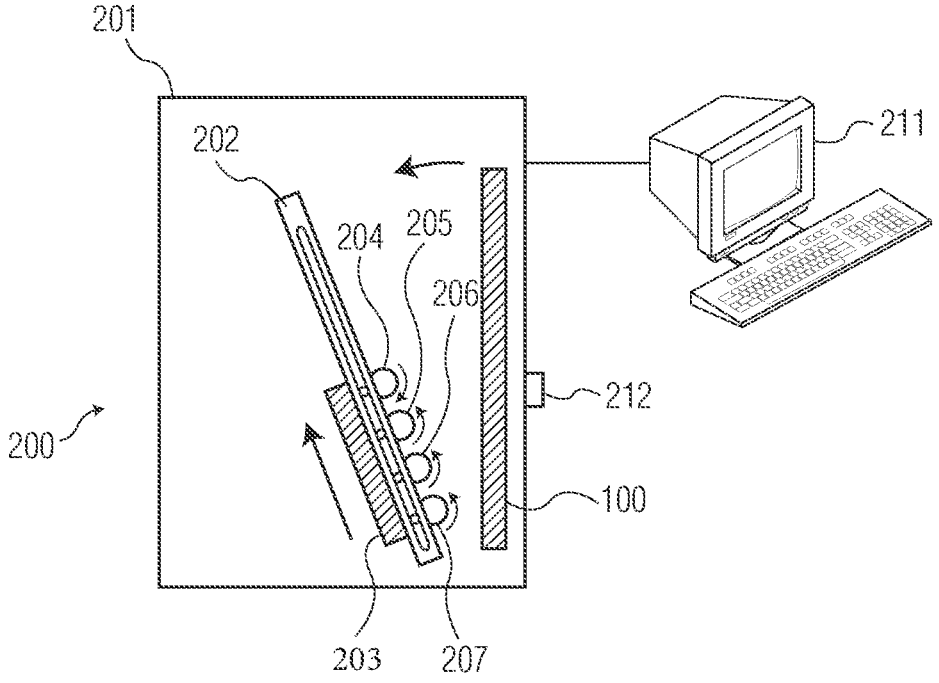
FIG. 2 depicts a cross section of one embodiment of an automated waxing device according to the disclosure.

FIG. 2 depicts a cross section of an automated waxing device 200. A user may input information such as snow conditions, type of skier/rider, make and model of skis/snowboard, desired type of wax, etc. into user interface 211. Further, user interface may also allow a user to perform payment for use of automated waxing device 200. User interface 211 may be a computer which can obtain snow conditions automatically and can automatically aide in the selection of, for example, the type of wax and steps for applying such wax. User interface 211 may allow a user to open housing 201 to insert their winter sporting equipment for automatic waxing upon, for example, receiving authorization of payment and instructing a locking mechanism 212 to unlock a door. Mounting mechanism 100 is initially aligned substantially vertically for a user to manually or automatically secure at least one pair of skis or at least one snowboard as described in reference to FIG. 1. Once skis 101 are secured, a housing 201 around automated waxing device 200 may be closed to keep cleaning or wax detritus from splattering beyond the housing. Automated waxing device 200 includes a track 202 which can be fixed. Carriage 203 moves along track 202 displacing at least one of the following: a cleaning portion 204 (also referred to herein as cleaning device 204 and cleaning mechanism 204), a waxing portion 205 (also referred to herein as waxing device 205 and waxing mechanism 205), a brushing portion 206 (also referred to herein as brushing device 206 and brushing mechanism 206), and a scraping portion 207 (also referred to herein as scraping device 207 and scraping mechanism 207). Mounting mechanism 100 can be lowered to meet track 202 and align skis 101 such that cleaning portion 204, waxing portion 205, brushing portion 206, and scraping portion 207 will contact a sole of skis 101 and perform the desired cleaning, waxing, brushing, and scraping. Alternatively, mounting mechanism 100 can be fixed and track 202 can be raised to meet mounting mechanism 100. The substantially vertical alignment of automated waxing device 200 is particularly advantageous as compared to any prior art device at least because it requires the least horizontal footprint for performing cleaning, waxing, scraping, and brushing. In the configuration depicted in FIG. 2, cleaning portion 204, waxing portion 205, brushing portion 206, and scraping portion 207 are substantially cylindrical shaped and can be rotated by one or more motors 208. These one or more motors 208 can also move carriage 203 along track 202 to perform the automated cleaning, waxing, brushing, and scraping.

Figure 3:
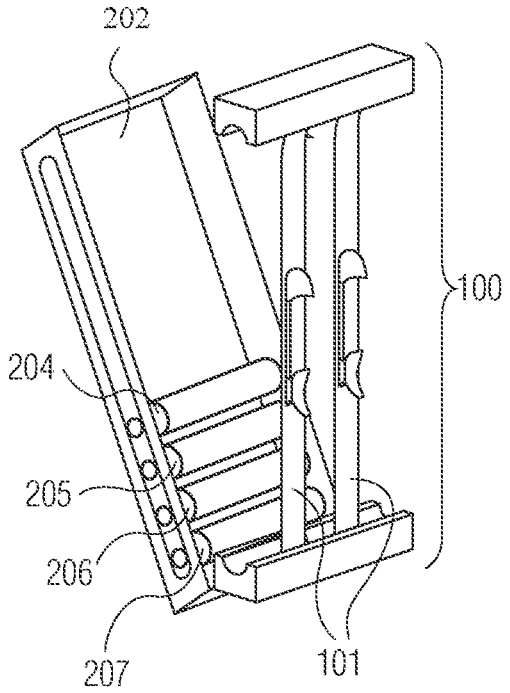
FIG. 3 depicts a rotated view of the automated waxing device of FIG. 2.

FIG. 3 depicts a rotated view of the automated waxing device of FIG. 2. In this configuration, mounting mechanism 100 rotates toward track 202 to align skis 101 with cleaning portion 204, waxing portion 205, brushing portion 206, and scraping portion 207 so that such will contact a sole of skis 101 as carriage 203 moves up track 202 and performs the desired cleaning, waxing, brushing, and scraping.

Figure 4:
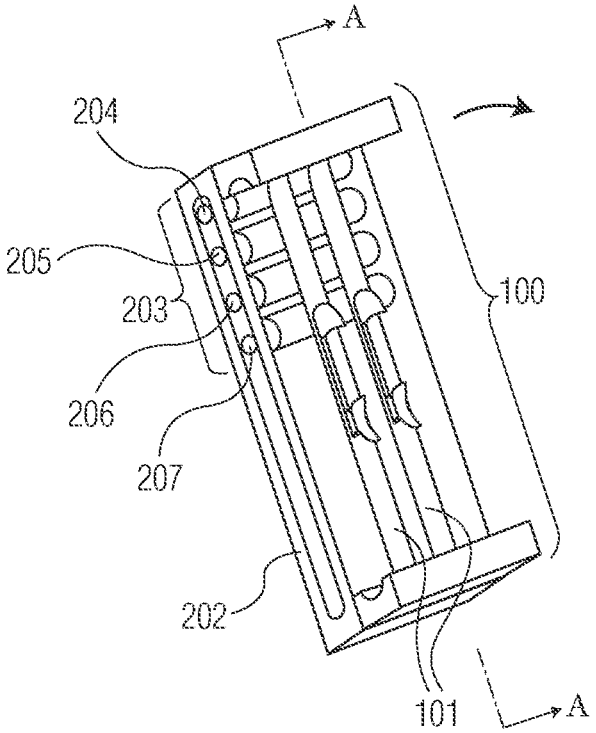
FIG. 4 depicts the automated waxing device of FIG. 3 in a closed configuration.

FIG. 4 depicts the automated waxing device of FIG. 3 in a closed configuration with mounting mechanism 100 and track 202 brought into substantial proximity to allow cleaning portion 204, waxing portion 205, brushing portion 206, and scraping portion 207 to contact a sole of skis 101 with adequate force to perform the automated cleaning, waxing, brushing, and scraping. The closed configuration may have skis 101 substantially vertical, level with the ground, or any degree of rotation in between.

Figure 5:
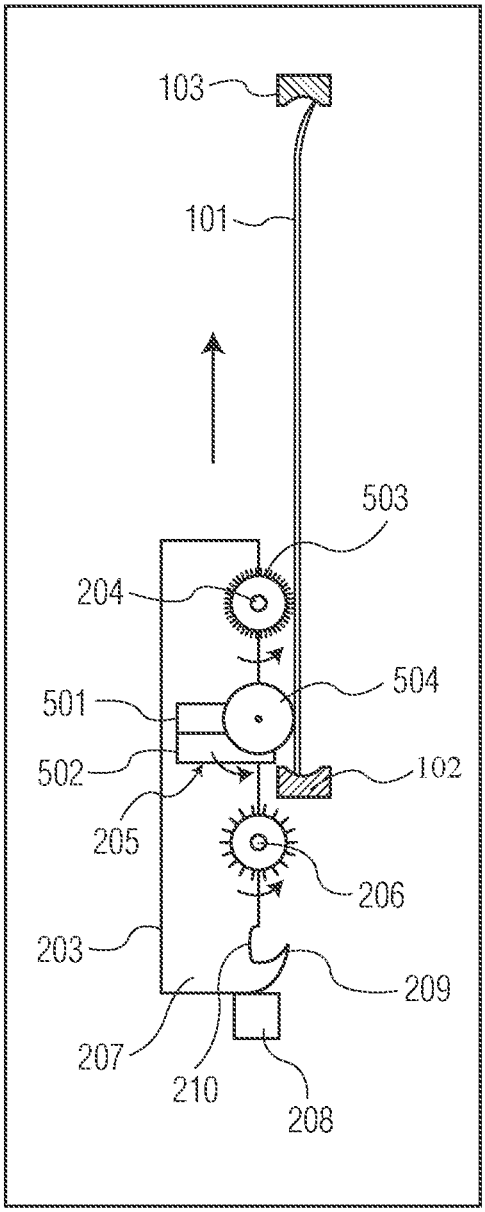
FIG. 5 depicts a cross section along plane A-A of the automated waxing device in FIG. 4.

FIG. 5 depicts a cross section along plane A-A of the automated waxing device in FIG. 4. Ski 101 is held in mounting mechanism 100 by upper track portion 103 and lower track portion 102. Carriage 203 aligns with skis 101 such that cleaning portion 204, waxing portion 205, brushing portion 206, and scraping portion 207 will contact a sole of skis 101 and perform the desired cleaning, waxing, brushing, and scraping along most of the surface of a sole of skis 101 regardless of the curvature of skis 101 as carriage 203 moves up the length of skis 101. This configuration provides a distinct advantage of not having to alter the plane of skis 101 during cleaning, waxing, brushing and scraping to account for curvature in the vertical shape along the longitudinal axis of skis 101.

Cleaning portion 204 may, for example, be a substantially cylindrical roller with damp course bristles 503. A dispensing device (not shown) such as a spray nozzle may dispense a cleansing agent on cleaning portion 204 which may be applied by spinning bristles 503 over a sole of skis 101. Alternatively, for example, cleaning portion 204 may apply a spray to a sole of skis 101 and remove the spray with bristles 503. Cleaning portion 204 may be made of materials and cleansing agents which clean a sole of skis 101 and remove, for example, snow, ice, slush, dirt, preexisting wax, or any other substance which can interfere with the application of wax to a sole of a ski or snowboard. Additionally, any cleansing agent dispensed by a dispensing device or applied by cleaning portion 204 may be composed to dry quickly to enable application of wax by waxing portion 205 soon after cleaning a portion of the sole of skis 101.

Waxing portion 205 may include, for example, a substantially cylindrical heated roller 504 which contacts wax block 501. A portion of wax block 501 melts upon being heated by heated roller 504 and is applied to a sole of skis 101 as it is carried along a portion of the circumference of heated roller 504 as it contacts skis 101 by virtue of the viscosity of the melted wax. Heated roller 504 may include, for example, grooves or indents which may align with skis 101 or a snowboard to better perform application of wax. Heated roller 504 may also locally heat a sole of skis 101 (or a snowboard) as it passes to improve wax absorption. Alternatively, carriage 203 may also include a heating element (not shown) which also heats skis 101. Wax block 501 may be carried by wax carriage 502 which includes a mechanism for maintaining contact between wax block 501 and heated roller 504. Additionally, wax carriage 502 may supply heat to heated roller 504. Also, for example, wax carriage 502 may collect and store unused melted wax drippings for future use. Automated waxing device 200 may allow for selection of wax blocks 501 based on current snow conditions and may dispense a wax block 501 which is placed upon or secured to wax carriage 502 prior to activating automated waxing.

Brushing portion 206 may be a substantially cylindrical rotating brush with, for example, fine bristles employed in smoothing wax in preparation for scraping. Brushing portion 206 may be rotated by motor 208 at a variety of speeds appropriate to provide desired texture according to the properties of wax applied to skis 101 and for the snow conditions. Alternatively, brushing portion 206 may be aligned below scraping portion 207 or a second brushing portion 206 may be aligned such that brushing occurs before and after scraping a sole of skis 101. In this example, a first brushing portion 206 may be of a more coarse texture to maximize effectiveness of scraping portion 207 and second brushing portion 206 may be of a more fine texture to ensure additional smoothing of a sole of skis 101. Second brushing portion 206 may only be optionally used as carriage 203 passes along a sole of skis 101 and may be disengaged from contacting skis 101 if snow conditions call for a less smooth wax application on a sole of skis 101.

Scraping portion 207 may be, for example, a hooked scraping edge 209 and a detritus collection area 210. As scraping portion 207 passes along a sole of skis 101, scraping edge 209 contacts wax applied by waxing portion 205 and scrapes off at least some wax to smooth the outer surface of the sole of skis 101. Scraping portion 207 may be formed of a material which provides adequate resistive force to enable an appropriate amount of scraping by scraping edge 209, or, alternatively, may consist of a spring mechanism to maintain contact between scraping edge 209 and a sole of skis 101. As an additional example, scraping edge may be a tapered hard plastic, a blade, a sharp edge, or any other known substance or configuration known in the art for scraping unwanted wax. As an additional example, scraping portion 207 can apply selective resistive force such that scraping edge 209 scrapes a desired amount of wax from selected wax block 501, or scrapes different portions of a sole of skis 101 differently (e.g., scrapes the center of a sole of skis 101 less than the upper or lower portions of a sole of skis 101). Scraping portion 207 may also contain wax collection area 210 which can collect wax scrapings from scraping edge 209 for recycling into new wax blocks 501. Scraping mechanism 207 may include a receptacle for collecting excess wax removed by scraping mechanism 207, a heating device for melting the collected excess wax, and a wax dispensing device for reusing the melted collected excess wax in subsequent wax applications.

Figure 6:
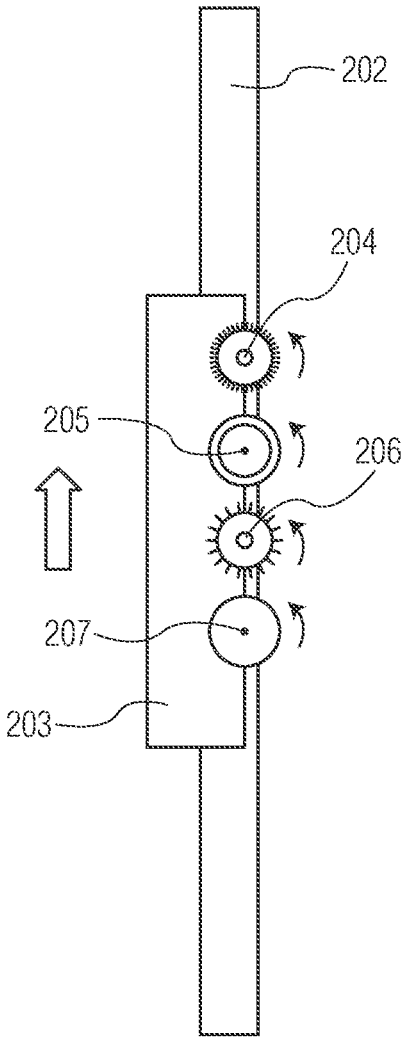
FIG. 6 depicts one embodiment of a displaceable cleaning portion, waxing portion, and scraping portion.

FIG. 6 depicts one configuration of carriage 203 where cleaning portion 204, waxing portion 205, brushing portion 206 and scraping portion 207 are substantially aligned in-line along the vertical axis of carriage 203. As motors 208 move carriage 203 up track 202, they may spin substantially cylindrical cleaning portion 204, waxing portion 205, and brushing portion 206, for example in a counter clockwise direction or in any way suitable for performing cleaning, waxing, and brushing. Alternatively, motors 208 may spin cleaning portion 204, waxing portion 205, and brushing portion 206 individually or together in a programmed manner to enable optimal wax application and smoothness for current snow conditions. In the example shown in FIG. 6, a single pass of carriage 203 along track 202 may be sufficient for complete cleaning, wax application, brushing, and scraping of a sole of ski 101. Alternatively, if additional deposition of wax layers is desired or programmed, carriage 203 may return to its starting position after completing one pass along track 202 and perform one or more additional passes along the length of skis 101 or a snowboard.

Figure 7:
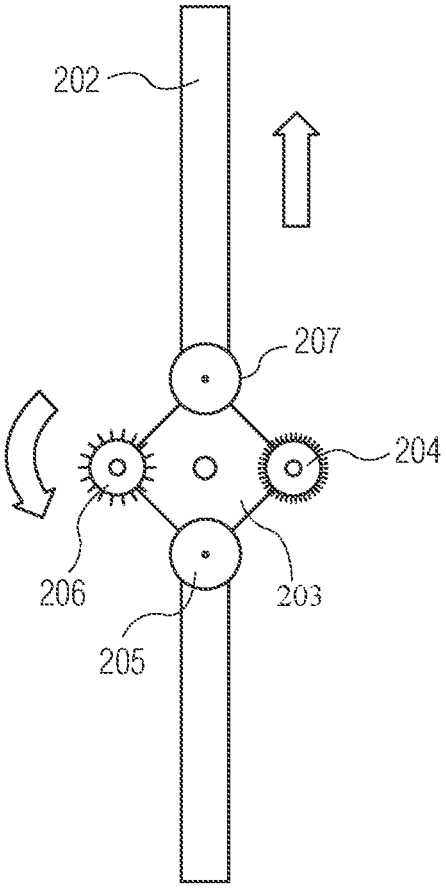
FIG. 7 depicts one embodiment of a displaceable cleaning portion, waxing portion, and scraping portion.

FIG. 7 depicts one configuration of carriage 203 where cleaning portion 204, waxing portion 205, brushing portion 206 and scraping portion 207 are each sequentially aligned to contact a sole of skis 101 during a single pass of carriage 203 along track 202. In the configuration of FIG. 7, motors 208 may rotate carriage 203 in its starting position such that cleaning portion 204 aligns to contact a sole of skis 101 in a first pass up track 202, then rotates carriage 203 such that waxing portion 205 aligns to contact a sole of skis 101 in a second pass down track 202, then rotates carriage 203 such that brushing portion 206 aligns to contact a sole of skis 101 in a third pass up track 202, and then rotates carriage 203 such that scraping portion 207 aligns to contact a sole of skis 101 in a fourth pass down track 202. This four-pass configuration may also require that carriage 203 always return to its starting position before motors 208 rotate carriage 203 so all steps are performed while passing up track 202.

Figure 8:
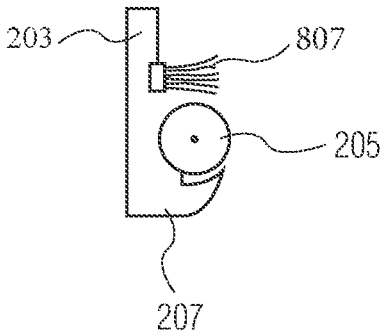
FIG. 8 depicts one embodiment of a displaceable cleaning portion, waxing portion, and scraping portion.

FIG. 8 depicts one configuration of carriage 203 with a fixed brushing portion 807 situated adjacent to a waxing portion 205 that also includes a brush texture, and a scraping portion 207. In this configuration of FIG. 8, brushing and waxing may be combined in a single step to reduce the number of passes of carriage 203 along track 202 to complete automated waxing of skis 101. Other configurations which combine cleaning, waxing, brushing and scraping are also possible to combine steps required for automated waxing of skis 101.

Figure 9:
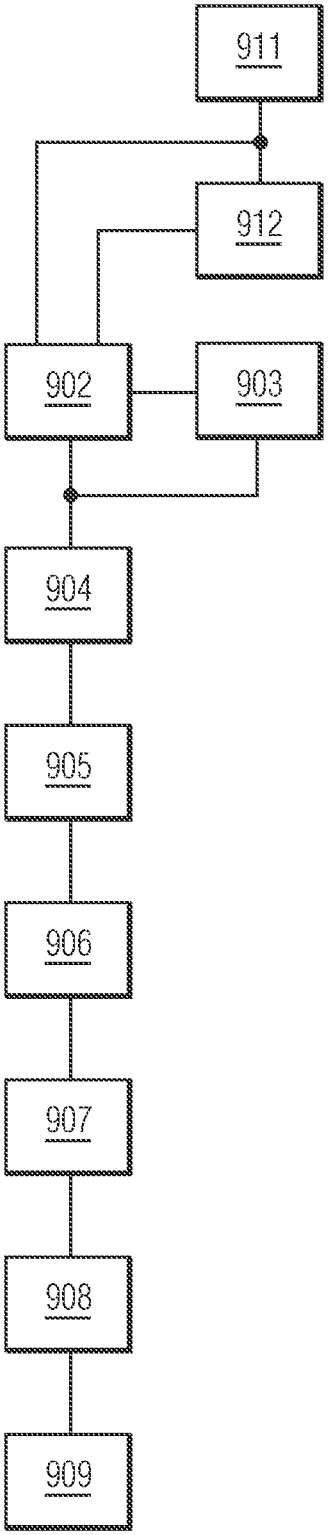
FIG. 9 depicts a flow diagram showing one embodiment of method steps according to the disclosure.

FIG. 9 depicts a flow diagram showing method steps according to one embodiment of the disclosure. In step 911 a user inputs information into a user interface 211 or provides information from, for example, a smartphone or contactless tag in a piece of snow sport equipment. This information can be, for example snow conditions, make and model of the snow sport equipment, size of the snow sport equipment, type of skier or rider, or any other information pertinent to selection of type of wax and process steps for optimal application of that type of wax. In optional step 912 a user may be required to provide payment for use of the automated waxing device 200 by any means of payment know in the art prior to the user interface instructing a locking mechanism 212 to allow access to the user. Alternately, no payment may be required for access.

Once access to a housing 201 is permitted in step 902, a user inserts at least one pair of skis 101 or snowboard into mounting mechanism 100. Mounting mechanism 100 may be manually operated by the user to secure ski 101, automatically operated by motors 208 to secure ski 101, or some combination thereof and housing 201 may be closed. Step 902 may be performed by displacing a lower portion track 102 or an upper portion track 103 to contact a first and second end of said at least one pair of skis or snowboard. If automated waxing device is so configured or a wax is manually selected by the user, a wax block 501 may be selected from a variety of wax blocks in step 903 based on the information input in step 911 and placed upon or secured to wax carriage 502. In 904 mounting mechanism 100 and carriage 203 are brought into proximity (either by moving one or both) to allow contact between cleaning portion 204, waxing portion 205, brushing portion 206 and scraping portion 207 and a sole of the inserted at least one pair of skis 101 or snowboard. In step 905 cleaning portion 204 cleans the at least one pair of skis 101 or snowboard. In step 906 waxing portion 205 applies wax (heated or at ambient temperature) to at least a portion of the sole of the at least one pair of skis 101 or snowboard. In step 907 a scraping portion removes excess wax deposited during step 906. Step 907 may also include brushing. In step 908, mounting mechanism 100 and carriage 203 are returned to substantially their original positions. In step 909 after a predetermined period of time to allow for cooling, locking mechanism 212 may be opened and the at least one pair of skis 101 or snowboard are released for removal from automated waxing device 200. Steps 905, 906, and 907 may be performed in a single pass of carriage 203 along track 202. Alternatively, steps 905, 906, and 907 may be performed in a more than one pass of carriage 203 along track 202. Further, steps 905, 906, and 907 may be performed in a pre-programmed manner to optimize application of wax for the type of wax selected in step 903.

Figure 10:
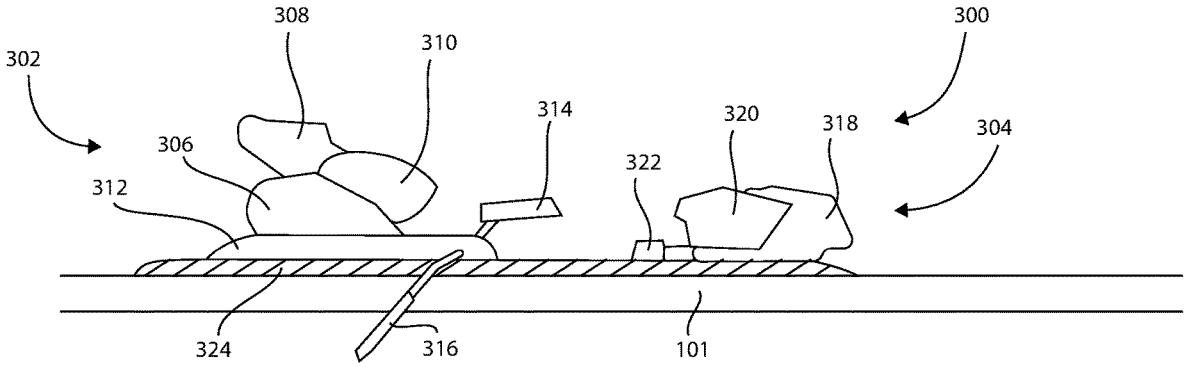
FIG. 10 depicts one embodiment of a ski binding.

FIG. 10 is one embodiment of aspects of a ski binding 300. In one or more embodiments, ski binding 300 may be configured to at least one ski (such as pair of skis 101) and/or other equipment. In one or more embodiments, each ski binding 300 may include a heel piece 302 and a toe piece 304. In one or more embodiments, each heel piece 302 may include a heel housing 306, a heel lever 308, a heel cup 310, a heel track 312, a brake pedal 314 and at least one brake arm 316. In one or more embodiments, each toe piece 304 may include a toe housing 318, a toe cap 320, and an anti-friction device (AFD) 322. In one or more embodiments, each ski binding 300 may be configured to a riser or mounting plate 324 and mounting plate 324 may be configured to the equipment. Although FIG. 10 shows one embodiment of ski bindings, there are numerous other configurations of ski bindings which the disclosure may engage, such as, for example, bindings manufactured and/or sold by Tyrolia, Rossignol, Look, Salomon, Marker, Atomic, Dynafit, G3, Fisher, Head, Black Diamond, etc. In one or more embodiments, the disclosure may engage all types of Alpine style ski bindings.

The disclosure may be configured in various ways to retract each brake arm 316 and temporarily securing each brake arm 316 in that retracted position, and/or to provide a counter force to the force being exerted on the equipment by carriage 203 and/or other apparatuses while the equipment is being serviced.

Figure 11:
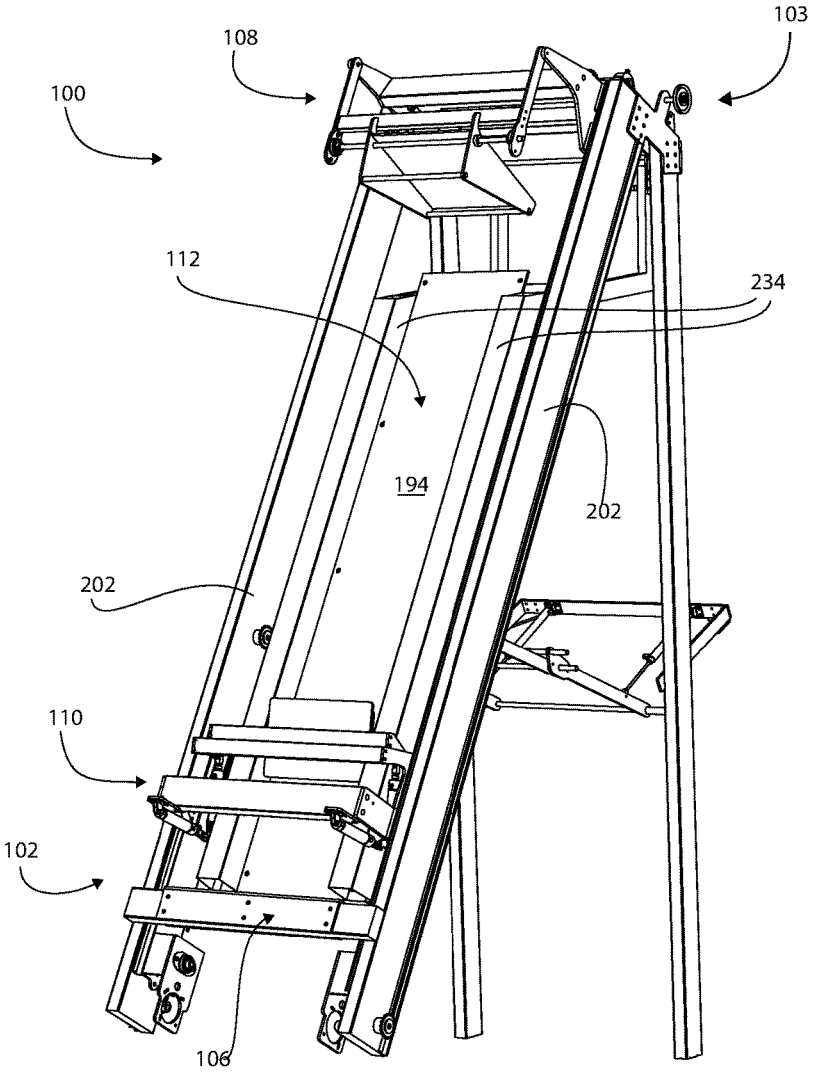
FIG. 11 depicts a front perspective view of one embodiment of a mounting mechanism including a wall, a tip engagement device, a mounting block, and a brake engagement device.

For example, FIG. 11 shows one embodiment of mounting mechanism 100 which may include a flat surface such as a wall 112; one embodiment of upper track portion 103 which may include a tip engagement device 108; and one embodiment of lower track portion 102 which may include a mounting block 106 and a brake engagement device 110. In one or more embodiments, wall 112, tip engagement device 108, mounting block 106 and brake engagement device 110 may be configured to work in conjunction with each other for at least the purpose of retracting each brake arm 316 and temporarily securing each brake arm 316 in that retracted position during the operation of carriage 203 and/or other apparatuses while performing functions on the equipment. FIG. 11 also shows one embodiment of tracks 202 on which tip engagement device 108 and brake engagement device 110 may travel along and on which mounting block 106 and/or wall 112 may engage. FIG. 11 also shows one embodiment of wall 112 which may include positioning units 234 which may help channel, position, align and/or prepare the equipment for cleaning, waxing, scraping, brushing and/or other services after being inserted onto mounting mechanism 100.

Other embodiments will be discussed in greater detail below. However, in one or more embodiments, mounting mechanism 100 may function without the use of wall 112.

For example, in one or more embodiment, upper track portion 103 may include a tip engagement device 108 and lower track portion 102 may include a mounting block 106 and a brake engagement device 110 that may function without the use of wall 112 (e.g. FIGS. 40A, 40B, 40C and 40D). Alternatively and/or in addition, in one or more embodiments, mounting mechanism 100 may include a brake engagement device 110 that may function without the use of a wall 112, a tip engagement device 108 and/or a mounting block 106 (e.g. FIGS. 38A, 38B, 38C and 38D). Alternatively and/or in addition, in one or more embodiments, mounting mechanism 100 may include a wall 112 and a brake engagement device 110 that may function without the use of a tip engagement device 108 (e.g. FIGS. 39A and 39B). Other embodiments are contemplated and within the spirit of this disclosure.

Figure 12:
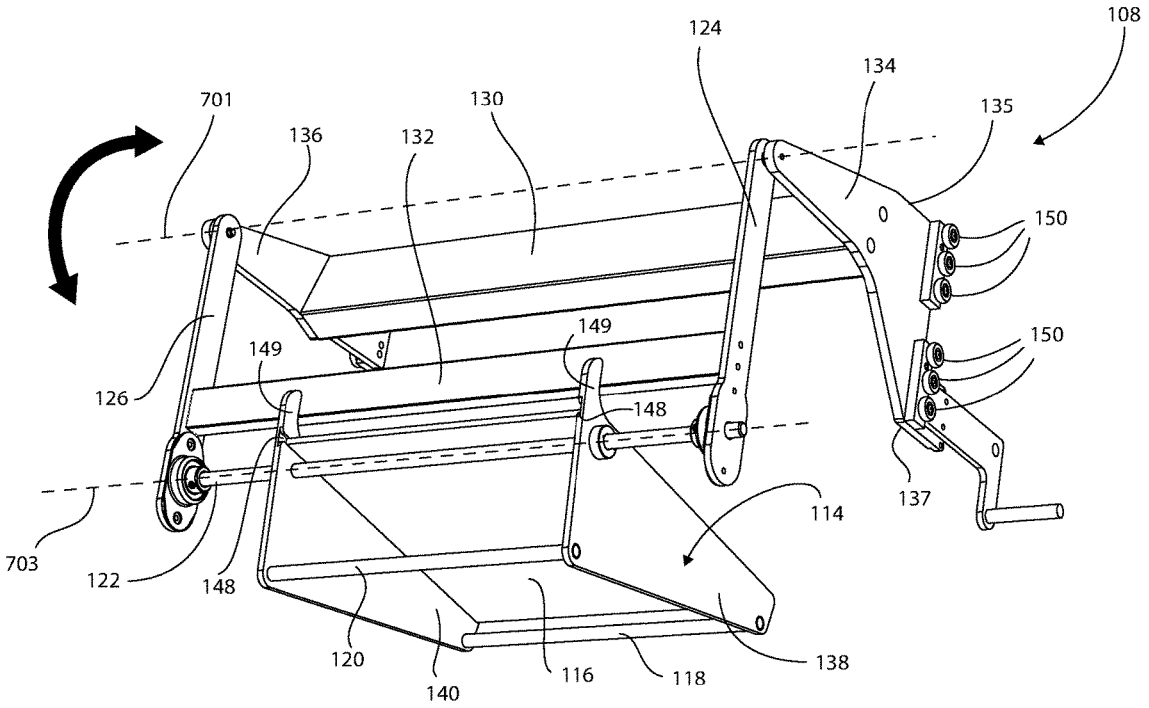
FIG. 12 depicts a front perspective view of one embodiment of a tip engagement device.
Figure 13:
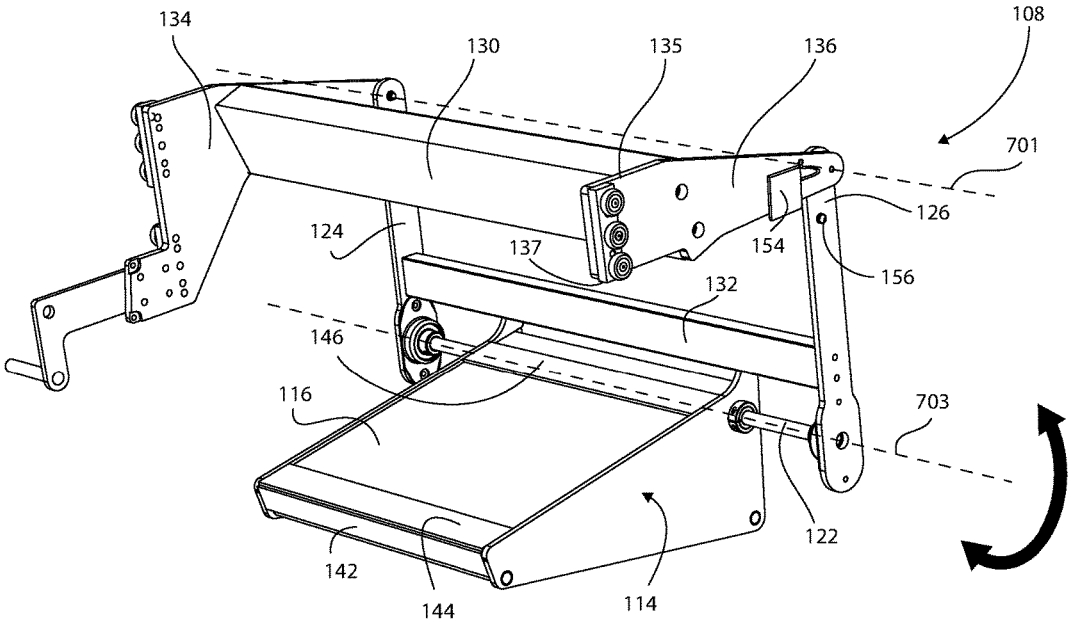
FIG. 13 depicts a rear perspective view of the tip engagement device of FIG. 12.

FIGS. 12 and 13 show one embodiment of tip engagement device 108. In one or more embodiments, tip engagement device 108 may be configured for the purposes of locating the tip of the equipment, temporarily securing the position of tip of the equipment, and reducing and/or eliminating the camber or bend of the equipment such that the sole of the equipment is positioned in substantially a single plane. In one or more embodiments, tip engagement device 108 may be configured to achieve said purposes on equipment of various dimensions. Alternatively and/or in addition, in one or more embodiments, tip engagement device 108 may be configured to at least begin the process of retracting brake arms by utilizing the presence of wall 112 which may provide counter pressure when tip engagement device 108 reduces and/or eliminates the camber or bend of the equipment such that the sole of the equipment is positioned in substantially a single plane. In one or more embodiments, tip engagement device 108 may be designed to assume various configurations to accomplish one and/or more of the stated purposes.

For example, in one or more embodiments, tip engagement device 108 may include a bar 118 which aids in locating the tip of the equipment and temporarily securing the position of tip of the equipment, and a bar 120 which aids in reducing and/or eliminating the camber or bend of the equipment such that the sole of the equipment is positioned in substantially a single plane. In one or more embodiments, tip engagement device 108 may include a casing 114, a shield 116, a pivot 122, swing arms 124 and 126, cross braces 130 and 132, stationary arms 134 and 136, and/or various other components and materials. In one or more embodiments, bar 118, bar 120 and pivot 122 may be designed to numerous configurations, such as solid bars, pipes, parts of a folded sheet metal assembly, plates, weldments, flat bars, etc. configured to various dimensions (including shapes). In one or more embodiments, bar 118, bar 120 and pivot 122 may each be configured to similarly and/or differently.

In one or more embodiments, casing 114 may be configured to clasp or engage the tip of the equipment and temporarily secure it into position. In one or more embodiments, casing 114 may include side plates 138 and 140 which may prevent the tip of the equipment from being laterally or horizontally displaced, a rear flat bar 142 which may engage the top and/or tip of the equipment and prevent it from being longitudinally or vertically displaced, top flat bars 144 and 146 which may aid in retaining shield 116 and preventing the tip of the equipment from moving away from bar 118 once engaged by bar 118, and bars 118 and 120 which aid in temporarily securing the equipment as discussed herein. In one or more embodiments, side plates 138 and 140 may be configured together by various means, such as by welding top flat bars 144 and 146 to a top portion of each side plate 138 and 140, by welding bars 118 and 120 to a bottom portion of each side plate 138 and 140, and/or by welding rear flat bar 142 to a rear portion of each side plate 138 and 140. In one or more embodiments, when configured together, casing 114 may resemble a box with at least one side angled wherein a front portion may have a greater height than a rear portion. Such angled configuration may aid the casing 114 in moving over, engaging and/or securing the equipment. In one or more embodiments, casing 114 may include means for retaining shield 116, such as top flat bars 144 and 146 and channels 148. In one or more embodiments, shield 116 which may be inserted and/or slid into casing 114 by way of channels 148 in one or more embodiments, rear flat bar 142 may be situated substantially perpendicularly to top flat bar 144 for the purpose of acting as a stopper of and/or retaining shield 116 when it may be inserted and/or slid into casing 114 (via channels 148 and/or other means). Such substantially perpendicular configuration of rear flat 142 may be for the purpose of boxing in the tip of the equipment once casing 114 engages the equipment.

In one or more embodiments, shield 116 may be configured from materials which allows the tip of equipment to easily slide on shield 116 and which may not damage and/or scratch the equipment when shield 116 engages the equipment. For example, shield 116 may be configured from plastic and/or other non-stick, non-damaging materials.

In one or more embodiments, stationary arms 134 and 136 may be configured to allow tip engagement device 108 to travel along track 202 and engage equipment of various dimensions. For example, although not shown entirely in FIGS. 12 and 13, in one or more embodiments, one or more chains, ropes, cables, axels, shafts, gears, sprockets, bearings, bushings, flanges, pulleys, counter weights, motors, cylinders, pneumatic pumps, power sources, electronics, wires and/or other means and/or combinations thereof may be provided to move tip engagement device 108 up and/or down track 202. In one or more embodiments, stationary arms 134 and 136 may be configured with rollers 150 which may fit into channels located on track 202 which may allow tip engagement device 108 to roll up and/or down track 202 as at least one drive chain (which may be configured to top portions 135 and bottom portions 137 of stationary arm 134) may be driven by at least one motor. In one or more embodiments, stationary arms 134 and 136 may remain at a constant angle while tip engagement device 108 moves along track 202. In one or more embodiments, stationary arms 134 and 136 may be together by welding cross brace 130 to each arm, which configuration may provide structural support and enable both stationary arms 134 and 136 to travel synchronously along track 202. The mobility of tip engagement device 108 provides the advantage of allowing it to perform its functions on equipment of various dimensions, such as different types of ski bindings and different ski sizes.

In one or more embodiments, swing arms 124 and 126 may be configured for the purpose of allowing the casing 114 to pivot and press down on the equipment. In one or more embodiments, swing arms 124 and 126 may respectively be pivotably configured to stationary arms 134 and 136 via pins, bearings, bushings and/or other means and/or combinations thereof, such that as tip engagement device 108 may be moved up and/or down track 202, swing arms 124 and 126 may be free hanging and/or be free to swing and/or rotate around a first axis 701. In one or more embodiments, swing arms 124 and 126 may be configured together by welding cross brace 132 to each arm, which configuration may provide structural support and enable both swing arms 124 and 126 to rotate synchronously around first axis 701.

In one or more embodiments, casing 114 may be pivotably configured to swing arms 124 and 126 by various means. For example, side plates 138 and 140 may be configured to pivot 122. In one or more embodiments, pivot 122 may be configured to swing arms 124 and 126 via pins, bearings, bushings and/or other means and/or combinations thereof, which allow pivot 122 (and consequently, casing 114) to rotate around a second axis 703.

FIG. 12 shows one embodiment of casing 114 in its home position. In one or more embodiments, casing 114 may be configured with at least one stopper 149 which may engage cross brace 132 and counter the gravitational force which may pull and rotate the rear portion of casing 114 down. Such configuration may limit casing's 114 ability to rotate around second axis 703 in at least one direction and keep casing 114 in its home position until it engages the equipment. In one or more embodiments, without at least one stopper 149, casing 114 may rotate around second axis 703 and cause bar 118 to be misaligned and not properly engage the tips of the equipment.

The configuration of stationary arms 134 and 136, swing arms 124 and 126, and casing 114 may provide the distinct advantage of allowing tip engagement device 108 to adapt to the different geometries of various equipment (such as the size and type ski tips) that users may use in conjunction with the disclosure and/or to provide a means for at least beginning the brake retraction process.

FIGS. 14, 15A, 15B, 16, 17A and 17B show embodiments of aspects of a process wherein the tip engagement device 108 may engage the tip of the equipment and temporarily secure it to wall 112 and begin the retraction of ski brakes.

Figure 14:
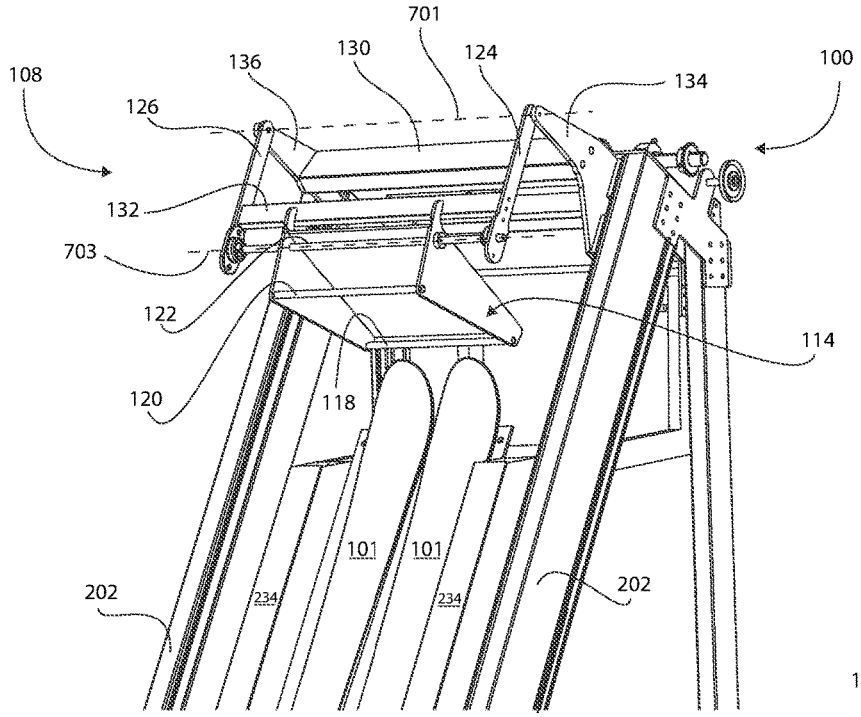
FIG. 14 depicts aspects of one embodiment of mounting mechanism including a tip engagement device.

FIG. 14 shows one embodiment of mounting mechanism 100 and tracks 202 where the equipment has been loaded and wherein tip engagement device 108 is in a home position.

Figure 15A:
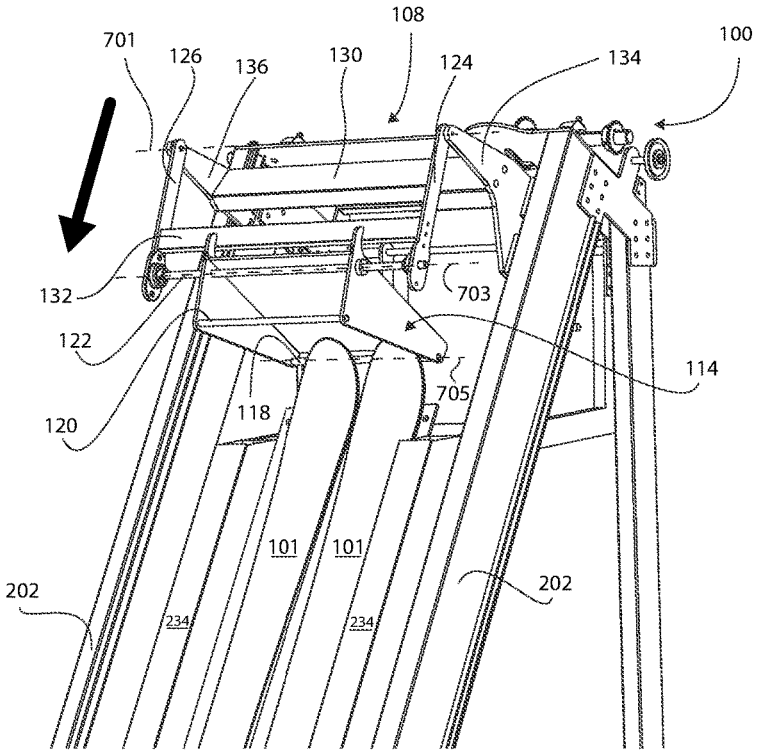
FIG. 15A depicts one embodiment of a process wherein a tip engagement device is moved down a track.

FIG. 15A shows one embodiment of a process wherein tip engagement device 108 is displaced from its home position and moved down track 202 to allow casing 114 to contact the tip of the equipment such that bar 118 is positioned and/or caught on the sole or base of the equipment. FIG. 15A also shown one embodiment of a third axis 705.

Figure 15B:
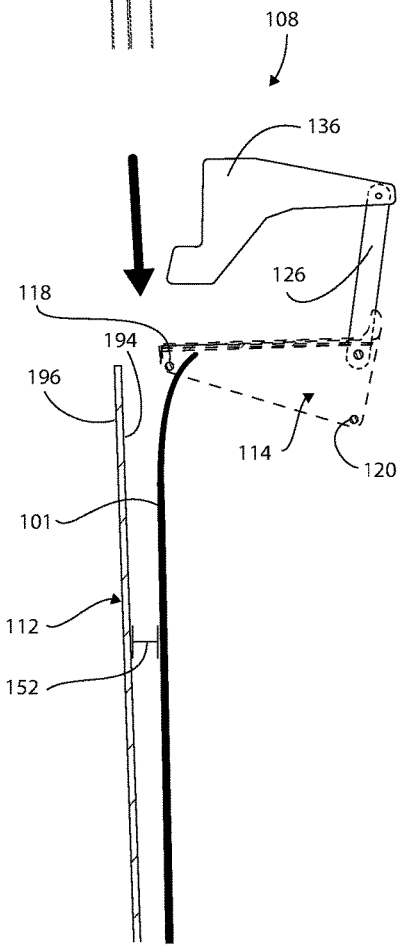
FIG. 15B depicts a side view of aspects of the process illustrated in FIG. 15A.

FIG. 15B shows a side view of aspects of the process illustrated in FIG. 15A and showing that tip engagement device 108 may be moved down track 202 such that bar 118 may be positioned and/or caught on the sole or base of the equipment.

Figure 16:
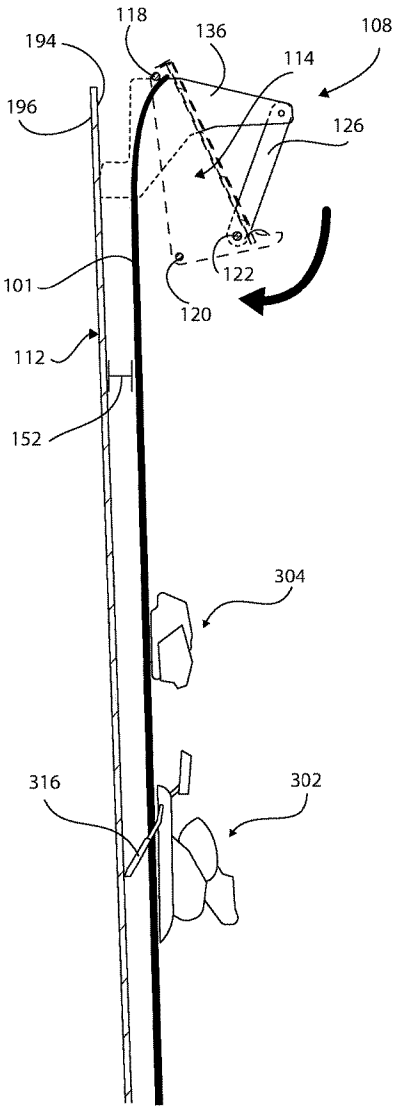
FIG. 16 depicts a side view of one embodiment of a process wherein the tip of the equipment may be engaged.

FIG. 16 shows a side view of one embodiment of a process wherein after casing 114 may contact the tip of the equipment, stationary arms 134 and 136 may continue moving down track 202 and aspects of tip engagement device 108 may change their positioning. In one or more embodiments, once bar 118 engages the sole or base of the equipment bar 118 may act as third axis 705 on which casing 114 may rotate towards wall 112 as stationary arms 134 and 136 continue to move down track 202. In one or more embodiments, once bar 118 engages the sole or base of the equipment, swing arms 124 and 126 may rotate around first axis 701 and pivot 122 (and consequently, casing 114) may rotate around second axis 703. FIG. 16 also shows one embodiment of the disclosure wherein each brake arm 316 is extended and a gap 152 exists between at least a portion of the sole of the equipment and wall 112.

Figure 17B:
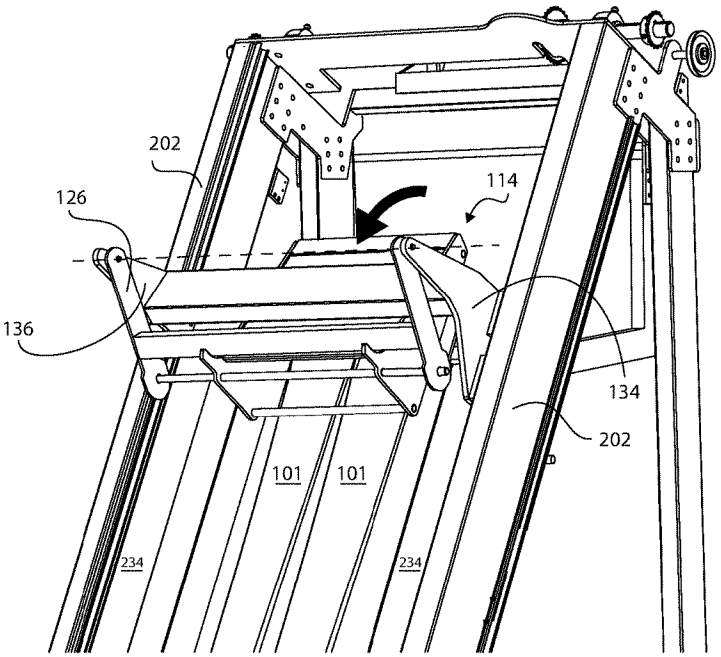
FIG. 17B depicts a side view of aspects of the process illustrated in FIG. 17A.
Figure 17A:
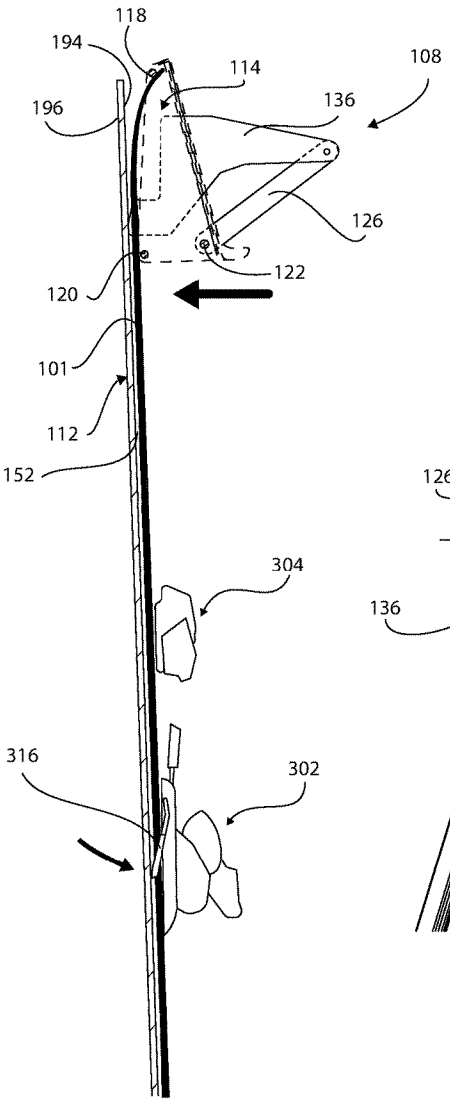
FIG. 17A depicts a side view of one embodiment of a process wherein aspects of a tip engagement device have changed position.

FIG. 17A shows a side view of one embodiment of a process wherein stationary arms 134 and 136 have continued moving down track 202 and aspects of tip engagement device 108 have changed position. In one or more embodiments, as stationary arms 134 and 136 continue to move down track 202 casing 114 may continue to rotate around third axis 705, swing arms 124 and 126 may continue to rotate around first axis 701, and pivot 122 (and consequently, casing 114) may continue to rotate around second axis 703, such that bar 120 engages the top of the equipment and forces the equipment towards wall 112. As the equipment is forced towards wall 112 each brake arm 316 may begin to rotate towards a retracted position and gap 152 may shrink and/or be eliminated. In one or more embodiments, the movement of at least one brake arm 316 towards a retracted position may actuate each brake pedal 314 down and open up the space between each brake pedal 314 and each heel cup 310 and/or each heal housing 306 and provide more room for brake engagement device 110 to perform its functions. Moving each brake arms 316 towards a retracted position may aid in moving each brake arm 316 out of the way to allow carriage 203 to perform its functions (such as cleaning, waxing, scraping and/or brushing) and/or other services to be performed on the equipment without interference from each brake arm 316. In one or more embodiments, tip engagement device 108 may aid in cantilevering each brake arm 316 passed between about 35 percent to about 99 percent of total retraction, which may allow the brake engagement device 110 to use less force on each brake pedal 314 to substantially complete the retraction of each brake arm 316.

In one or more embodiments, the upward pull of bar 118 on the tip of the equipment coupled with the downward push of bar 120 on the equipment towards wall 112 may assist in removing and/or reducing the camber or bend of the equipment and at least begin moving the equipment towards and/or place the equipment in substantially a single plane upon which carriage 203 may clean, wax, scrap and/or brush and/or upon which other services may be performed. Such configuration may reduce the complexity of the configuration of carriage 203 as, in one or more embodiments, carriage 203 may not have to operate on more than one plane. Such configuration may illustrate how aspects of tip engagement device 108 may passively rotate to provide tension to the equipment. The tension provided on the equipment may make the equipment more rigid for cleaning, waxing, scraping, brushing and/or other services performed on it.

FIG. 17B shows a side view of aspects of the process illustrated in FIG. 17A wherein that stationary arms 134 and 136 may continue moving down track 202 and aspects of tip engagement device 108 may change their positioning such that bar 120 engages the top of the equipment and forces the equipment towards wall 112. In one or more embodiments, tip engagement device 108 may maintain contact with, leverage and/or tension on the equipment for a specific period of time, until additional functions and/or processes are performed (such as certain processes associated with brake engagement device 110, wall 112, carriage 203 and/or other aspects of the disclosure), and/or until some other event triggers the release of the equipment. Upon such occurrence, in one or more embodiments, although not shown, tip engagement device 108 may perform additional processes and/or disengage and return to its home position. For example, in one or more embodiments, tip engagement device 108 may reverse the processes it took to engage and secure the tip of the equipment and/or press the top of the equipment at least towards wall 112. In one or more embodiments, stationary arms 134 and 136 may be moved in the reverse direction, thereby rotating bar 120 up and away from the top of the equipment, as well as rotating the front of casing 114 up and back including pivot 120, and also rotating and pulling bar 118 away from the tip of the equipment. Then, in one or more embodiments, tip engagement device 110 may continue in reverse direction and be displaced to its home position and associated configuration (see, for example, FIG. 14).

In one or more embodiments, tip engagement device 108 may be configured with at least one sensor system (not shown) which senses when sufficient leverage and/or tension has been made on the equipment and/or the equipment has engaged wall 112. In one or more embodiments, the sensor system may signal or alert a computer when the equipment has engaged or is about to engage wall 112 and the computer may then cause stationary arms 134 and 136 (via at least one motor and/or other means) to temporarily halt movement along track 202 and/or temporarily halt the movement of bar 120 towards wall 112. In one or more embodiments, at least one sensor system may be configured to stationary arm 134 and/or 136 and/or swing arm 124 and/or 126 and/or some other aspect of tip engagement device 108. Any number and/or kinds of sensor systems may be used, such as hall effect sensors, magnets, light switch, limit switch, button switch, roller switch, and/or any other switch and/or sensor system and/or combinations thereof. For example, in one or more embodiments, a hall effect sensor (not shown) may be configured to stationary arm 136 and a magnet (not shown) may be configured to swing arm 126. Once the hall effect sensor detects the magnet, the hall effect sensor may signal or alter a computer of such and the computer may then instruct at least one motor to temporarily stop the movement of stationary arms 134 and 136 on track 202.

In one or more embodiments, other than a drive chain, a motor, a sensor system and a computer, the movement of the various tip engagement device 108 components may be driven by the natural geometric interaction of tip engagement device's 108 components while tip engagement device 108 moves along track 202 and/or while it engages the tip of the equipment. Such configuration of tip engagement device 108 illustrates how tip engagement device 108 may be designed to reduce the number of motorized and electronic components and/or computer programs which drive the movements of its various components.

Figure 18:
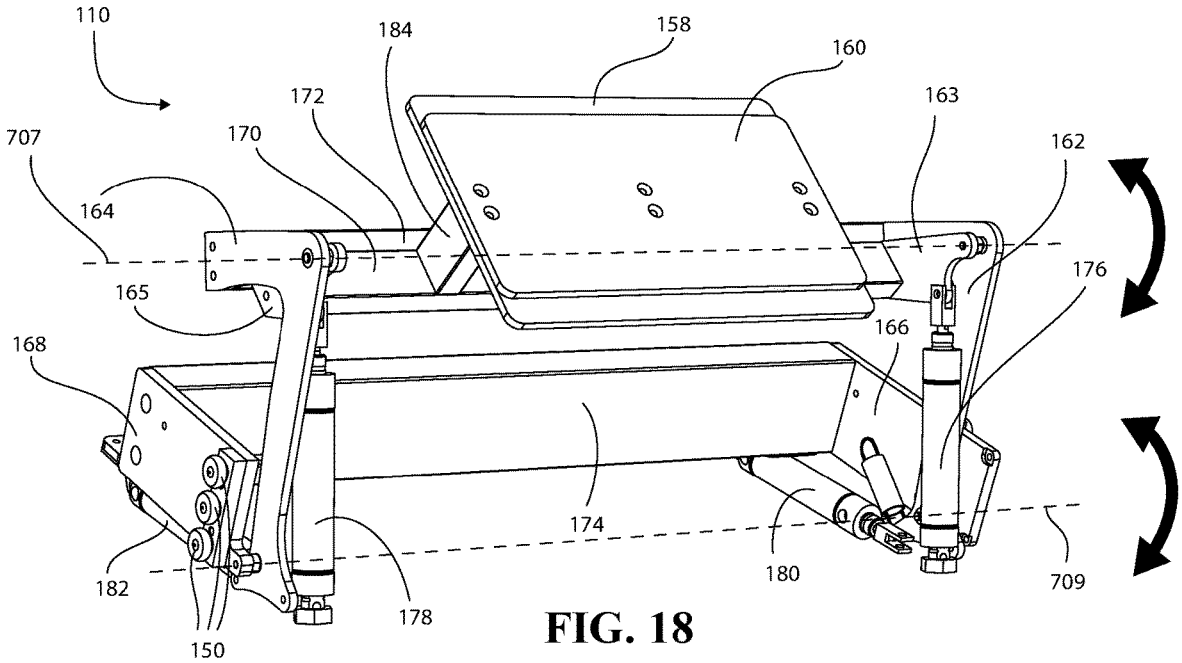
FIG. 18 depicts a front perspective view of one embodiment of a brake engagement device.
Figure 19:
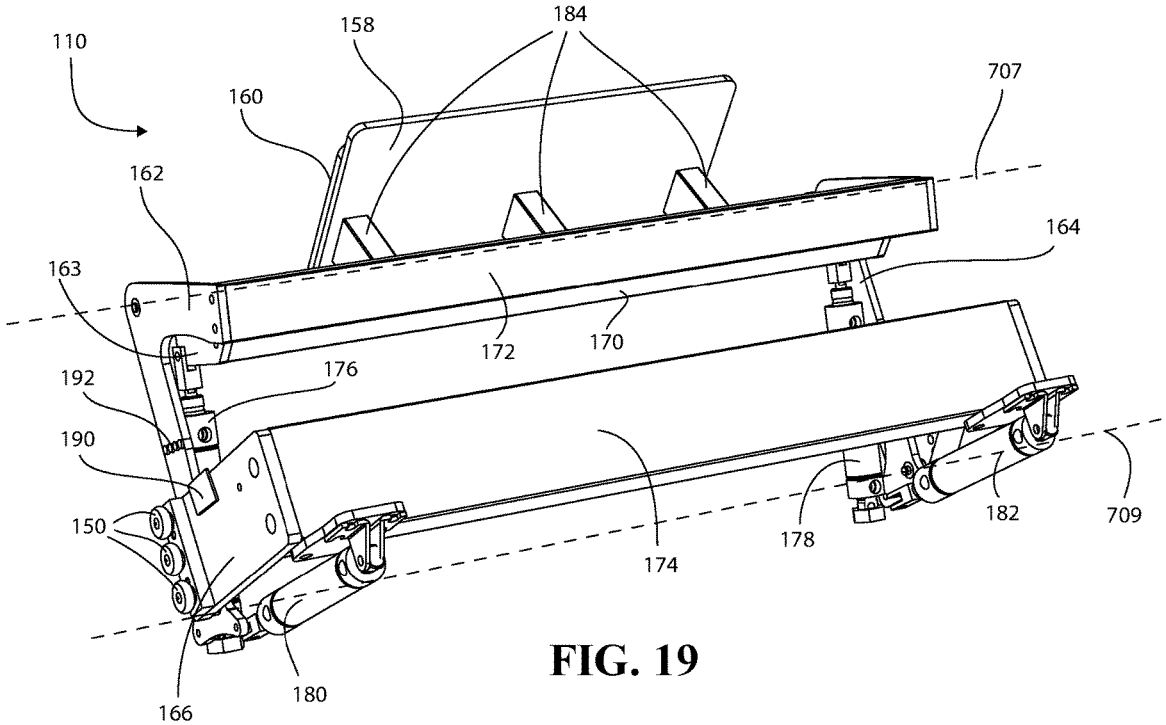
FIG. 19 depicts a rear perspective view of the embodiment of brake engagement device illustrated in FIG. 18.

FIGS. 18 and 19 show one embodiment of brake engagement device 110. In one or more embodiments, brake engagement device 110 may be configured for the purpose of engaging each heel piece 302 and retracting each brake arm 316. Alternatively and/or in addition, in one or more embodiments, brake engagement device 110 may be configured for the purpose of providing opposing pressure to the equipment while carriage 203 and/or other objects engage the sole of the equipment during the cleaning, waxing, brushing, scraping and/or other processes. In one or more embodiments, brake engagement device 110 may be designed to assume various configurations to accomplish one and/or more of the stated purposes.

For example, in one or more embodiments, brake engagement device 110 may include an engagement surface 158 for engaging each heel piece 302, temporarily retracting each brake arm 316 and/or providing opposing force against the equipment while carriage 203 and/or other apparatuses clean, wax, brush, scrape and/or performs other services on the equipment. In one or more embodiments, at least some portion of engagement surface 158 may be configured of and/or with material (such as a cover 160) and/or substances configured to aid engagement surface 158 in performing its function. In one or more embodiments, such material, including cover 160, may aid engagement surface 158 in sliding along the surface of the equipment, over each heel piece 302, and/or in between each heel cup 310 and each brake pedal 314 without damaging and/or scratching the equipment. For example, cover 160 may be composed from plastic and/or other non-stick, non-damaging materials. Although FIGS. 18 and 19 (and elsewhere) show cover 160 only covering a portion of engagement surface 158, cover 160 may, in one or more embodiments, at least substantially cover at least one surface of engagement surface 158.

In one or more embodiments, brake engagement device 110 may include support arms 162 and 164 for supporting and aiding in the movement of the engagement surface 158. In one or more embodiments, engagement surface 158 may be pivotably configured to support arms 162 and 164 by various means (such as pins, bearings, bushings and/or other means and/or combinations thereof) such that engagement surface 158 may rotate around a fourth axis 707. Such configuration may allow engagement surface 158 to change planes and/or angles in which it engages the equipment. For example, as brake engagement device 110 moves along track 202, engagement surface 158 may engage different geometrically situated surfaces located on the equipment and rotate around fourth axis 707 as it engages those different surfaces.

In one or more embodiments, engagement surface 158 may be configured to rotate around fourth axis 707 in an offset manner. For example, in one or more embodiments, brake engagement device 110 may include engagement arms 163 and 165. In one or more embodiments, engagement arms 163 and 165 may be pivotably configured to support arms 162 and 164 such that engagement arms 163 and 165 may rotate around fourth axis 707. In one or more embodiments, engagement arms 163 and 165 may be configured together by welding cross brace 170 to each arm, which configuration may provide structural support and enable both engagement arms 163 and 165 to rotate synchronously around fourth axis 707. In one or more embodiments, engagement surface 158 may be configured to engagement arms 163 and 165 in various ways. For example, in the instance where cross brace 170 is configured to engagement arms 163 and 165, engagement surface 158 may be configured to cross brace 170, which allows for engagement surface 158 to rotate around fourth axis 707 in an offset manner as engagement arms 163 and 165 rotate around fourth axis 707. In one or more embodiments, such configuration may allow engagement surface 158 to change planes and/or angles as it engages the equipment (which planes and/or angles may not be attainable simply by configuring engagement surface 158 to support arms 162 and 164 in the absence of engagement arms 163 and 165).

In one or more embodiments, engagement surface 158 may be configured to reach and/or engage brake pedals 314 and/or to allow aspects of brake engagement device 110 to maneuver around the contour of aspects of binding 300 and/or to support engagement surface 158 while it applies a counter force to the equipment while carriage 203 and/or other apparatuses engage the equipment. For example, in one or more embodiments, brake engagement device 110 may include at least one extension unit 184 which may be configured to cross brace 170 on one end and engagement surface 158 on another end. The dimensions of the at least one extension unit 184 may be such that it allows engagement surface 158 to reach and/or engage brake pedals 314, to maneuver around the contour of aspects of binding 300, and/or to provide sufficient support to engagement surface 158 when it counters the force exerted on the equipment by carriage 203 and/or other apparatuses during the cleaning, waxing, brushing, scraping and/or other functions performed on the equipment. In one or more embodiments, the at least one extension unit 184 may provide brake engagement device 110 clearance over positioning units 234 on wall 112 when brake engagement device 110 is moving along track 202.

In one or more embodiments, brake engagement device 110 may be configured with at least two axes which allows engagement surface 158 to adapt to the different contours on the surface of the equipment and to engage aspects of ski binding 300. For example, in one or more embodiments, brake engagement device 110 may include side plates 166 and 168. In one or more embodiments, support arms 162 and 164 may be pivotably configured to side plates 166 and 168 by various means (such as pins, bearings, bushings and/or other means and/or combinations thereof) such that support arms 162 and 164 may rotate around a fifth axis 709. In one or more embodiments, support arms 162 and 164 may be configured together by welding a cross brace 170 to each arm, for structural support and to enable both support arms 162 and 164 to rotate synchronously around fifth axis 709. Additionally, as indicated above, in one or more embodiment, engagement arms 163 and 165 may be pivotably configured to support arms 162 and 164 such that engagement arms 163 and 165 may rotate around fourth axis 707. Such configuration of engagement arms 163 and 165 and support arms 162 and 164 may provide a brake engagement device 110 the ability to double pivot. That is, the actuation of support arms 162 and 164 may allow engagement surface 158 to be rotated and/or raised and/or lowered and the actuation of engagement arms 163 and 165 may allow engagement surface 158 to be separately and/or simultaneously twisted and/or rotated and/or changed in position. Such double pivoting configuration may provide engagement surface 158 increased maneuverability and aid it in sliding along the surface of the equipment, over heel piece 302, and in between heel cups 310 and brake pedals 314.

In one or more embodiments, aspects of brake engagement device 110 may be spring loaded such that aspects of brake engagement device 110 may automatically adjust and/or adjust upon command as it engages the equipment. Such configuration may allow engagement surface 158 to engage different geometrically situated surfaces located on the equipment and rotate around said surfaces as they are engaged. In one or more embodiments, the movement of aspects of brake engagement device 110 may be driven by pneumatic cylinders, motors, chains, wires, ropes, etc. and/or mechanical interaction and forces, and/or other means and/or combinations thereof. For example, in one or more embodiments, support arms 162 and 164 may be rotated around fifth axis 709 by pneumatic cylinders 180 and 182 which may be configured to side plates 166 and 168. In one or more embodiments, engagement arms 163 and 165 may be rotated around fourth axis 707 by pneumatic cylinders 176 and 178 which may be configured to support arms 162 and 164.

In one or more embodiments, brake engagement device 110 may be configured to travel along track 202. For example, although not shown entirely in FIGS. 18 and 19, in one or more embodiments, one or more chains, ropes, cables, axels, shafts, gears, sprockets, bearings, bushings, flanges, pulleys, counter weights, motors, cylinders, pneumatic pumps, power sources, electronics, wires and/or other means and/or combinations thereof may be provided to move brake engagement device 110 up and/or down track 202. In one or more embodiments, side plates 166 and 168 may be configured with rollers 150 which may fit into channels located on track 202 which may allow brake engagement device 110 to roll up and/or down track 20 as at least one drive chain (which may be configured to a top portion and a bottom portion of side plate 166 and/or 168) may be driven by at least one motor. In one or more embodiments, side plates 166 and 168 may be together by welding a cross brace 174 to each arm, which configuration may provide structural support and enable both side plates 166 and 168 to travel synchronously along track 202. The mobility of brake engagement device 110 provides the advantage of allowing it to perform its function on equipment of various dimensions, such as different types of ski bindings and different ski sizes.

In one or more embodiments, at least one sensor system may be configured to support arm 164 and/or 166 and/or side plate 166 and/or 168 and/or some other aspect of brake engagement device 110. Any number and/or kinds of sensor systems may be used, such as hall effect sensors, magnets, light switch, limit switch, button switch, roller switch, and/or any other switch and/or sensor. For example, in one or more embodiments, a hall effect sensor 190 may be configured to side plate 166 and at least one magnet 192 may be configured to arm 162. When support arms 162 and 164 rotate around fifth axis 709 and hall effect sensor 190 detects magnet 192, the hall effect may signal such detection to a computer and the computer may in turn direct brake engagement device 110 and/or other aspects of the disclosure to perform various functions and/or movements.

FIGS. 20, 21, 22, 23, 24A, 24B, 25A and 25B show embodiments of aspects of a process wherein brake engagement device 110 may engage each heel piece 302 and retract each brake arm 316 and/or provide opposing pressure to the equipment while carriage 203 and/or other objects engage the sole of the equipment during the cleaning, waxing, brushing, scraping and/or other processes. Although FIGS. 20 through 25B do not show the presence of wall 112, in one or more embodiments, wall 112 may be present during some or all of the processes illustrated and described in relation to FIGS. 20 through 25B.

Figure 20:
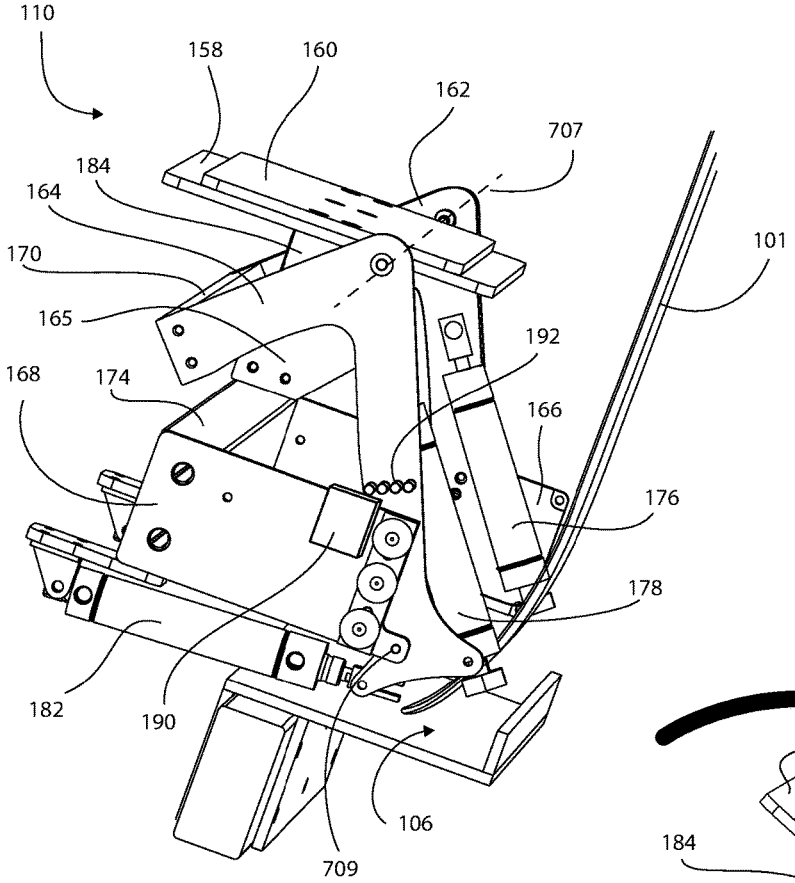
FIG. 20 depicts one embodiment of a brake engagement device in a home position.

FIG. 20 shows one embodiment of brake engagement device 110 located in a home position anticipating engagement with the equipment. FIG. 20 shows the equipment resting on one embodiment of mounting block 106 whereon the equipment may rest and/or be secured while the equipment is serviced. FIG. 20 shows an embodiment of brake engagement device 110 wherein a hall effect sensor 190 may be configured to side plate 168 and at least one magnet 192 may be configured to arm 164, which may function as discussed in reference to FIG. 19 albeit the hall effect sensor 190 and at least one magnet 192 may be located on different aspects of brake engagement device 110.

Figure 21:
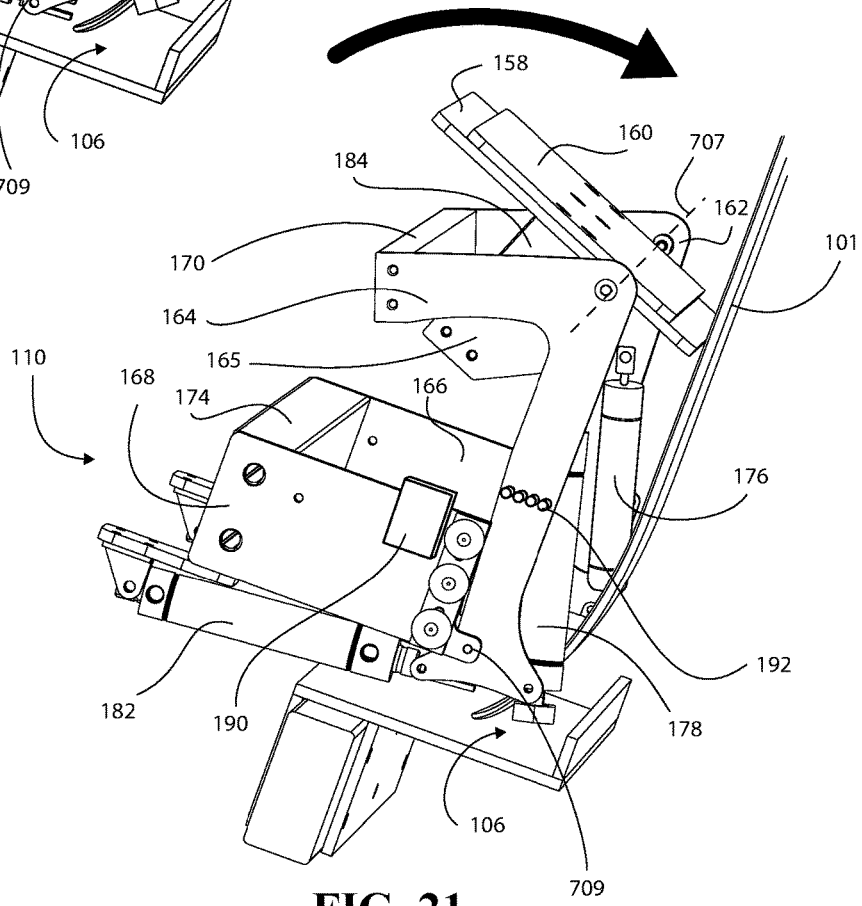
FIG. 21 depicts one embodiment of a process wherein a brake engagement device is positioned against the equipment.

FIG. 21 shows one embodiment of a process wherein brake engagement device 110 is displaced from its home position and engagement surface 158 is positioned against the equipment. The engagement of engagement surface 158 against the equipment may be for the purpose of pushing the equipment against wall 112, for aligning the equipment in proper positioning for carriage 203 and/or other objects to perform their functions, and for other purposes. The engagement of engagement surface 158 against the equipment may be accomplished in various ways depending on the configuration of brake engagement device 110. For example, in one or more embodiments, pneumatic cylinders 180 (not shown)

and 182 (and/or engagement of motors, chains and/or other means and/or combinations thereof) may contract and rotate support arms 162 and 164 around fifth axis 709 (not shown) such that support arms 162 and 164 are lowered towards the equipment so that engagement surface 158 may engage the equipment. In one or more embodiments, pneumatic cylinders 176 and 178 (and/or engagement of motors, chains and/or other means and/or combinations thereof) may expand and/or contract and rotate engagement arms 163 and 165 around fourth axis 707 and cause engagement surface 158 to reposition such that it leans diagonally towards the equipment when it engages the equipment. In one or more embodiments, rotation around fourth axis 707 may not be necessary as the engagement surface 158 may be positioned diagonally towards the equipment as it approaches each heel piece 302 and/or when pneumatic cylinders 182 and 180 (not shown) contract and rotate support arms 162 and 164 around fifth axis 709 (not shown) and lower engagement surface 158 towards the equipment.

In situations where the equipment contains ski bindings, processes may be performed which allow the brake engagement device 110 to engage aspects of the ski bindings. In situations where the equipment does not contain ski bindings (such as when using snowboards in conjunction with the disclosure), brake engagement device 110 may not need to retract each brake arm 316 and thus engagement surface 158 may simply be positioned against the equipment (such as, for example, via the processes illustrated and discussed in relation to FIG. 21) so that it may provide and maintain opposing pressure on the equipment while carriage 203 and/or other objects engage the sole of the equipment during the cleaning, heating, waxing, scraping, brushing, and/or other processes.

In one or more embodiments, the process illustrated and discussed in relation to FIG. 21 may be performed to position and/or prepare the equipment for engagement with tip engagement device 108, wall 112 and/or other aspects of the disclosure. For example, in one or more embodiments, the process illustrated and discussed in relation to FIG. 21 may be performed to force or snug the equipment up against wall 112 prior to tip engagement device 108 engaging the equipment. In one or more embodiments, the process illustrated and discussed in relation to FIG. 21 may be optionally performed.

Figure 22:
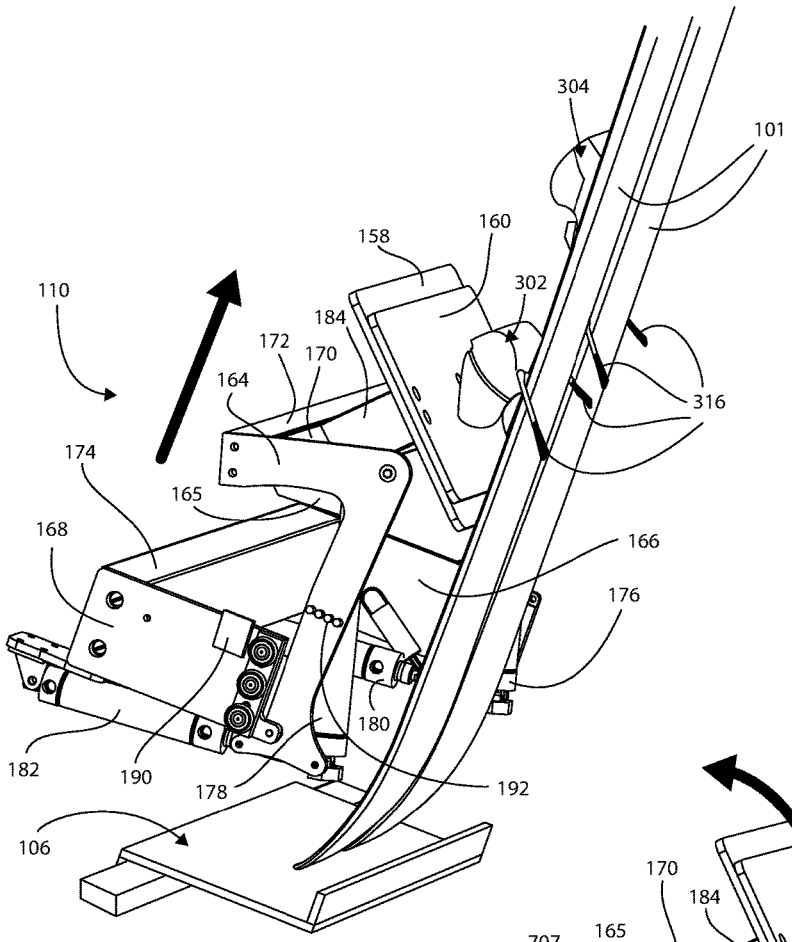
FIG. 22 depicts one embodiment of a process wherein a brake engagement device engages each heel piece.

FIG. 22 shows one embodiment of a process wherein brake engagement device 110 has been moved towards and engaged each heel piece 302 of the equipment.

Figure 23:
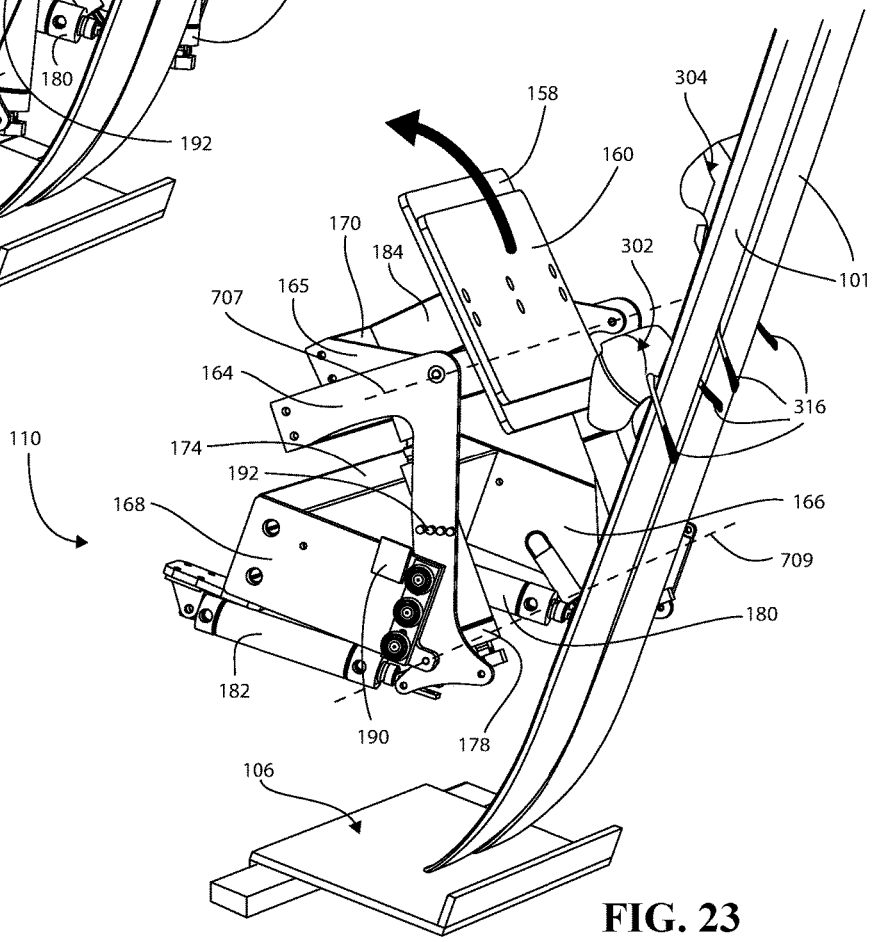
FIG. 23 depicts one embodiment of a process wherein an engagement surface has traveled partially over each heel piece.

FIG. 23 shows one embodiment of a process wherein engagement surface 158 has traveled partially over each heel piece 302 of the equipment. In one or more embodiments, support arms 162 and 164 may rotate around fifth axis 709 such that support arms 162 and 164 are raised away from the equipment and/or engagement surface 158 is allowed to travel over the surface or contour of the heel piece 302. Said rotation of support arms 162 and 164 around fifth axis 709 may be caused by the expansion of pneumatic cylinders 180 and 182 (and/or engagement of motors, chains and/or other means and/or combinations thereof) and/or by the natural force resulting from the continued movement of brake engagement device 110 along track 202 towards the ski binding while the diagonally positioned engagement surface 158 engages the heel piece 302. Alternatively and/or in addition, in one or more embodiments, engagement arms 163 and 165 may rotate around fourth axis 707 such that engagement surface 158 is allowed to travel over the surface or contour of the heel piece 302. Said rotation of engagement arms 163 and 165 around fourth axis 707 may be caused by the expansion of pneumatic cylinders 176 and 178 (and/or engagement of motors, chains and/or other means and/or combinations thereof) and/or by the natural force resulting from the continued movement of brake engagement device 110 along track 202 towards the ski binding while the diagonally positioned engagement surface 158 engages the heel piece 302. Alternatively and/or in addition, in one or more embodiments, spring mechanisms may force engagement surface 158 towards each heel piece 302 while each heel piece provides a force counter to the force generated by the spring mechanisms. In one or more embodiments, as aspects of the brake engagement device 110 travel over the contour of heel piece 203, a sensor system may detect said movement. For example, in one or more embodiments, as support arms 162 and 164 rotate around fifth axis 709, hall effect sensor 190 (which may be configured to side plate 168) may detect the presence of at least one magnet 192 (which may be configured to support arm 164) and signal such detection to a computer.

Figure 24A:
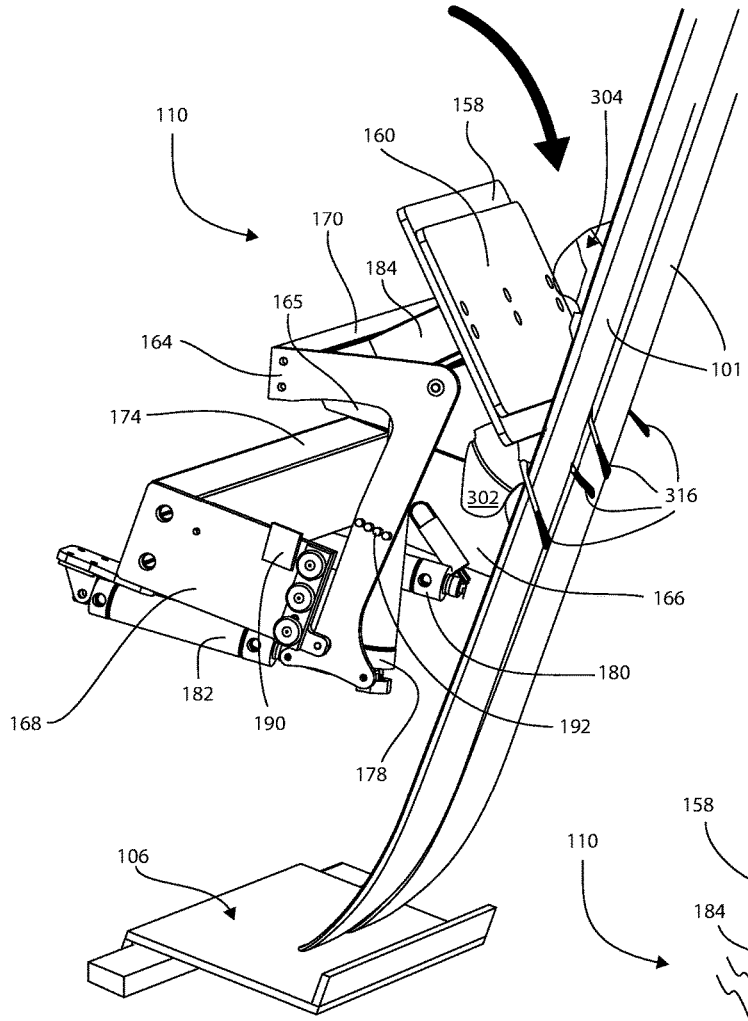
FIG. 24A depicts one embodiment of a process wherein an engagement surface slid down in between each heel cup and each brake pedal.

FIG. 24A shows one embodiment of a process wherein engagement surface 158 has traveled over aspects of each heel piece 302 and slid down in between each heel cup 310 and each brake pedal 314. In one or more embodiments, support arms 162 and 164 may rotate around fifth axis 709 (not shown) such that support arms 162 and 164 are lowered towards the equipment and/or engagement surface 158 is allowed to slide in between each heel cup 310 and each brake pedal 314. Said rotation of support arms 162 and 164 around fifth axis 709 may be caused by the contraction of pneumatic cylinders 180 and 182 (and/or engagement of motors, chains and/or other means and/or combinations thereof) and/or by the natural downward movement of the engagement surface 158 resulting from the continued movement of brake engagement device 110 along track 202 coupled with the engagement surface 158 no longer being supported by each heel piece 302. Alternatively and/or in addition, in one or more embodiments, engagement arms 163 and 165 may rotate around fourth axis 707 (not shown) such that engagement surface 158 is allowed to slide in between each heel cup 310 and each brake pedal 314. Said rotation of engagement arms 163 and 165 around fourth axis 707 may be caused by the contraction and/or expansion of pneumatic cylinders 176 and 178 (and/or engagement of motors, chains and/or other means and/or combinations thereof) and/or by the natural downward movement of the engagement surface 158 resulting from the gap or opening between each heel cup 310 and each brake pedal 314 and the continued movement of brake engagement device 110 along track 202. In one or more embodiments, as aspects of the brake engagement device 110 slide in between each heel cup 310 and each brake pedal 314, a sensor system may detect said movement. For example, in one or more embodiments, as support arms 162 and 164 rotate around fifth axis 709 (not shown), hall effect sensor 190 (which may be configured to side plate 168) may detect the lack of the presence of at least one magnet 192 (which may be configured to support arm 164) and signal such detection to a computer. The computer may then instruct a motor or other means to temporarily stop brake engagement device 110 on track 202. Alternatively and/or in addition, although not shown in FIG. 24A, in one or more embodiments, once engagement surface 158 has been slid into position between heel cup 310 and brake pedal 314, the disclosure may cause engagement surface 158 to be reversed or backed up against each heel cup 310 to ensure that engagement surface is in proper position for future actions.

Figure 24B:
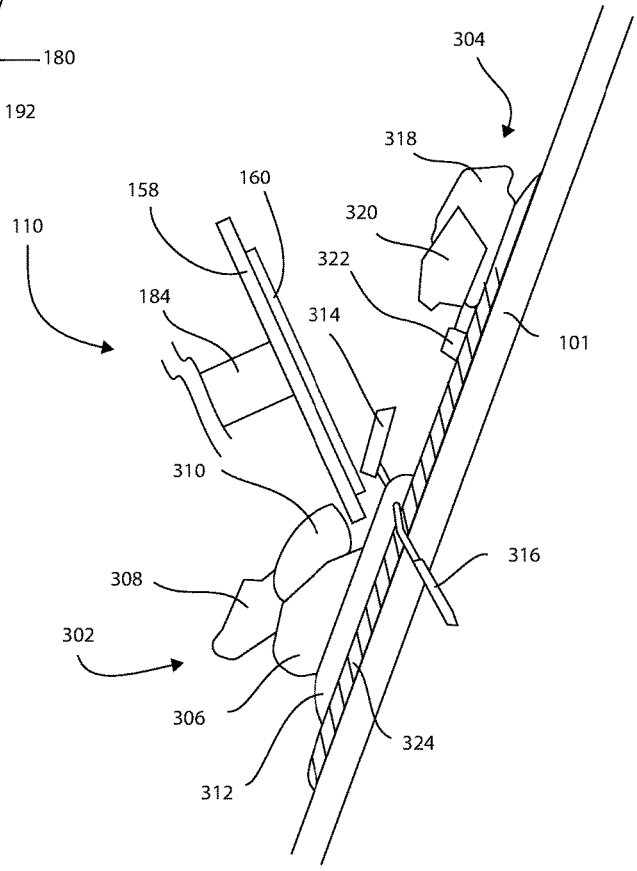
FIG. 24B depicts a side view of aspects of the process illustrated in FIG. 24A.

FIG. 24B shows a side view of aspects of the process illustrated in FIG. 24A. In one or more embodiments, although FIGS. 24A and 24B show each brake arm 316 in an extended position, each brake arm 316 may have previously been rotated into or towards a retracted position (such as by the process shown and discussed in relation to FIGS. 14 through 17B).

Figure 25A:
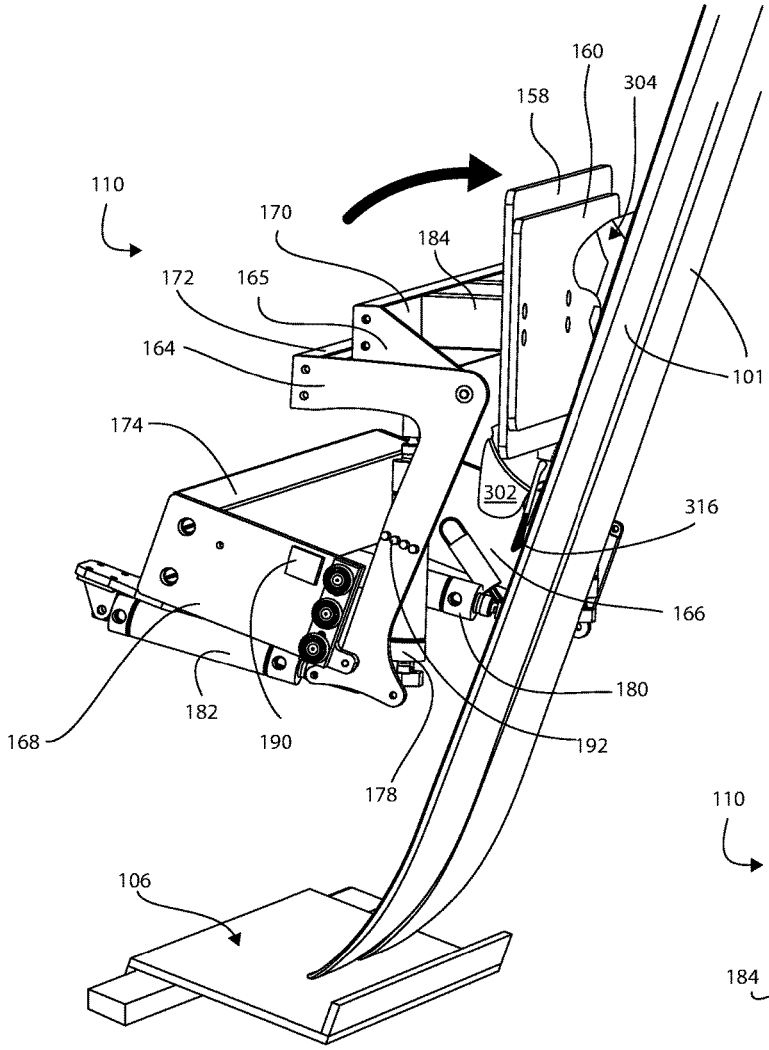
FIG. 25A depicts one embodiment of a process wherein an engagement surface is engaging each brake pedal.

FIG. 25A shows one embodiment of a process wherein engagement surface 158 has been actuated and is engaging each brake pedal 314. In one or more embodiments, engagement arms 163 and 165 may rotate around fourth axis 707 (not shown) such that engagement surface 158 engages each brake pedal 314 with sufficient force to retract brake arms 316. Said rotation of engagement arms 163 and 165 around fourth axis 707 may be caused by the contraction and/or expansion of pneumatic cylinders 176 and 178 (and/or engagement of motors, chains and/or other means and/or combinations thereof). Alternatively and/or in addition, support arms 162 and 164 may rotate around fifth axis 709 (not shown) in order to aid in engagement surface's 158 engagement of each brake pedal 314. Said rotation of support arms 162 and 164 around fifth axis 709 may be caused by the contraction of pneumatic cylinders 180 and 182 (and/or engagement of motors, chains and/or other means and/or combinations thereof).

Alternatively and/or in addition, in one or more embodiments, engagement surface 158 may temporarily secure and/or engage each brake pedal 314 (and keep each brake arm 316 temporarily retracted) and/or apply the appropriate amount of pressure on the equipment to counter opposing pressure directed to the equipment by carriage 203 and/or other apparatus. Such temporary securement and/or pressure by engagement surface 158 may provide rigidity to the equipment while it is brushed, cleaned, waxed, scraped, heated and/or otherwise serviced, and thereby improving the quality of such services. Such temporary securement and/or pressure by engagement surface 158 may remain on the equipment for a specific period of time, until the disclosure performs additional functions and/or processes (such as the processes associated with wall 112, carriage 203 and/or other apparatuses), and/or until some other event which triggers the release of said securement and/or pressure. Upon such occurrence, in one or more embodiments, engagement surface 158 may release said securement and/or pressure and perform additional processes, such as brake engagement device 110 may return to its home position. For example, in one or more embodiments, brake engagement device 110 may over extend the front portion of engagement surface 158 so that it pushes each brake pedal 314 further down and twists to lift the rear portion of the engagement surface 158 so that is forms a negative diagonally sloped angle with the rear portion proximal to each heel cup 310 is higher than the front portion proximal each brake pedal 314. Then, in one or more embodiments, brake engagement device 110 may move away from each heel piece 302 and, once the rear portion of engagement surface 158 clears and/or is over each heel cup 310, the front portion of engagement surface 158 may rotate up sufficient enough to clear each heel piece 302. Then, in one or more embodiments, brake engagement device 110 may be displaced to its home position and associated configuration (see, for example, FIG. 20).

Figure 25B:
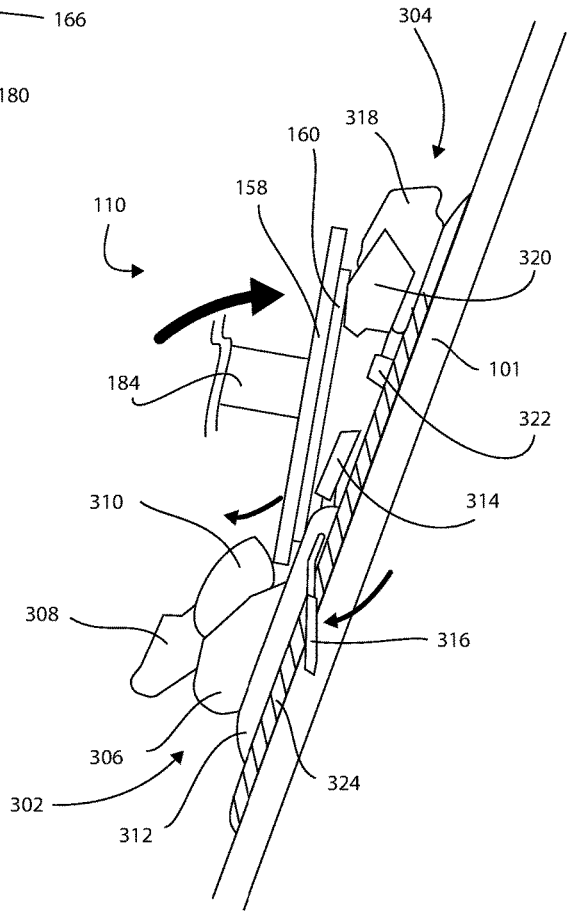
FIG. 25B depicts a side view of aspects of the process illustrated in FIG. 25A.

FIG. 25B shows a side view of aspects of the process illustrated in FIG. 25A. As showing in FIG. 25B, in one or more embodiment, engagement surface 158 may engage each heel cup 302 in such a manner so that engagement surface 158 uses each heel cup 310 as fulcrum and/or applies a pressure on each heel cup 310 as the engagement surface 158 is wedged under the heel cup 310 while, at the same time, rotating to compress each brake pedal 314. Such configuration may provide a rotational force around at least one axis compressing each brake pedal 314.

Although the figures show embodiments of the home position of tip engagement device 108 situated towards the top portion of track 202 and of the home position of brake engagement device 110 situated towards the bottom portion of track 202, in one or more embodiments, the opposite may be implemented and/or both devices may be situated substantially towards the same end portion of track 202.

Figure 26:
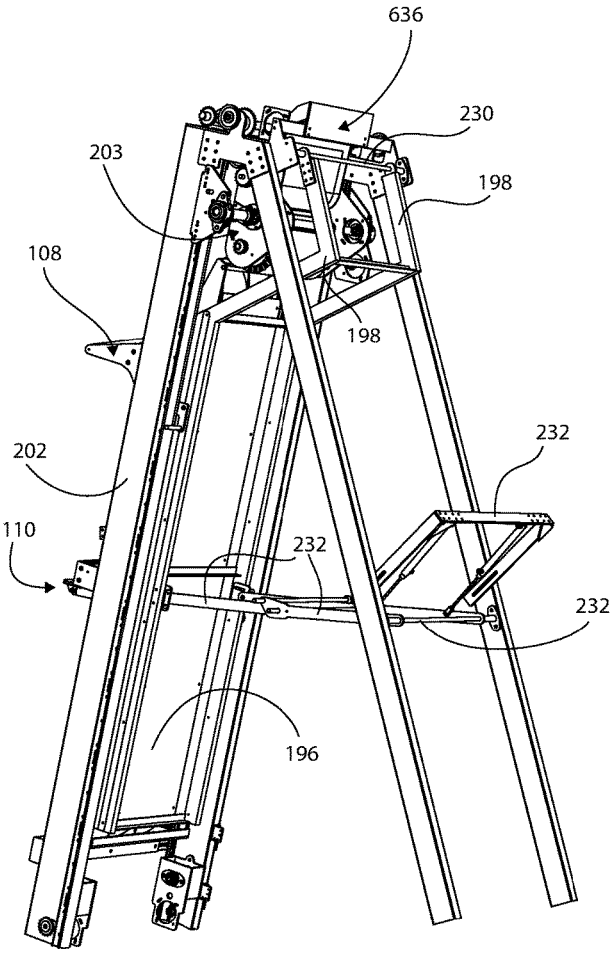
FIG. 26 depicts one embodiment of a rear side of a wall.

FIG. 26 shows one embodiment of a rear side of wall 112 and other aspects of the disclosure. In one or more embodiments, wall 112 may be configured for the purpose of aiding in the retraction of each brake arm 316 and/or providing counter pressure on the sole of the equipment while pressure is exerted on the top of the equipment. Alternatively and/or in addition, in one or more embodiments, wall 112 may be configured for the purpose of providing a stable surface for the user to lean or load the equipment against. Alternatively and/or in addition, in one or more embodiments, wall 112 may be configured for the purpose of constraining the equipment within the operating width of carriage 203 and/or other apparatuses. Alternatively and/or in addition, in one or more embodiments, wall 112 may be configured for the purpose of providing a flat reference surface representing the plane upon which carriage 203 and/or other apparatuses may perform their functions. Alternatively and/or in addition, in one or more embodiments, wall 112 may be configured for the purpose of aiding in partially depressing each brake arm 316 and making additional room or shape for the brake engagement device 110 to perform its functions. In one or more embodiments, wall 112 may be designed to assume various configurations to accomplish one and/or more of the stated purposes.

In one or more embodiments, wall 112 may be configured to various dimensions. For example, in one or more embodiments, wall 112 may be between about 2 inches to about 20 feet in length, between about 2 inches to about 10 feet in width, and between about ⅛ of an inch to about 2 feet in thickness. In one or more embodiments, wall 112 may include various surfaces, such as a front side 194 and a rear side 196. In one or more embodiments, wall 112 may be configured from materials which enables each brake arm 316 and/or other aspects of the equipment to easily slide on and/or which may not damage and/or scratch the equipment, such as plastic and/or other non-stick, non-damaging materials. Alternatively and/or in addition, in one or more embodiments, aspects of wall 112 may be configured with material which aids in gripping, such as rubber.

In one or more embodiments, wall 112 may be configured to be fixed and/or movable. For example, in one or more embodiments, wall 112 may be configured to move away from and/or towards the equipment to allow carriage 203 and/or other apparatuses to perform their functions on the equipment and/or return to a home position. In one or more embodiments, wall 112 may include frame members 198, a pivot 230, and a release mechanism 232 for the purpose of allowing wall 112 to rotate away from the equipment to allow carriage 203 and/or other apparatuses to perform their functions on the equipment and the purpose of allowing wall 112 to return to a home position. In one or more embodiments, frame members 198 may be configured to rear side 196 and pivotably configured to pivot 230 such that wall 112 may rotate around pivot 230 and away from and/or towards the equipment. In one or more embodiments, release mechanism 232 may include pneumatic cylinders, motors, chains and/or other means, and/or combinations thereof, which, when activated, may cause wall 112 to rotate around pivot 230. In one or more embodiments, release mechanism 232 may be adjustable.

Although not shown in FIG. 26, in one or more embodiments, wall 112 may include means for channeling, positioning, aligning, securing and/or preparing the equipment in preparation and/or during cleaning, waxing, scraping, heating, brushing and/or other services. For example, as shown in FIGS. 11, 14, 15A, 17B, and 27, in one or more embodiments, wall 112 may include positioning units 234 which may be configured as hollow square tubing which run the length of at least one side of wall 112 and which ensure that users properly load the equipment in to mounting mechanism 100.

Figure 26A:
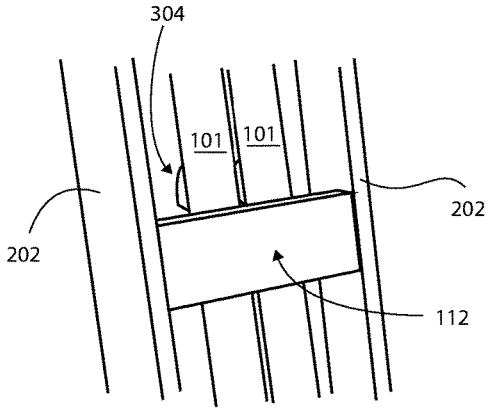
FIG. 26A depicts one embodiment of a wall.

FIG. 26A show one embodiment of wall 112 configured as a beam which may be positioned under each heel piece 302. The beam configuration may be such that when pressure is exerted on each brake pedal 314 towards wall 112, the wall 112 may provide counter pressure on such force by providing opposing force towards the equipment and thereby aiding in the retraction of each brake arm 316. In one or more embodiments, the wall 112 may aid in cantilevering each brake arm 316 passed about 35 percent to about 99 percent, which may allow brake engagement device 110 to use less force on each brake pedal 314 in order to substantially complete the brake arm retraction process. In one or more embodiments, wall 112 may include multiple beams or segments of wall 112. In one or more embodiments, the beam(s) may be fixed and/or movable. In one or more embodiments, the dimensions of wall 112 may be adjustable depending on the size of the equipment and/or other factors.

Returning FIG. 26, FIG. 26 shows one embodiment of wall 112 in a home or closed position substantially parallel to track 202. In one or more embodiments, wall 112 may remain in a home or closed position for a specific period of time, until the disclosure performs additional functions and/or processes, and/or until some other event which triggers the movement of wall 112 away from the equipment. For example, in one or more embodiments, once tip engagement device 108 may be maintaining contact with and/or leverage on the equipment and brake engagement device 110 may be maintaining pressure on each brake pedals 314 with each brake arm 316 retracted, the disclosure may cause wall 112 to open or rotate on pivot 230 away from the equipment to provide room for carriage 203 and/or other apparatuses to perform their functions on the equipment (see FIG. 27 for example). In one or more embodiments, (although not shown in FIG. 26) once carriage 203 and/or other apparatuses have performed their functions on the equipment, the disclosure may cause wall 112 to rotate on pivot 230 toward the equipment and return to its home position (see, for example, FIG. 26). Although not shown in FIG. 26, in one or more embodiments, wall 112 may be positioned substantially horizontal to ground level or any other angle.

Figure 27:
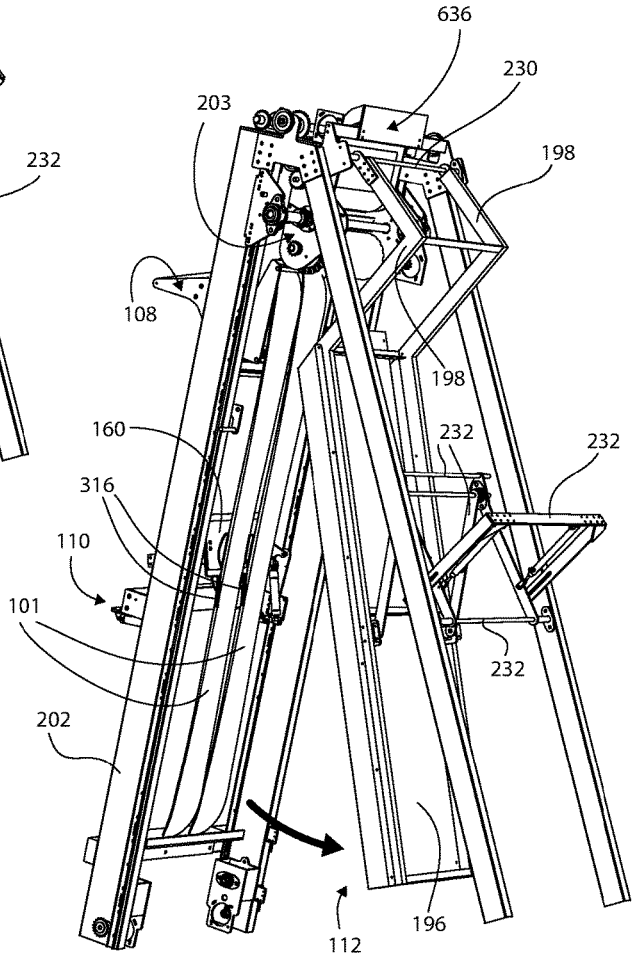
FIG. 27 depicts the embodiment of the process of an opened wall.

FIG. 27 shows the embodiment of the process of opened or rotated wall 112 around pivot 230 and away from the equipment to provide room for carriage 203 and/or other apparatuses to perform their functions on the equipment.

Figure 28:
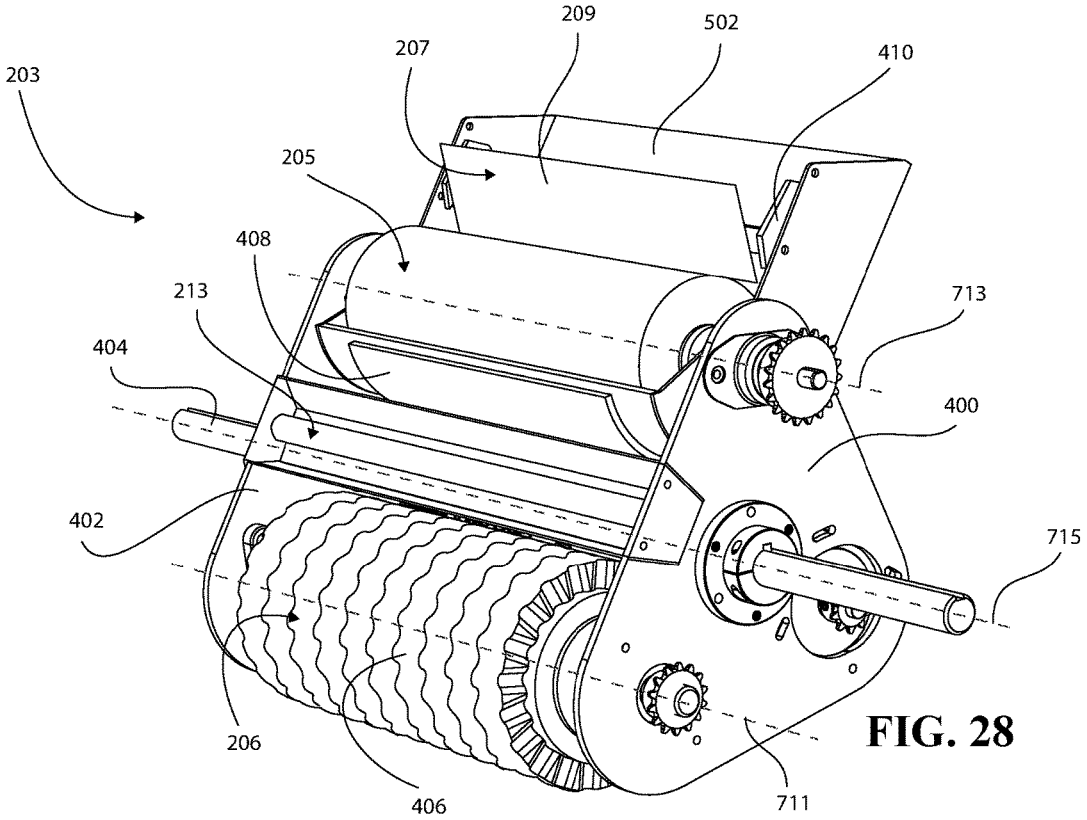
FIG. 28 depicts a front perspective view of an embodiment of a carriage.
Figure 29:
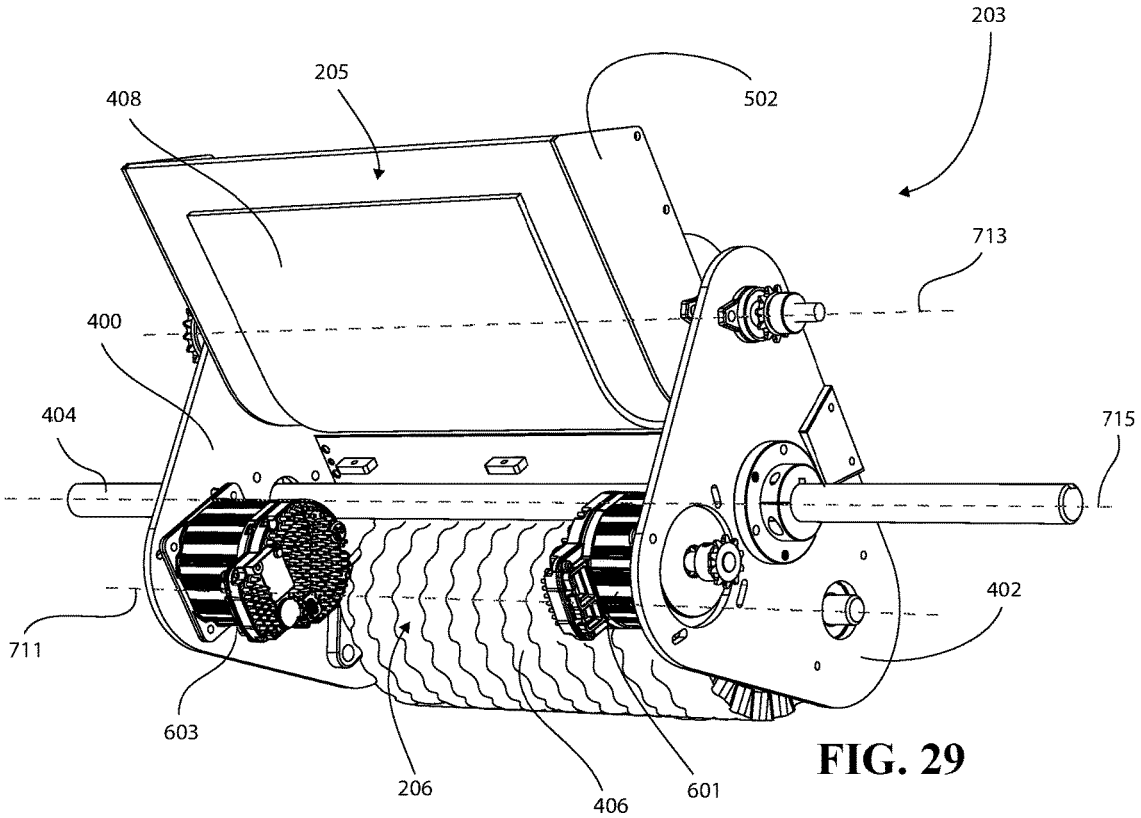
FIG. 29 depicts a rear perspective view of the carriage illustrated in FIG. 28.

FIGS. 28 and 29 show one embodiment of carriage 203. In one or more embodiments, carriage 203 may be configured for the purpose of performing at least one of the following functions on the equipment: cleaning, waxing, heating, scraping, brushing and/or other functions. In one or more embodiments, carriage 203 may be designed to assume various configurations to accomplish one and/or more of the stated purposes.

For example, in one or more embodiments, carriage 203 may include brushing portion 206, waxing portion 205, scraping portion 207, and at least one heating element 213. In one or more embodiments, carriage 203 may include side frames 400 and 402, a shaft 404 and/or various other components and materials configured to achieve one and/or more of its purposes. In one or more embodiments, side frames 400 and 402 may enclose aspects of the brushing portion 206, waxing portion 205, scraping portion 207 and at least one heating element 213. In one or more embodiments, side frames 400 and 402 may be configured together by means of shaft 404 and/or other components. In one or more embodiments, side frames 400 and 402 may rotate around an eighth axis 715 via shaft 404 such that as shaft 404 is rotated side frames 400 and 402 rotate along with it. Such configuration allows the disclosure to tilt or change between the various functions carriage 203 may perform on the equipment, thereby providing the ability to house and perform multiple functions from a single apparatus.

In one or more embodiments, brushing portion 206 may include a substantially cylindrical roller which rotates around a sixth axis 711. In one or more embodiments, brushing portion 206 may combine the functions, structures and/or benefits previously described and illustrated with regards to cleaning portion 204 and brushing portion 206 into one apparatus. For example, in one or more embodiments, brushing portion 206 may be configured with materials which may remove snow, ice, slush, dirt, preexisting wax, and/or other substances from the soles of the equipment. For example, in one or more embodiments, brushing portion 206 may be configured with a ski waxing brush made from polypropylene, nylon fiber and/or other materials, and may include bristles 406 which may spin on and remove substances from the sole of the equipment. In one or more embodiments, the pattern of bristles 406 may be 45 degrees. Alternatively and/or in addition, in one or more embodiments, brushing portion 206 may be configured to smooth wax in preparation for scraping and/or removal of excess wax after scraping and/or adding grooves and/or texture to the wax after it has been applied. In one or more embodiments, brushing portion 206 may engage the sole of the equipment prior to waxing in order to perform its cleaning and/or other functions and/or after the sole of the equipment has been waxed in order to perform its texturizing, wax removal, smoothing and/or other functions.

In one or more embodiments, waxing portion 205 may include a substantially cylindrical roller which rotates around a seventh axis 713 for the purpose of rolling hot wax onto the sole of the equipment. In one or more embodiments, waxing portion 205 may be configured to contact wax (such as wax from wax block 501) and apply the wax onto the soles of the equipment as carriage 203 travels along track 202. In one or more embodiments, the roller may be made from various materials, such as grooved rubber. In one or more embodiments, waxing portion 205 may include wax carriage 502 which may house wax (such as wax block 501) and/or a heating element 408. In one or more embodiments, heating element 408 may heat the wax in the wax carriage 502 in preparation for application by the roller. In one or more embodiments, as the roller of waxing portion 205 spins, it may contact and collect hot wax and then apply the hot wax onto the sole of the equipment.

Although not shown entirely in FIGS. 28 and 29, in one or more embodiments, one or more chains, ropes, cables, axels, shafts, gears, sprockets, bearings, bushings, flanges, motors, cylinders, pneumatic pumps, power sources, electronics, wires and/or other means and/or combinations thereof may be provided to cause brushing portion 206 to rotate around sixth axis 711, waxing portion 205 to rotate around seventh axis 713, and carriage 203 to rotate shaft 404 around eighth axis 715. For example, in one or more embodiments, a motor 601 may cause the rotation of the substantially cylindrical roller associated with waxing portion 205 around seventh axis 713 via chains (not shown), sprockets and/or other components. In one or more embodiments, a motor 603 may cause the rotation of the substantially cylindrical roller associated with brushing portion 206 around sixth axis 711 via chains (not shown), sprockets and/or other components.

In one or more embodiments, scraping portion 207 may include scraping edge 209 for the purpose of scraping excess wax from the soles of the equipment. In one or more embodiments, aspects of scraping portion 207 may be made out of any rigid, heat resistant material (such as, carbon steel, titanium, aluminum, sheet steel, etc.), silicone and/or other materials which may be suitable for scraping excess wax from the soles of the equipment. Scraping edge 209 may engage the sole of the equipment and scrap off excess wax. In one or more embodiments, excess wax may be deposited into wax carriage 502 for reuse. In one or more embodiments, aspects of scraping portion 207 may be spring loaded and/or pivotably configured for the purpose of maintaining contact between scraping edge 209 and the sole of the equipment and/or for the automatic adjustment of the angle at which scraping edge 209 engages the soles of the equipment as carriage 203 travels along the sole of the equipment. For example, in one or more embodiments, scraping edge 209 may be pivotably configured to waxing carriage 502 via a spring mechanism 410 which may include one or more springs, hinges, pins/pivots and/or other components which allows scraping edge 209 to maintain contact between it and the sole of the equipment and/or automatically adjust the angle at which scraping edge 209 engages the soles of the equipment as carriage 203 travels along the sole of the equipment. Such configuration may provide scraping portion 207 with the advantage of being adaptable to various surfaces and obstacles on the surfaces of the soles of the equipment as scraping edge 209 moves along the sole of the equipment. In one or more embodiments, scraping portion 207 may be configured with a heating element for purposes of heating scraping edge 209, the wax, and/or the equipment and/or some other aspect of the disclosure. For example, in one or more embodiments, the rear side of scraping edge 209 may be configured with a heating element (not shown).

In one or more embodiments, heating element 213 may be positioned between brushing portion 206 and waxing portion 205 for the purpose of heating the soles of the equipment as carriage 203 moves along track 203 in order to enhance wax absorption and/or facilitate other functions. In one or more embodiments, heating element 213 may be activated and/or deactivate at any time, including before and/or after brushing portion 206 has operated, before and/or after waxing portion 205 has operated, and/or before and/or after scraping portion 207 has operated.

Figure 30:
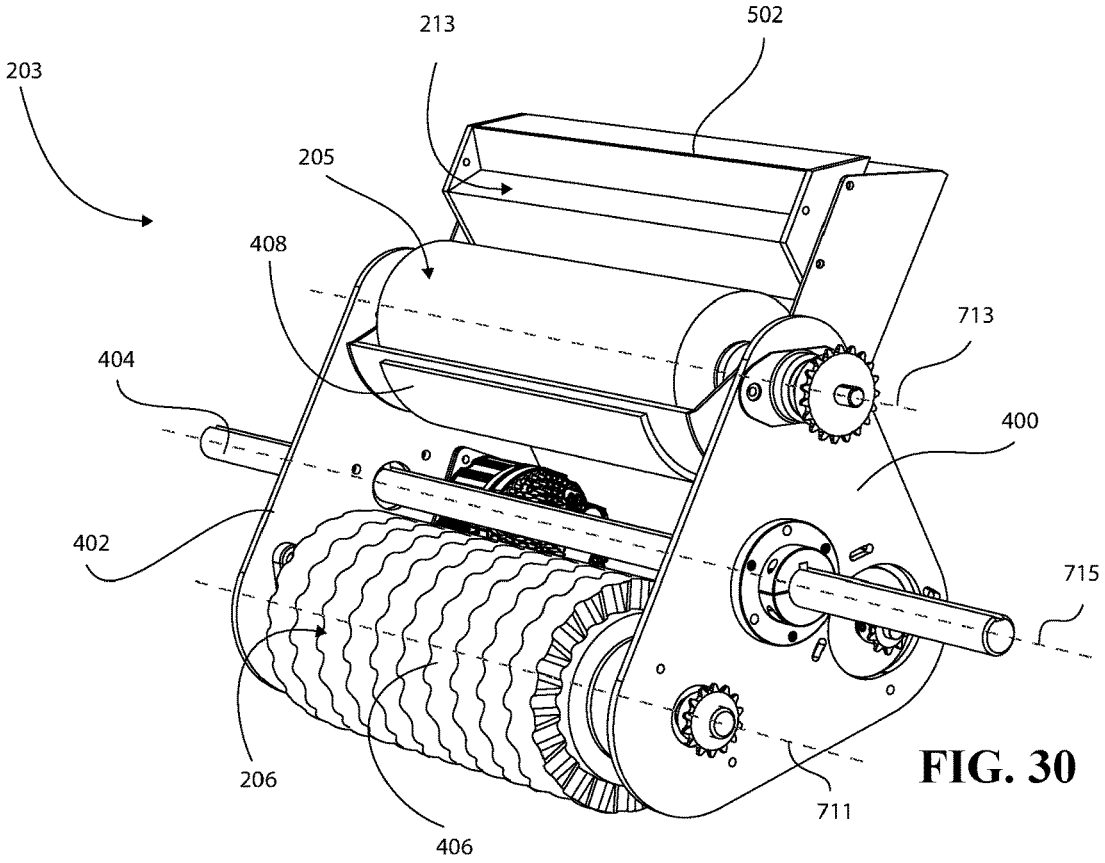
FIG. 30 depicts a front perspective view of an embodiment of a carriage.
Figure 31:
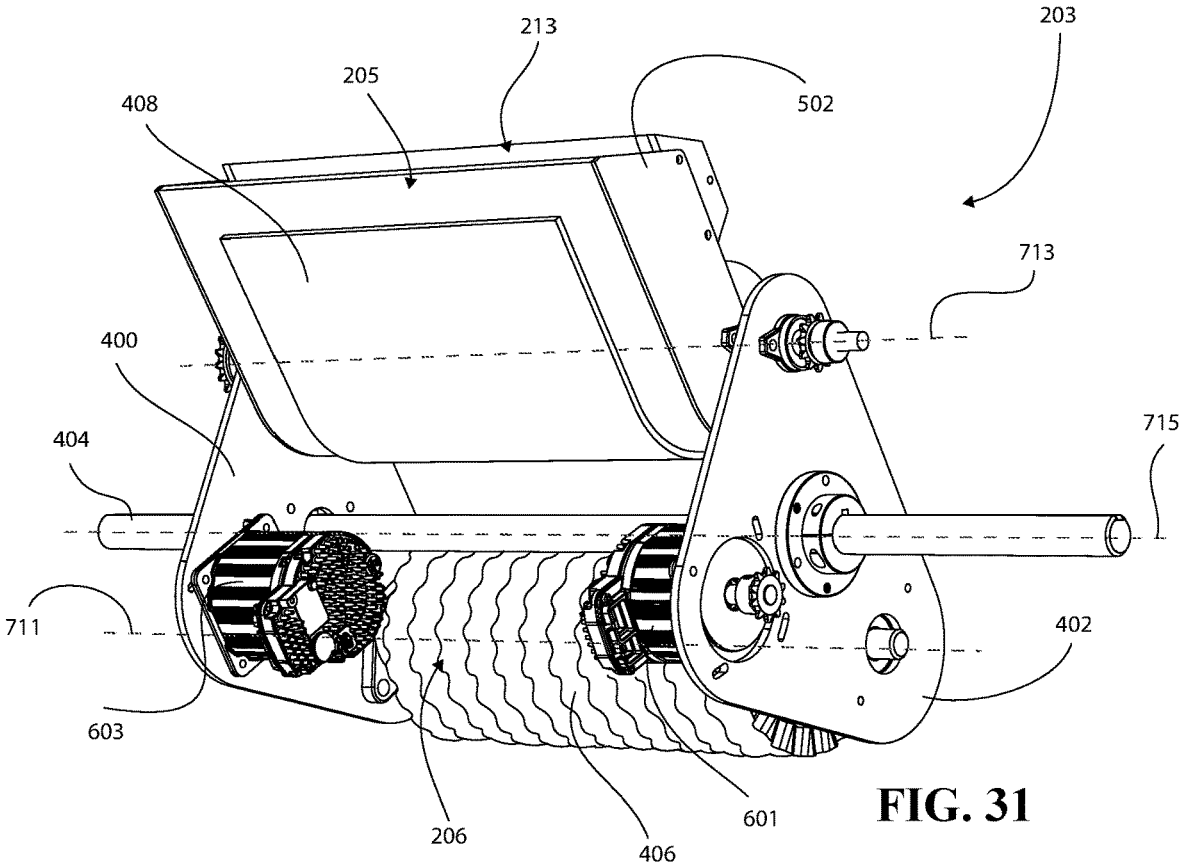
FIG. 31 depicts a rear perspective view of the carriage illustrated in FIG. 30.

FIGS. 30 and 31 show one embodiment of a carriage 203 similar to the embodiment illustrated in FIGS. 28 and 29, albeit there is no scraping portion 207 and the heating element 213 is designed differently and configured above the waxing portion 205. An advantage of this configuration is that brushing portion 206 may perform its function on the down pass and the waxing portion 205 may perform its function on the up pass while the heating element 213 positioned above waxing portion 205 may heat the sole of the equipment prior to waxing portion 205 applying the wax on the up pass. Such configuration may save time as the carriage may perform the desired functionality in one full cycle. In one or more embodiments, heating element 213 may be configured to wax carriage 502.

Although not shown in FIG. 28, 29, 30 or 31, in one or more embodiments, carriage 203 may be configured with devices which tune, sand, sharpen (including the edges and the sole of the equipment), fill in scrapes, divots, grooves and other abrasions, and repair the equipment. In one or more embodiments, the disclosure may secure the equipment and retract the brake arms in preparation for an individual to clean, wax, scrape, brush, heat, tune, sand, sharpen, fill, repair, etc. and/or otherwise service the equipment, rather than (and/or in conjunction with) carriage 203 performing one or more of said services on the equipment.

FIGS. 32, 33, 34, 35, 36A, 36B and 37 show embodiments of aspects of a process wherein carriage 203 brush, wax, scrape, heat and/or perform other services to the sole of the equipment.

Figure 32:
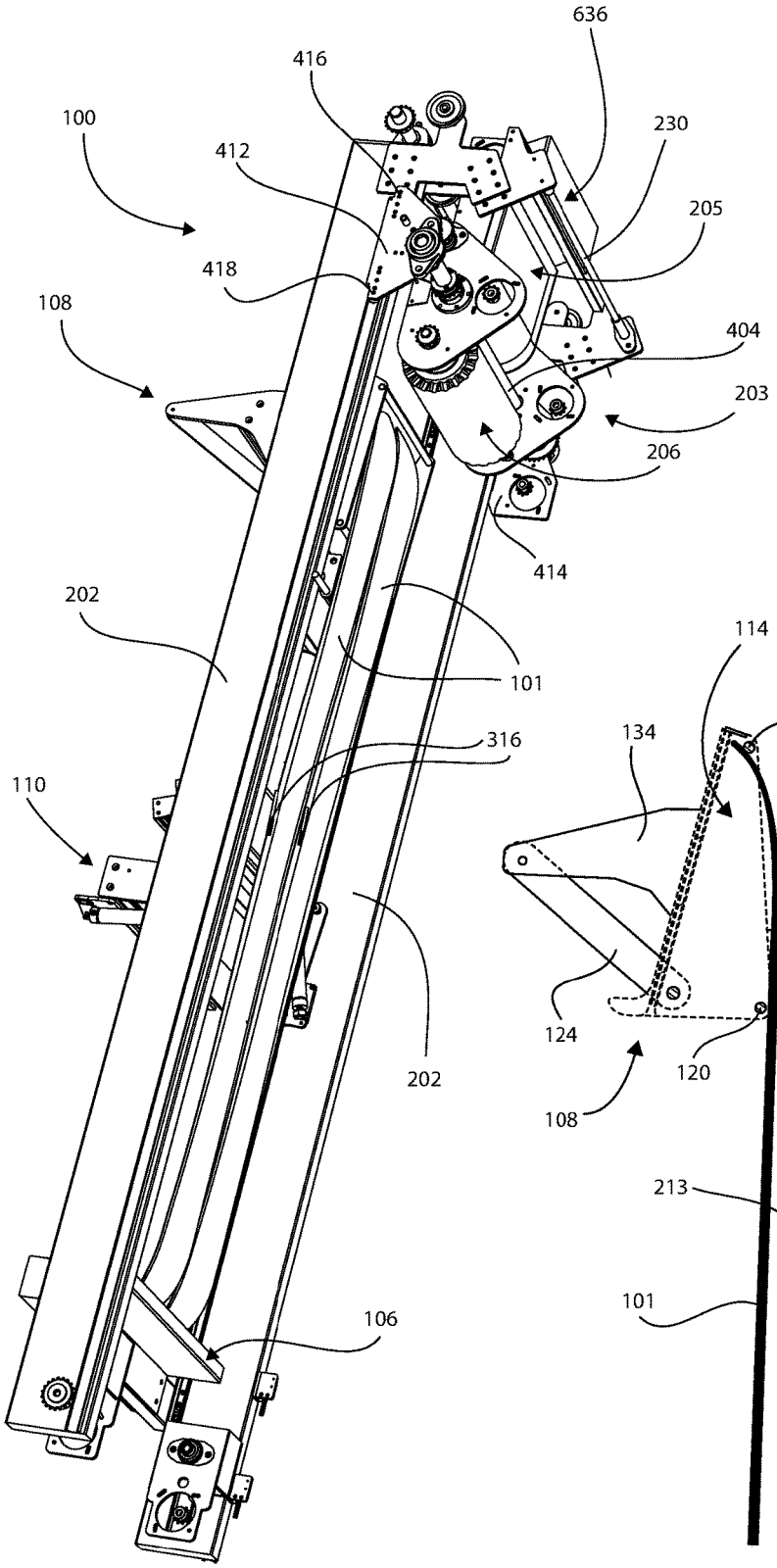
FIG. 32 depicts one embodiment of a carriage in a home position on a track.

FIG. 32 shows one embodiment of carriage 203 in a home position on track 202 and of each brake arm 316 in a retracted position out of the carriage's 203 path of operation. Although not shown in FIG. 32, the disclosure may be configured so that carriage's 203 home position may be at the bottom of track 202 and/or some other location along track 202.

In one or more embodiments, the disclosure may be designed to allow carriage 203 to move along track 202 to perform its various functions, such as, cleaning, waxing, scraping, heating, brushing and/or other functions and/or being in a neutral position. For example, although not shown entirely in FIG. 32, in one or more embodiments, one or more chains, ropes, cables, axels, shafts, gears, sprockets, bearings, bushings, flanges, motors, cylinders, pneumatic pumps, power sources, electronics, wires and/or other means and/or combinations thereof may be provided to move carriage 203 along track 202. In one or more embodiments, at least one drive chain may be configured to top portions 416 and bottom portions 418 of track side plate 412 (and/or similar portions on track side plate 414) which at least one drive chain may be displaced by at least one motor. In one or more embodiments, track side plates 412 and 414 may include rollers 150 which engage track 202 and aid in displacing track side plates 412 and 414 along track 202. In one or more embodiments, as track side plates 412 and 414 move up and/or down track 202, carriage 203 may move along with track side plates 412 and 414.

In one or more embodiments, carriage 203 may be pivotably configured to track 202 by various means so that the position of carriage 203 may be rotated to perform its various functions (such as, cleaning, waxing, scraping, heating, brushing and/or other functions, and/or being rotated to a neutral position) as it travels along track 202. For example, in one or more embodiments, carriage 203 may be pivotably configured to track side plates 412 and 414 via shaft 404, a chain (not shown), a motor (not shown) and/or other components. In one or more embodiments, the motor may be configured to track side plate 414, which motor may turn a drive chain (not shown), which drive chain may turn a sprocket configured to shaft 404, thereby allowing the motor to rotate carriage 203 around eighth axis 715 (not shown in FIG. 32, see FIGS. 28 through 31). Thus, in one or more embodiments, the motor may drive the rotation of carriage 203 among its cleaning, waxing, scraping, heating, brushing and/or other functions, and/or its neutral position. In one or more embodiments, the particular function engaged may be controlled by a computer which may excite the motor. Although not shown, carriage 203 may be configured so as to rotate with the camber or curvature of the equipment, thus minimizing and/or eliminating the need to straighten and/or reduce the equipment to substantially a single plane.

Figure 33:
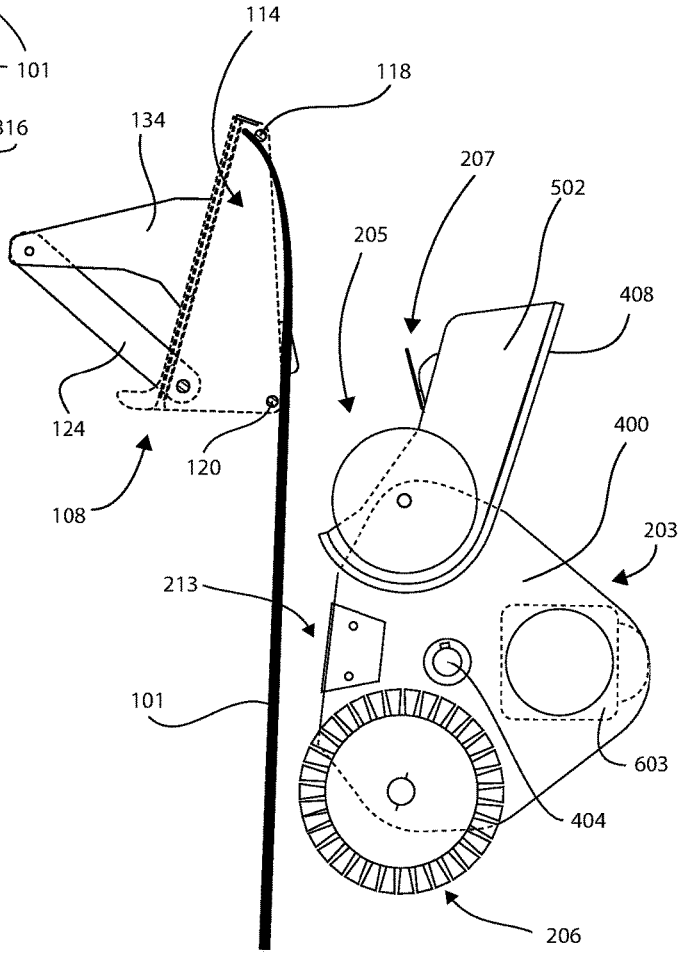
FIG. 33 depicts a side view of one embodiment of a carriage in a neutral position.

FIG. 33 shows a side view of one embodiment of carriage 203 in a neutral position and of tip engagement device 108 engaging the tip of the equipment and leveraging the equipment such that its camber or bend has been forced into substantially a single plane.

Figure 34:
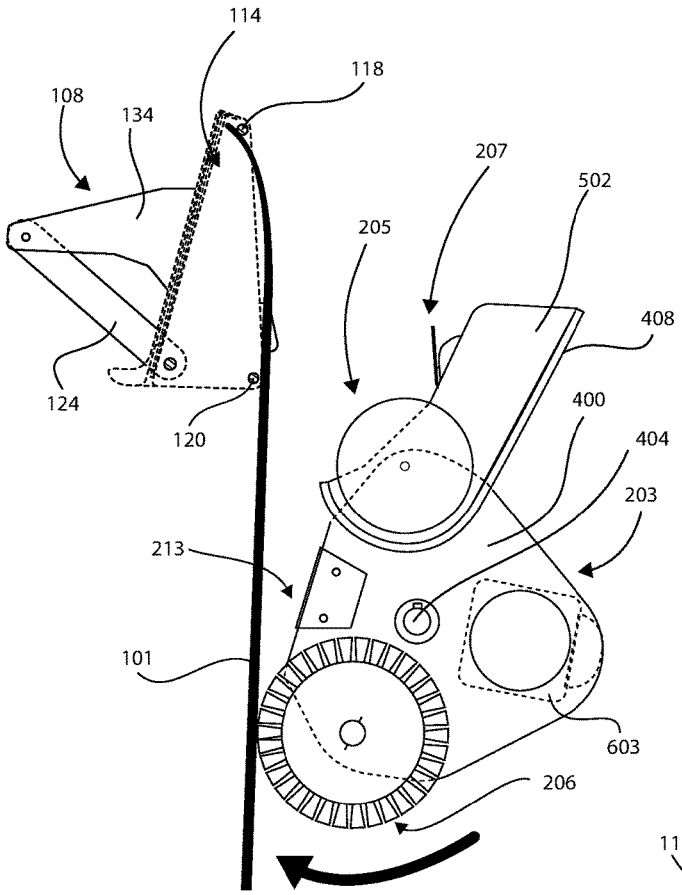
FIG. 34 depicts a side view of one embodiment of a process whereby one embodiment of a carriage has rotated.

FIG. 34 shows a side view of one embodiment of a process whereby carriage 203 has rotated around eighth axis 715 via shaft 404 such that brushing portion 206 is engaging the sole of the equipment, which equipment is being temporarily secured by tip engagement device 108. In one or more embodiments, after rotating to communicate with the equipment, brushing portion 206 may brush some or substantially the entire surface of the sole of the equipment. In one or more embodiments, at least one heating element 213 may heat the sole of the equipment as brushing portion 206 operates and/or moves along the sole of the equipment. In one or more embodiments, after performing its brushing functions, carriage 203 may return to the home position to terminate its operation and/or to rotate to start a new function and/or to repeat the brushing function. In one or more embodiments, carriage 203 may rotate and immediately begin performing another function without first returning to its home position.

Figure 35:
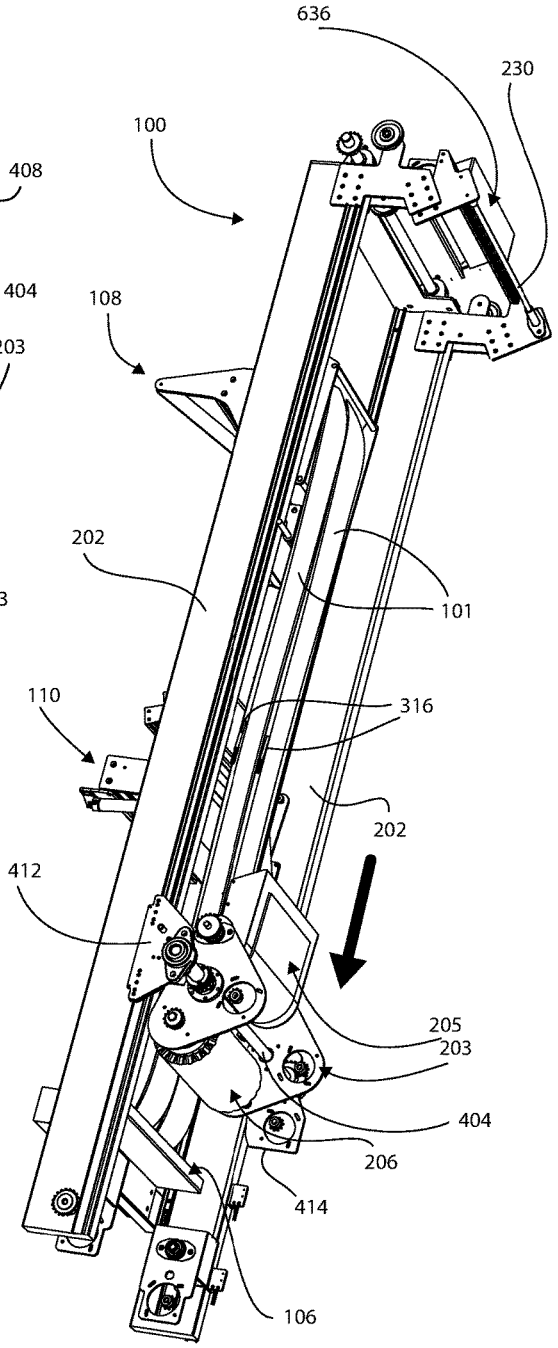
FIG. 35 depicts one embodiment of a process whereby a carriage performs services to the equipment.

FIG. 35 shows one embodiment of a process whereby carriage 203 has traveled along track 202 nearly to the bottom of the equipment while each brake arm 316 is in a retracted position as brushing portion 206 engaged the equipment.

Figure 36A:
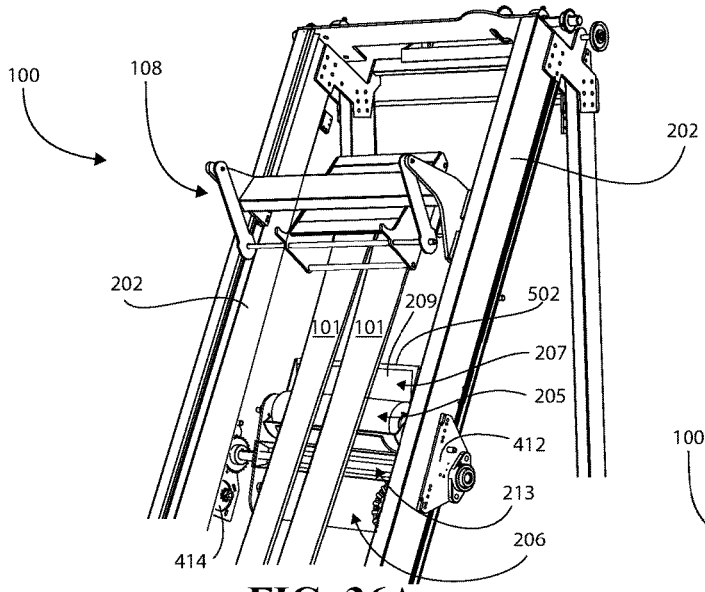
FIG. 36A depicts one embodiment of a process whereby a carriage has rotated so that a waxing portion, at least one heating element and/or scraping portion may engage the equipment.

FIG. 36A shows one embodiment of a process whereby carriage 203 has rotated around shaft 404 (not shown) so that waxing portion 205, at least one heating element 213 and/or scraping portion 207 may engage the sole of the equipment.

Figure 36B:
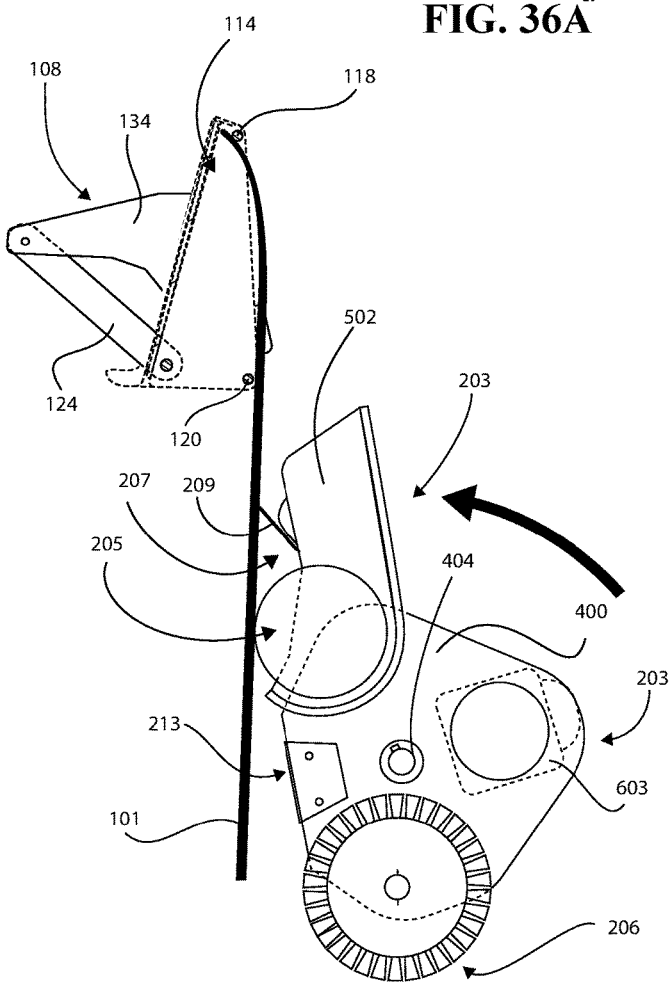
FIG. 36B depicts a side view of one embodiment of a process whereby a carriage has rotated.

FIG. 36B shows a side view of one embodiment of a process whereby carriage 203 has rotated around eighth axis 715 via shaft 404 such that waxing portion 205, at least one heating element 213 and/or scraping portion 207 may engage the sole of the equipment, which equipment is being temporarily secured by tip engagement device 108. In one or more embodiments, as carriage 203 moves along the sole of the equipment, at least one heating element 213 may heat the surface of the equipment and improve its ability to absorb the wax and/or improve the likelihood that the wax may stick to the surface of the equipment.

Figure 37:
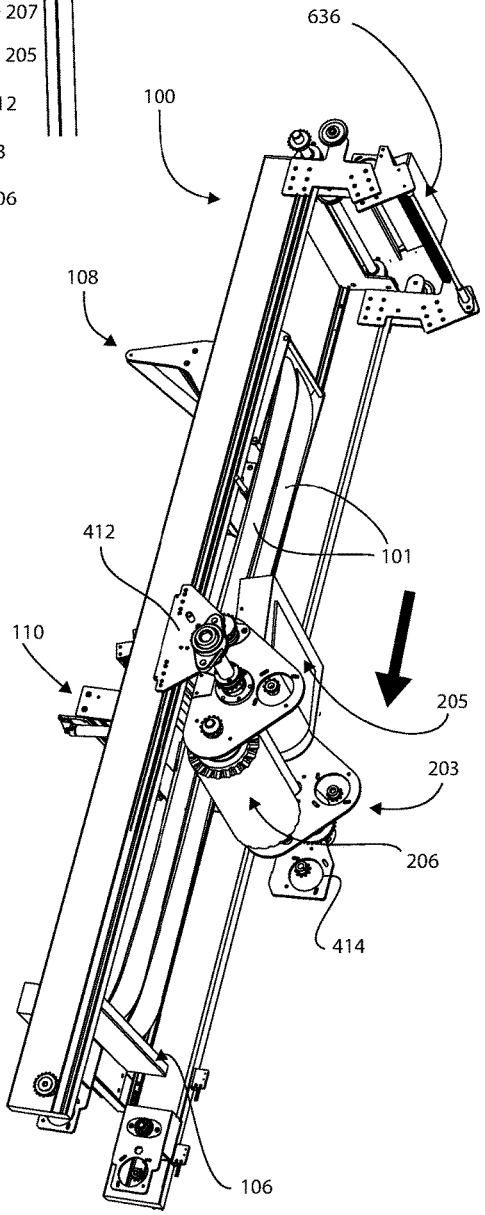
FIG. 37 depicts one embodiment of a process whereby a carriage has traveled along a track.
Figures 38A, 38B, 38C, 38D:
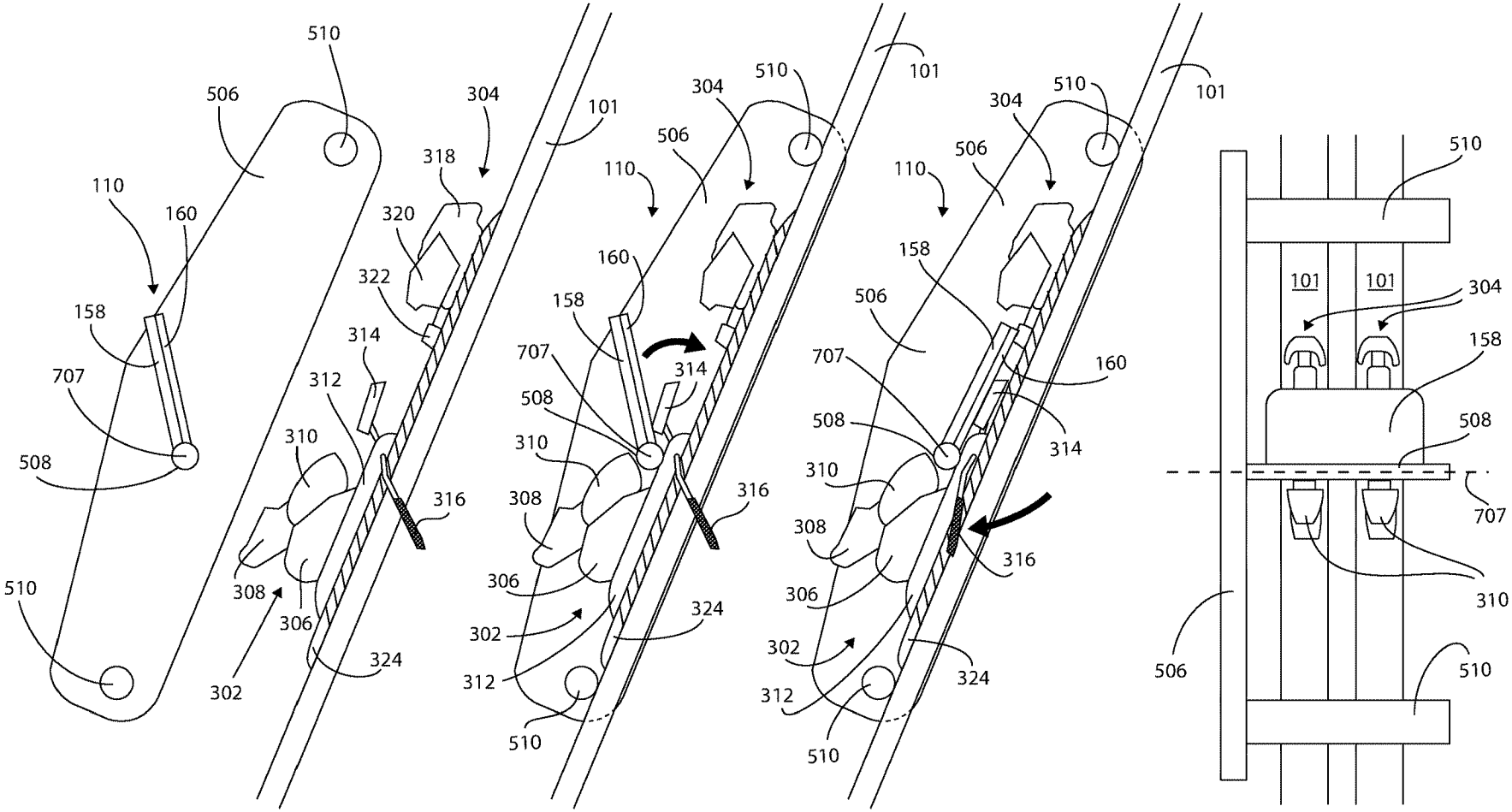
FIG. 38A depicts a view of one embodiment of a brake engagement device.
FIG. 38B depicts a view of the brake engagement device of FIG. 38A.
FIG. 38C depicts a view of the brake engagement device of FIG. 38B.
FIG. 38D depicts a plan view of the brake engagement device of FIG. 38B.

FIG. 37 shows one embodiment of a process whereby carriage 203 has traveled along track 202 while each brake arm 316 is in a retracted position and at least one of the following functions are being performed on the soles of the equipment, waxing, heating and/or scraping. In one or more embodiments, waxing portion 205, at least one heating element 213 and scraping portion 207 may engage the sole of the equipment on a single pass and/or on multiple passes, separately and/or in combination. In one or more embodiments, the advantage of performing multiple passes may be to add additional layers of wax onto and/or scrap excess wax off of the soles of the equipment. In one or more embodiments, after performing any one or more functions, carriage 203 may return to the home position (see, for example, FIG. 32) to terminate its operation and/or to rotate to start a new function and/or to repeat any one or more functions. Alternatively and/or in addition, in one or more embodiments, carriage 203 may rotate and immediately begin performing another function without first returning to its home position.

Although FIGS. 32 through 37 do not show wall 112, in one or more embodiments, during the processes illustrated and described with reference to FIGS. 32 through 37, wall 112 may be rotated out of the way of carriage's 203 operations.

FIGS. 38A, 38B, 38C and 38D show various views of one embodiment of brake engagement device 110 that may retract each brake arm 316 without the use of mounting block 106, tip engagement device 108 or wall 112. In one or more embodiments, brake engagement device 110 may include a mounting frame 506, a shaft 508, engagement surface 158 and at least one support bar 510. In one or more embodiments, shaft 508 and at least one support bar 510 may be configured to mounting frame 506. In one or more embodiments, engagement surface 158 may rotate around fourth axis 707 via shaft 508 for purposes of engaging each brake pedal 314 and retracting each brake arm 316. In one or more embodiments, engagement surface 158 may be configured with cover 160. In one or more embodiments, the purpose of the at least one support bar 510 may be to rest on top of the equipment and prevent it from rotating while being engaged by engagement surface 158. In one or more embodiment, the equipment and engagement surface 158 are brought together so that the shaft 508 is rested between each heel cup 310 and each brake pedal 314. Then, in one or more embodiments, shaft 508 rotates the engagement surface 158 around fourth axis 707 so that engagement surface 158 compresses each brake pedal 314, thereby retracting each brake arm 316 while the at least one support bar 510 prevents the equipment from rotating. In one or more embodiment, 3-point bending configuration is utilized to secure static stability. In one or more embodiment, engagement surface 158 may engage each heel cup 310 in such a manner so that engagement surface 158 uses each heel cup 310 as a fulcrum and/or applies pressure on each heel cup 310 as the engagement surface 158 is wedged under each heel cup 310 while, at the same time, rotating and compressing each brake pedal 314. Such configuration may provide a rotational force around at least one axis compressing each brake pedal 314. In one or more embodiment, at least one support bar 510 engages at least one surface of the at least one ski and prevents it from rotating at least in one direction while the engagement surface 158 compresses each brake pedal 314 as the engagement surface 158 rotates around at least one fulcrum point provided by its engagement with each heel cup 210.

In one or more embodiment, the advantage of such configuration of brake engagement device 110 may secure the equipment with only three points of tension while retracting each brake arm 316. Alternatively and/or in addition, in one or more embodiment, the advantage of such configuration of brake engagement device 110 may be that it may perform the brake arm retraction without the need for preliminary brake arm retraction work performed by, for example, tip engagement device 108. Alternatively and/or in addition, in one or more embodiment, the advantage of such configuration of brake engagement device 110 may be that it may perform the brake arm retraction without the need for the retention of the tip or the tail of the equipment by, for example, mounting block 106 and/or tip engagement device 108.

In one or more embodiment, mounting frame 506 may provide at least one support bar 510 which may engage the sole of the equipment and work in conjunction with at least one support bar 510 which may engage the top of the equipment, thereby pinching or securing the equipment and preventing it from rotating in any direction and thereby alleviating the need for wall 112.

Figure 39A:
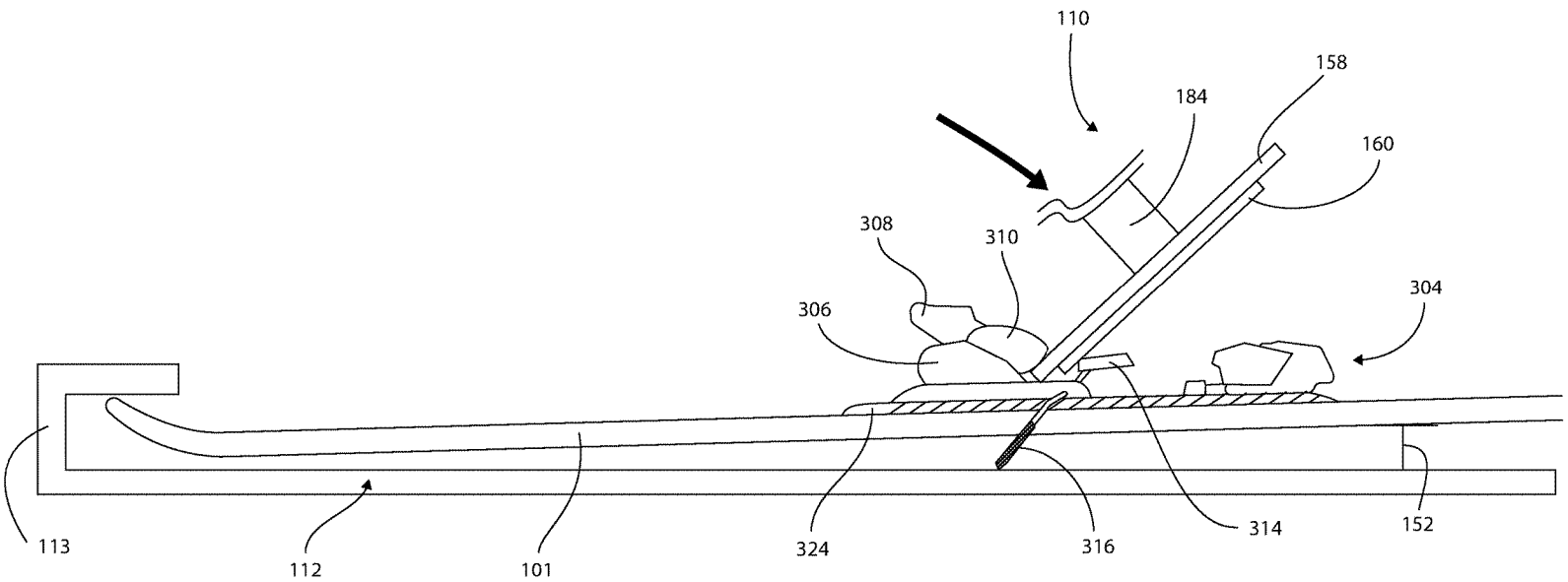
FIG. 39A depicts a side view of aspects of one embodiment of a brake engagement device and a wall.
Figure 39B:
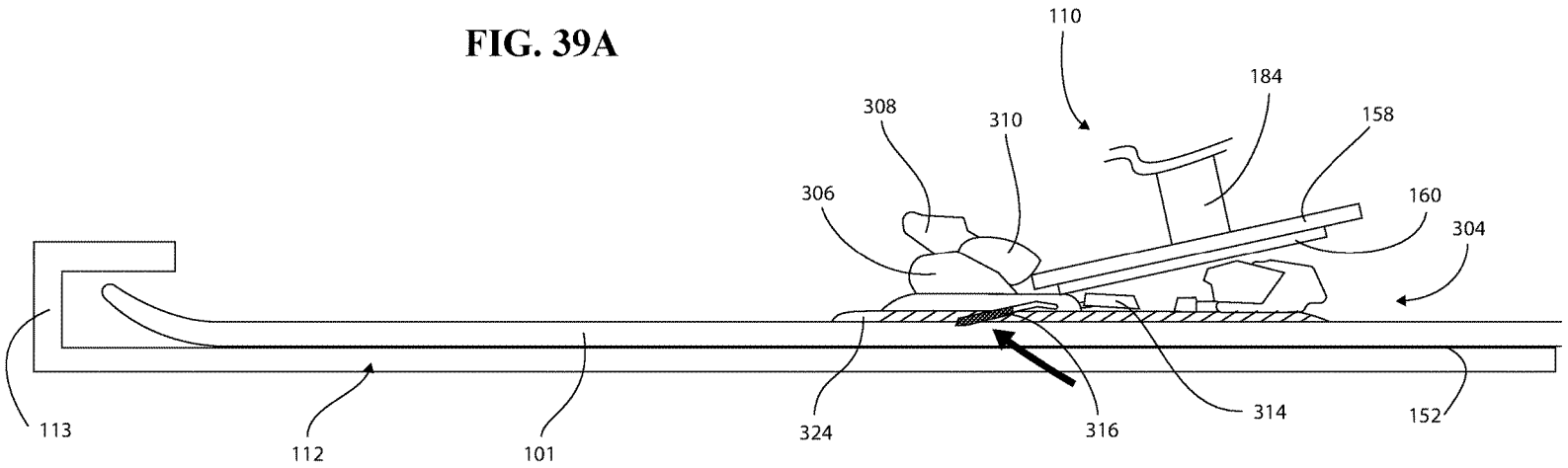
FIG. 39B depicts a side view of aspects of the brake engagement device and wall of FIG. 39A with brake arms in a retracted position.
Figures 40A, 40B, 40C, 40D:
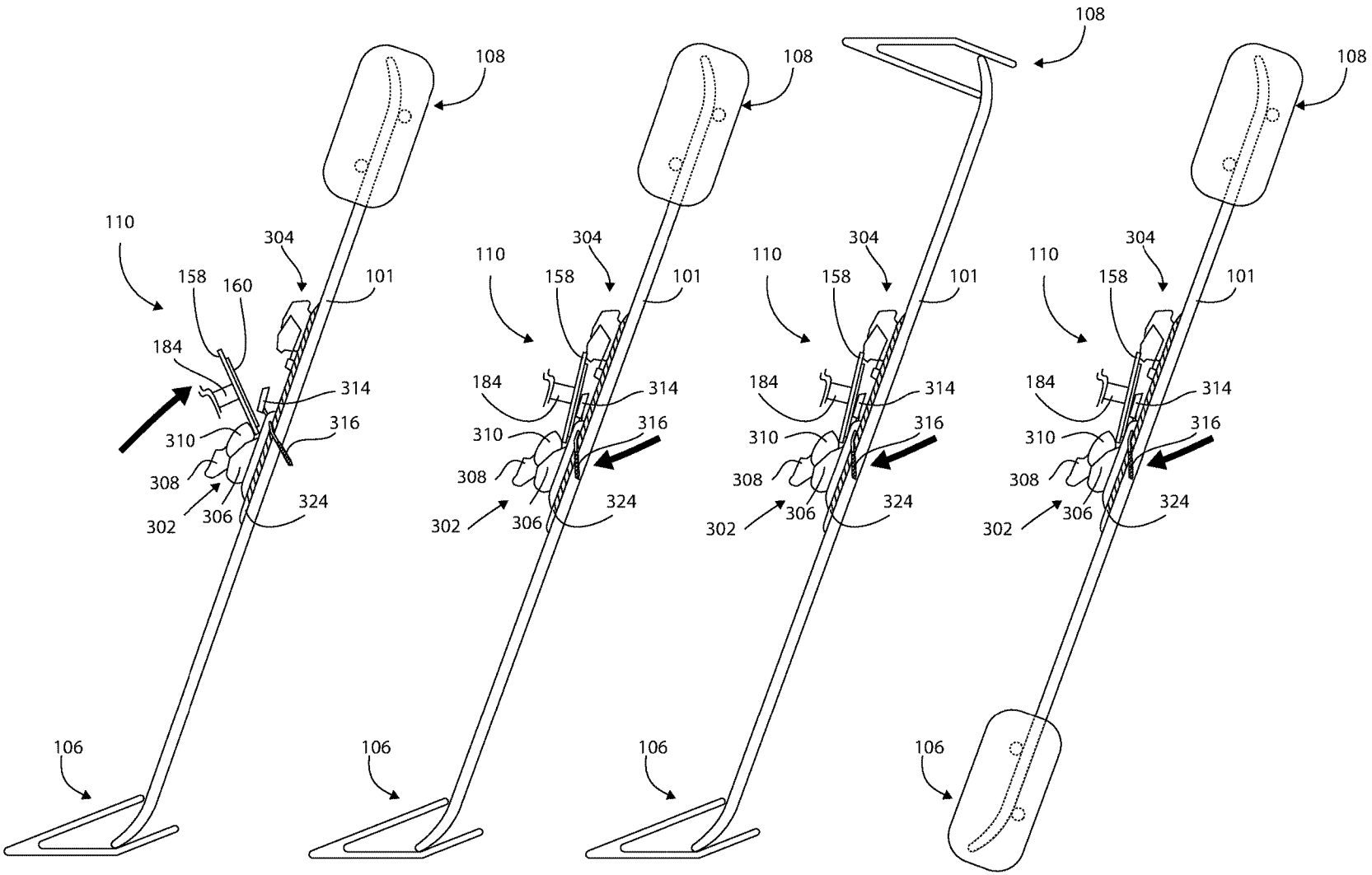
FIG. 40A depicts a view of aspects of one embodiment of a brake engagement device, a mounting block and a tip engagement device.
FIG. 40B depicts a view of aspects of the brake engagement device, mounting block and tip engagement device of FIG. 40A with brake arms in a retracted position.
FIG. 40C depicts a view of aspects of the brake engagement device and mounting block of FIG. 40B with another embodiment of a tip engagement device.
FIG. 40D depicts a view of aspects of the brake engagement device and tip engagement device of FIG. 40B with another embodiment of a mounting block.

FIGS. 39A and 39B show side views of aspects of one embodiment of brake engagement device 110 and of wall 112 which may work together to retract brake arms without the use of a tip engagement device 108. In one or more embodiments, brake engagement device 110 may include at least one extension unit 184 and engagement surface 158. In one or more embodiments, the embodiment of brake engagement device 110 may be as illustrated in FIGS. 18 and 19 which may be used in conjunction with the wall 112 illustrated in FIGS. 39A and 39B. Alternatively and/or in addition, the embodiment of brake engagement device 110 as illustrated in FIGS. 38A, 38B, 38C and 38D may be used in conjunction with the wall 112 illustrated in FIGS. 39A and 39B. In one or more embodiments, engagement surface 158 may be configured with cover 160. In one or more embodiments, wall 112 may include a tail and/or tip support member (such as tail support member 113) which constrains the movement of the tail and/or tip of the equipment while engagement surface 158 engages the equipment. In one or more embodiment, the equipment and engagement surface 158 are brought together so that engagement surface 158 is rested between each heel cup 310 and each brake pedal 314. Then, in one or more embodiments, engagement surface 158 rotates so that it compresses each brake pedal 314, thereby retracting each brake arm 316 and reducing and/or eliminating gap 152 between wall 112 and the sole of the equipment, all while the tail and/or tip support member (such as tail support member 113) of wall 112 prevents the equipment from rotating. In one or more embodiment, the advantage of such configuration of wall 112 is that brake engagement device 110 may retract each brake arm 316 without of tip engagement device 108 because the tail and/or tip support member (such as tail support member 113) of wall 112 secures the equipment.

FIGS. 40A, 40B, 40C and 40D show side views of aspects of one embodiment of brake engagement device 110, of mounting block 106 and/or of tip engagement device 108 which, various combinations of which, may work together to retract brake arms without the use of wall 112. In one or more embodiments, brake engagement device 110 may include at least one extension unit 184 and engagement surface 158. In one or more embodiments, the embodiment of brake engagement device 110 as illustrated in FIGS. 18 and 19 may be used in conjunction with the mounting block 106 and/or tip engagement device 108 as illustrated in FIGS. 40A, 40B, 40C and 40D. Alternatively and/or in addition, the embodiment of brake engagement device 110 as illustrated in FIGS. 38A, 38B, 38C and 38D may be used in conjunction with the mounting block 106 and/or tip engagement device 108 as illustrated in FIGS. 40A, 40B, 40C and 40D. In one or more embodiments, engagement surface 158 may be configured with cover 160. In one or more embodiments, mounting block 106 may be configured to restrain the tail of the equipment and tip engagement device 108 may be configured to retrain the tip of the equipment, while engagement surface 158 engages the equipment. In one or more embodiments, either and/or both mounting block 106 and/or tip engagement device 108 may move to engage the equipment. For example, in one or more embodiments, mounting block 106 may be fixed and tip engagement device 108 may be mobile. Alternatively and/or in addition, in one or more embodiments, tip engagement device 108 may be fixed and mounting block 106 may be mobile. Alternatively and/or in addition, in one or more embodiments, tip engagement device 108 and mounting block 106 may both be mobile. In one or more embodiments, once either and/or both mounting block 106 and/or tip engagement device 108 engages the equipment, engagement surface 158 may retract each brake arm 316. In one or more embodiment, the advantage of such configuration of mounting block 106, tip engagement device 108 and brake engagement device 110 working together is that brake engagement device 110 may retract each brake arm 316 without the need of wall 112.

Figure 41B:
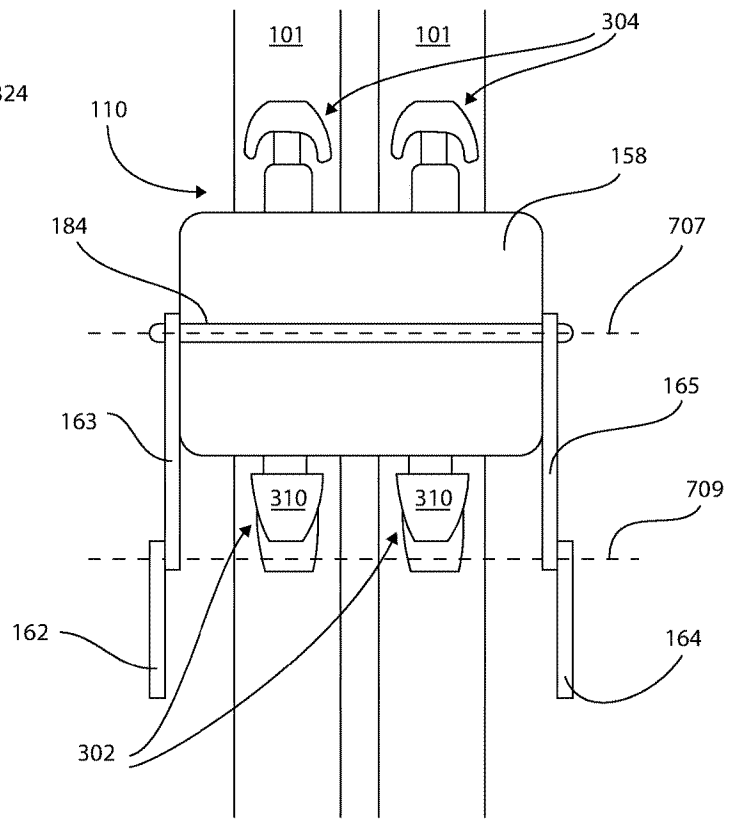
FIG. 41B depicts a plan view of aspects of the brake engagement device of FIG. 41A.
Figure 41A:
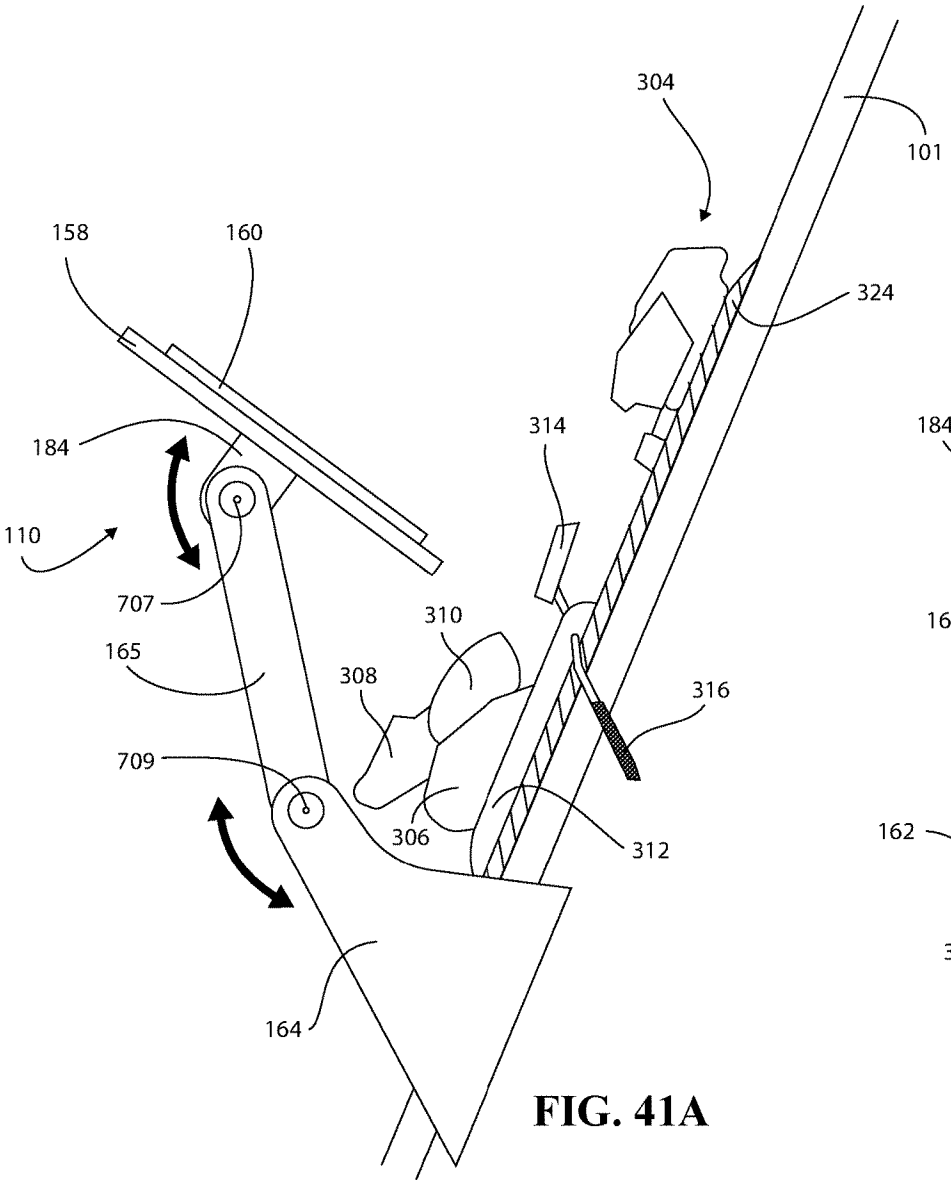
FIG. 41A depicts a view of aspects of one embodiment of a brake engagement device which includes a double pivot configuration.

The disclosure contemplates various ways of bringing the equipment and engagement surface 158 together. In one or more embodiments, the equipment may be stationary and the engagement surface 158 may be moved and/or properly aligned so that it may retract each brake arm 316. For example, FIGS. 41A and 41B show various views of aspects of one embodiment of brake engagement device 110 which includes a double pivot configuration for engaging each brake pedal 314 and retracting each brake am 316. In one or more embodiments, brake engagement device 110 may include support arms 162 and 164, engagement arms 163 and 165 which rotate around fifth axis 709, at least one extension unit 184 and engagement surface 158 (which may include cover 160) which rotate around fourth axis 707 (as illustrated in FIGS. 41A and 41B some or all of said elements may be configured differently than the embodiments in relation to FIGS. 18 and 19 and elsewhere herein).

Figure 42B:
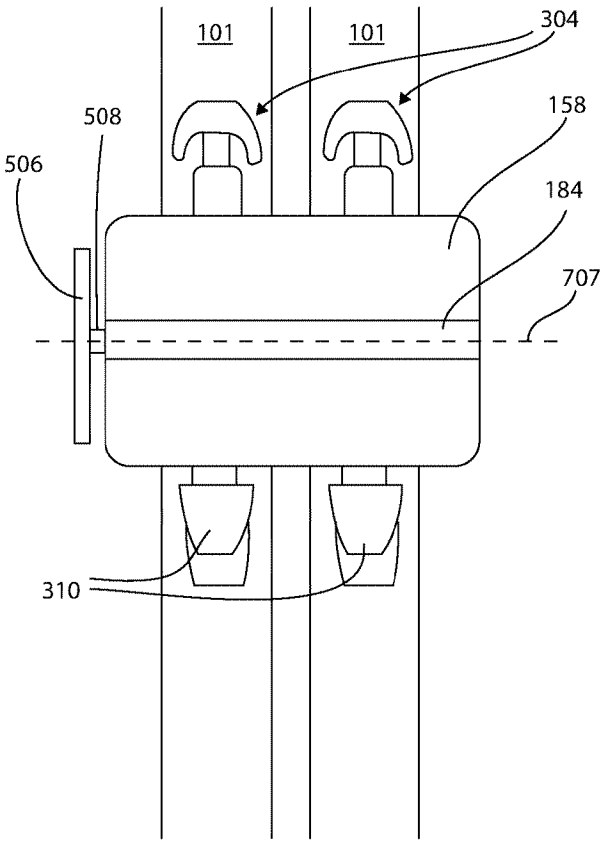
FIG. 42B depicts a plan view of aspects of the brake engagement device of FIG. 42A.
Figure 42A:
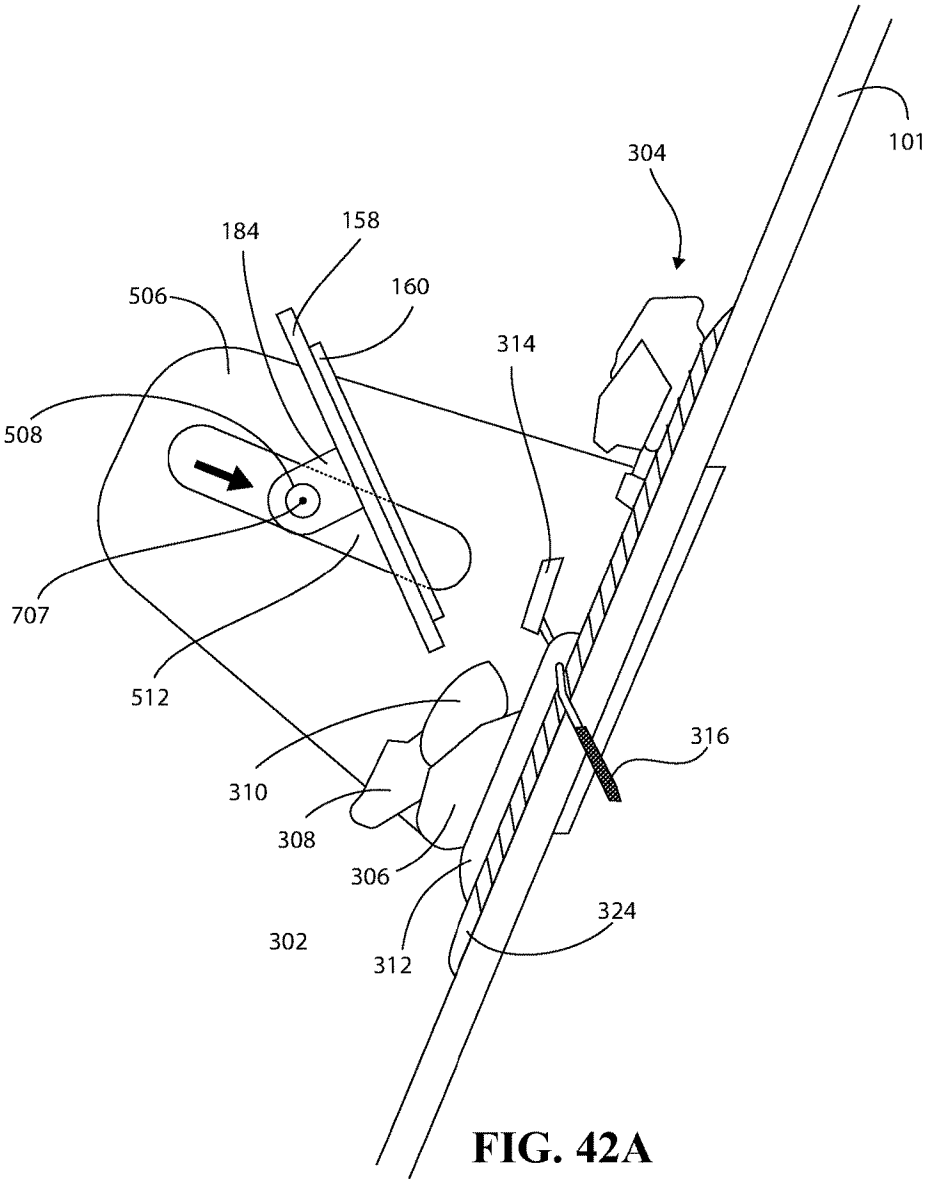
FIG. 42A depicts a view of aspects of one embodiment of a brake engagement device which includes a sliding pivot configuration.

In another example, FIGS. 42A and 42B show various views of aspects of one embodiment of brake engagement device 110 which includes a sliding pivot configuration for engaging each brake pedal 314 and retracting each brake arm 316. In one or more embodiments, brake engagement device 110 may include mounting frame 506, shaft 508, engagement surface 158, at least one extension unit 184, and a sliding mechanism 512. In one or more embodiments, sliding mechanism 512 may be configured to slide engagement surface 158 towards and/or away from the equipment. Such configuration allows brake engagement device 110 to adapt to ski bindings of various sizes and types. In one or more embodiments, engagement surface 158 may rotate around fourth axis 707 as shaft 508 rotates extension unit 184 which is configured to engagement surface 158. In one or more embodiments, slide mechanism 512 and rotating shaft 508 may work in together to properly align and fit engagement surface 158 in between each heel cup 310 and each brake pedal 314 so that, once properly aligned, shaft 508 may rotate around fourth axis 707 so that engagement surface 158 engages each brake pedal 314 and retracts each brake arm 316.

Figure 43:
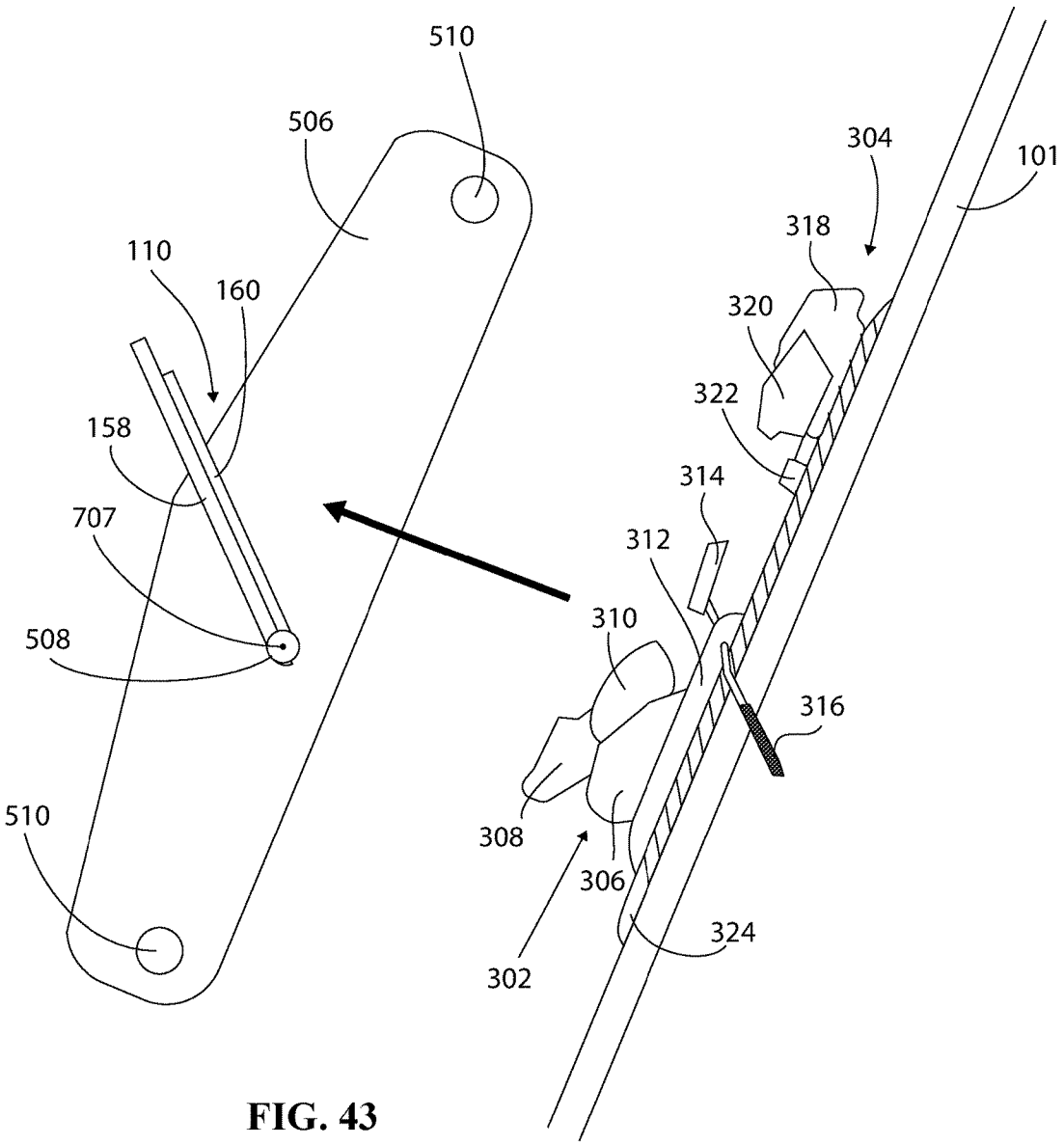
FIG. 43 depicts a view of aspects of one embodiment of a brake engagement device.

Alternatively and/or in addition, in one or more embodiments, engagement surface 158 may be stationary and the equipment may be moved so that each brake pedal 314 and each heel cup 310 are properly aligned such that engagement surface 158 may engage each brake pedal 314 and retract each brake arm 316. For example, FIG. 43 is an embodiment of brake engagement device 110 similar to that which is illustrated in FIGS. 38A through 38D, wherein the equipment illustrated in FIG. 43 is brought or moved to the brake engagement device 110. In one or more embodiments, a user may bring the equipment into proximity to the brake engagement device 110 and/or proper position so that engagement surface 158 may engage each brake pedal 314 and retract each brake arm 316.

Figure 44B:
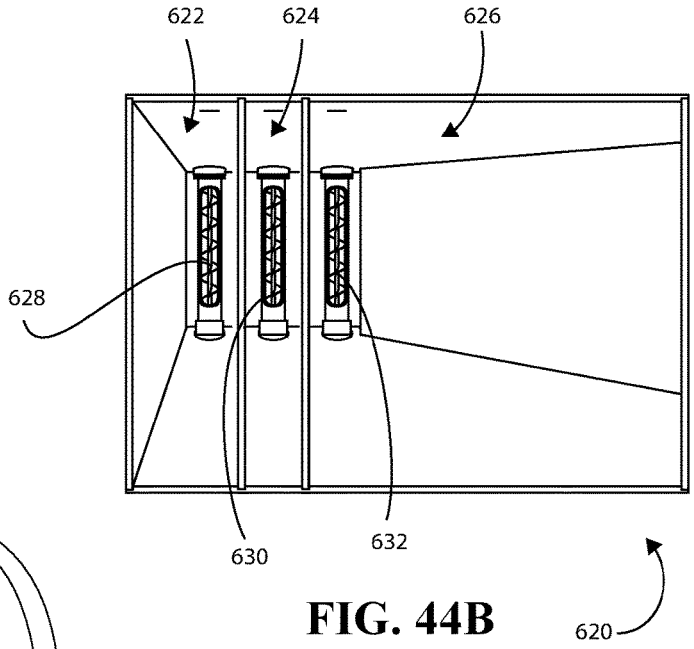
FIG. 44B depicts a plan view of the hopper of FIG. 44A.
Figure 44A:
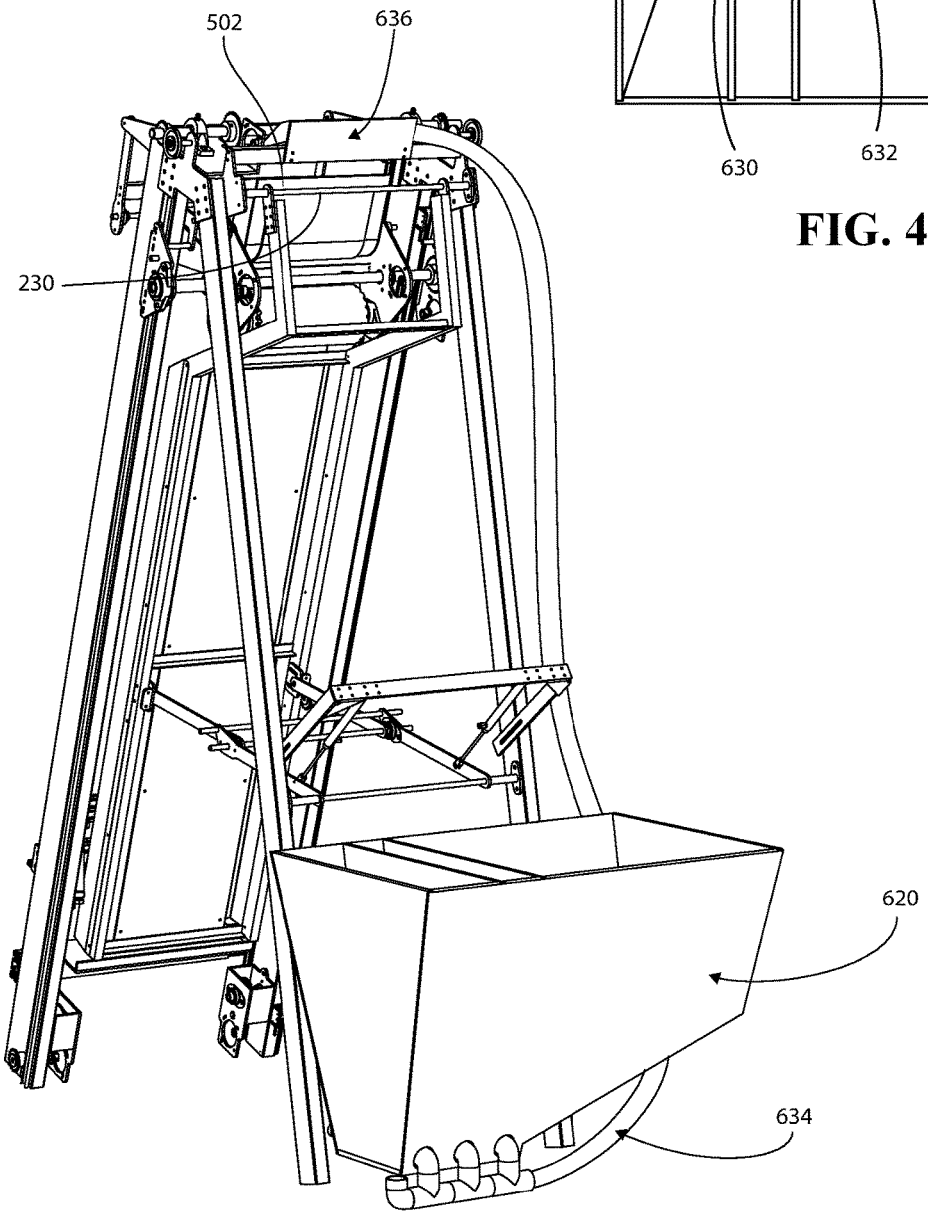
FIG. 44A depicts a view of aspects of one embodiment of a hopper.

FIGS. 44A and 44B show one embodiment of the disclosure which may include a hopper 620. In one or more embodiments, hopper 620 may contain various compartments for the purpose of storing various types of wax (such as various wax blocks 501). For example, in one or more embodiments, hopper 620 may include three compartments 622, 624, and 626. Although FIGS. 44A and 44B show the disclosure containing three compartments, in one or more embodiments, more or less compartments may be included in the disclosure. In one or more embodiments, each compartment may store the same and/or different types of wax. In one or more embodiments, wax may be fed from hopper 620 up to wax carriage 502 by various means. For example, in one or more embodiments, each of the compartments 622, 624 and 626 may include a motor and an auger (such as augers 628, 630 and 632) which pulls the wax contained in its respective compartment to a vacuum system (such as vacuum system 634) which funnels the wax at least towards wax carriage 502. In one or more embodiments, the amount of wax pulled by an auger may be regulated and controlled. In one or more embodiments, vacuum system 634 may include piping, tubes, hoses, clamps, a vacuum (such as, for example, a venture vacuum), a manifold, an intake valve and/or other components which may create a pressure differential and funnel the wax from hopper 620 at least towards wax carriage 502. In one or more embodiments, other structural elements may be added to control the dispensation of the wax and/or to minimize spillage and waste (see, for example, FIGS. 45A, 45B and 45C).

Figure 45C:
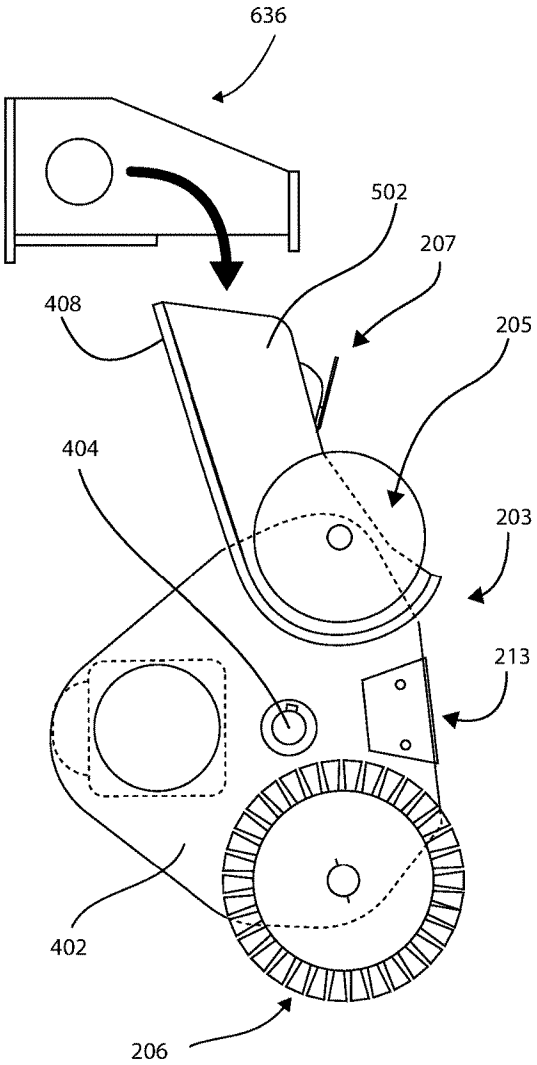
FIG. 45C depicts a side view of aspects of one embodiment of a wax dispenser proximal to a carriage.
Figure 45A:
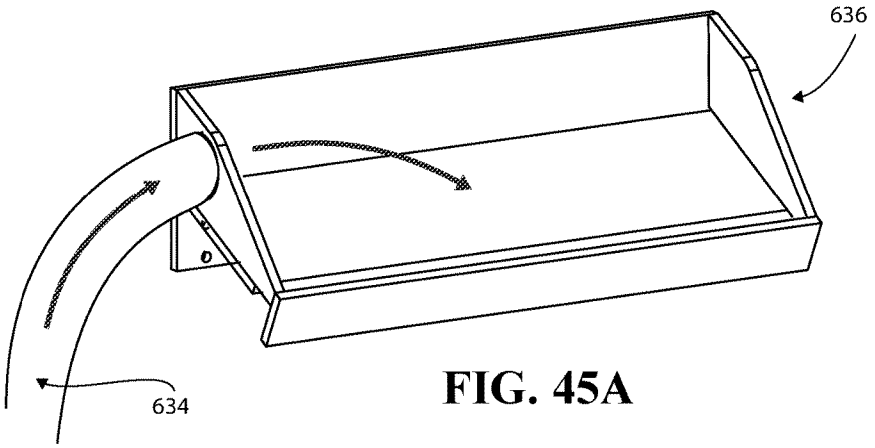
FIG. 45A depicts a view of aspects of one embodiment of a wax dispenser unit.
Figure 45B:
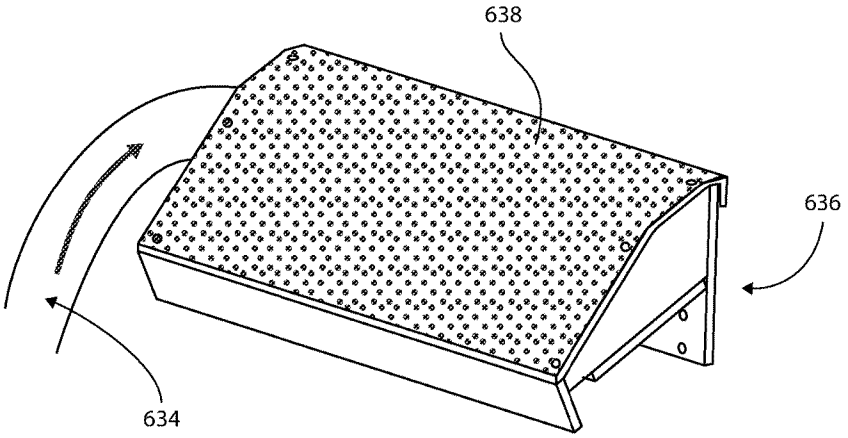
FIG. 45B depicts a view of aspects of one embodiment of a wax dispenser unit including a perforated cover.

FIGS. 45A, 45B and 45C show one embodiment of the disclosure which may include a wax dispenser unit 636. For example, in one or more embodiments, wax dispenser unit 636 may be configured for the purpose of diffusing the pressure created by vacuum system 634 and dispensing the wax into wax carriage 502. In one or more embodiments, wax dispenser unit 636 may be configured in various ways to achieve its purposes. For example, in one or more embodiments, wax dispenser unit 636 may include a top surface, a bottom surface, a rear surface and a front surface. In one or more embodiments, wax dispenser unit 636 may include a perforated cover (such as cover 638) to allow for air to dissipate while at the same time wax is kept contained in the wax dispenser unit 636. In one or more embodiments, wax dispenser unit 636 may include internal baffles (not shown) to slow and/or redirect the wax more evenly into wax carriage 502. In one or more embodiments, wax may travel through the vacuum system 634 and out into wax dispenser unit 636. As illustrated in FIG. 45C, in one or more embodiments, wax may pass through an opening between the bottom surface and front surface and into wax carriage 502 ultimately for application on the sole of equipment.

Figure 46A:
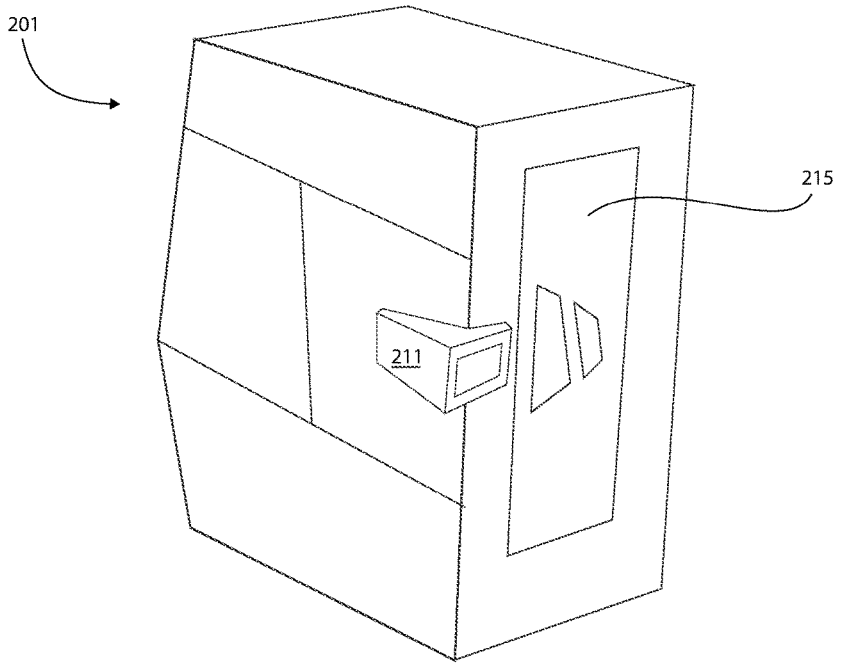
FIG. 46A depicts a perspective view of one embodiment of a housing.
Figure 46B:
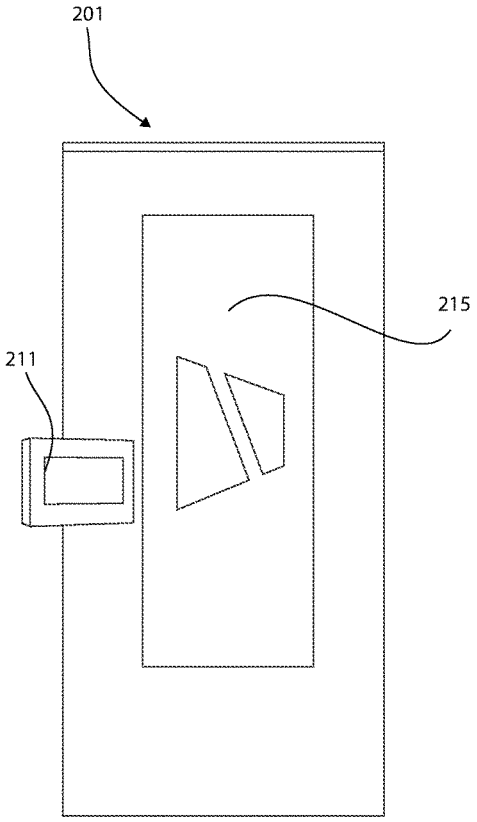
FIG. 46B depicts a front view of the housing of FIG. 46A.
Figure 46C:
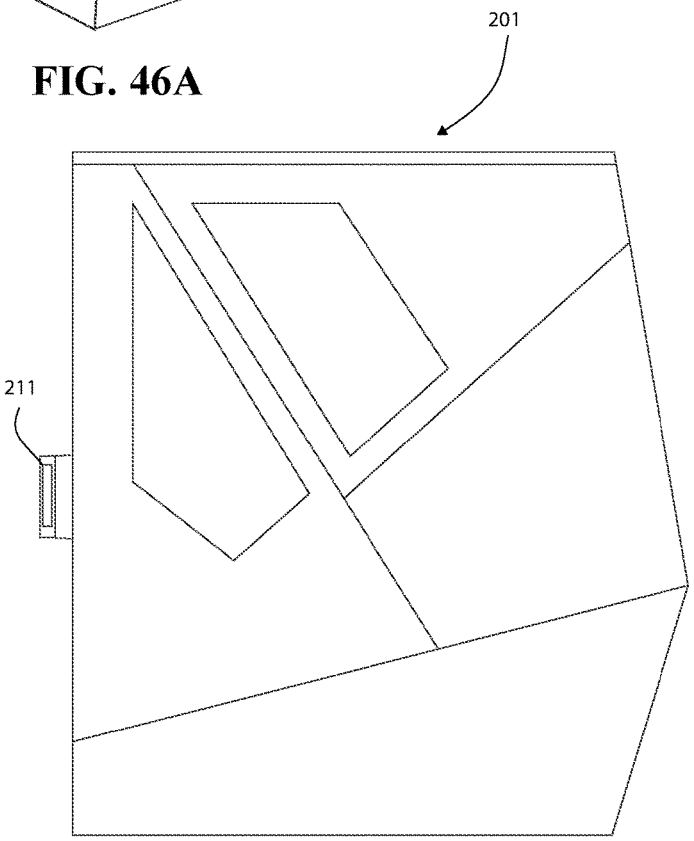
FIG. 46C depicts a side view of the housing of FIG. 46A.

FIGS. 46A, 46B and 46C show one embodiment of the disclosure being configured with a housing or kiosk where skiers, snowboarders and/or other equipment users may insert their equipment into mounting mechanism 100 and have it serviced on-site. In one or more embodiments, the housing may include user interface 211 and a door 215. In one or more embodiments which include a door (such as door 215), after the equipment has been serviced the door may unlock and/or otherwise be opened and the equipment may be retrieved by the user; otherwise, in the instance where no door is provide, the user may retrieve the equipment.

Figure 47:
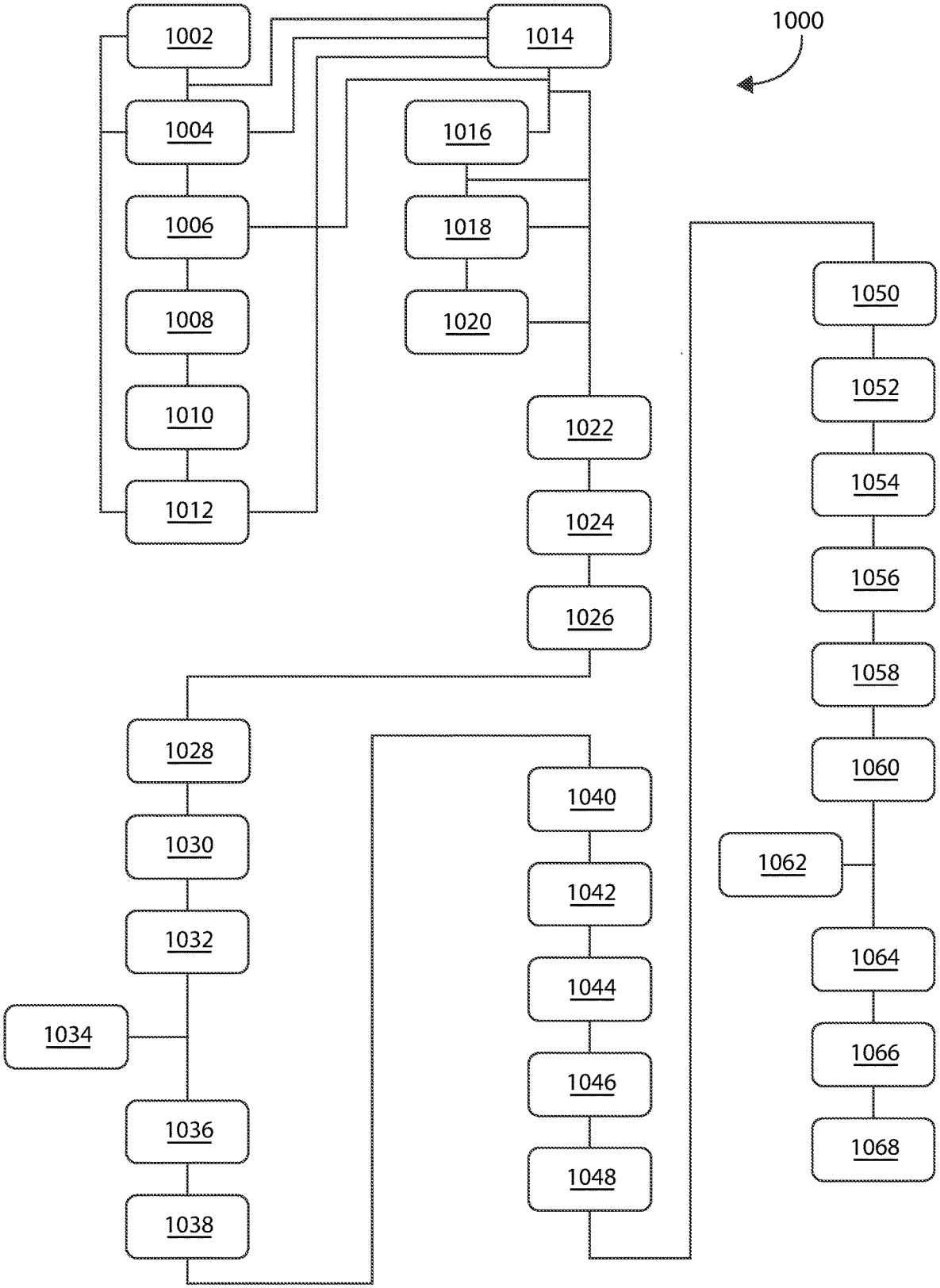
FIG. 47 depicts a flow diagram illustrating one embodiment of a method for using a brake engagement device and/or other aspects of the disclosure in accordance with at least one embodiment.

FIG. 47 is a flow diagram that depicts one embodiment of a method 1000 for using tip engagement device 108, brake engagement device 110, wall 112 and/or other aspects of the disclosure in accordance with at least one embodiment. In one or more embodiments, various embodiments of aspects of the disclosure may be used when implementing method 1000. The method 1000 for using brake engagement device 110 as illustrated flow diagram FIG. 47 may be customized, flexible and adapted to various circumstances and situations. In one or more embodiments, one or more steps in method 1000 may be deleted, skipped, added, modified, rearranged, and/or repeated. In one or more embodiments, method 1000 may be used to service equipment which includes ski bindings.

In optional step 1002, a user may enter information into user interface 211, such as the snow conditions, the type, make, model and size of equipment (such as whether each ski is free-heeled or telemark style skis or whether each ski has ski bindings), the type of skier and/or rider, the type of wax desired, the payment amount, type and authorization, coupon code, and/or any other information (see for example the illustrations and descriptions in relation to FIGS. 2, 46A, 46B and 46C). In optional step 1004, a user may pay for the services requested. Such may be done through user interface 211 if such is provided. In optional step 1006, the disclosure may determine the appropriate wax for the conditions and/or as selected by the user. In optional step 1008, the disclosure may check the level of wax in the wax carriage 502 to determine if there is a sufficient amount to service each ski. In optional step 1010, the disclosure may supply wax carriage 502 with at least a sufficient amount wax to wax carriage 502 to service each ski if needed (see for example the illustrations and descriptions in relation to FIGS. 5, 44A, 44B, 45A, 45B and 45C). In optional step 1012, the disclosure may unlock door 215 of housing 201 via system commands and/or upon the trigger of some event or signal, such as payment (see for example the illustrations and descriptions in relation to FIGS. 2, 46A, 46B and 46C).

In step 1014, a user may load at least one ski (such as pair of skis 101) onto mounting mechanism 100, wherein each at least one ski includes at least one ski binding 300, wherein each ski binding 300 includes at least one heel piece 302, wherein each heel piece 302 includes at least one heel cup 310, at least one brake pedal 314, and at least one brake arm 316. In optional step 1016, the disclosure may close door 215 to housing 201 if such is provided (see for example the illustrations and descriptions in relation to FIGS. 2, 46A, 46B and 46C). In optional step 1018, the disclosure or user may lock door 215 if such is provided (see for example the illustrations and descriptions in relation to FIGS. 2, 46A, 46B and 46C). In optional step 1020, the disclosure may articulate engagement surface 158 around at least one axis against the top of each ski so as to ensure each ski is properly positioned. After which, in one or more embodiments, engagement surface 158 may disengage engagement surface 158 (see for example the illustrations and descriptions in relation to FIGS. 20 and 21).

In step 1022, the disclosure may displace tip engagement device 108 along track 202 to engage the tip of each ski (see for example the illustrations and descriptions in relation to FIGS. 15A and 15B). In step 1024, the disclosure may articulate tip engagement device 108 around at least one axis such that a bar 118 engages the sole of each ski with a force towards the sole of each ski and around at least one axis such that a bar 120 engages the top of each ski with a force towards the top of each ski, and pressing each brake arm 316 towards the wall and moving each brake arm at least towards a retracted position and at least reducing the camber of each ski and bring each ski into substantially a single plane (see for example the illustrations and descriptions in relation to FIGS. 16, 17A and 17B). In step 1026, the disclosure may maintain the engagement of the sole of each ski with a force toward the sole and maintaining the engagement of the top of each ski with a force toward the top.

In step 1028, the disclosure may displace brake engagement device 110 along track 202 to engage engagement surface 158 with each heel piece 302 (see for example the illustration and description in relation to FIG. 22). In step 1030, the disclosure may displace brake engagement device 110 along track 202 to move engagement surface 158 over each heel cup 310 (see for example the illustration and description in relation to FIG. 23). In step 1032, the disclosure may seat engagement surface 158 in between each heel cup 310 and each brake pedal 314 (see for example the illustrations and descriptions in relation to FIGS. 24A, 24B, 38A, 38B, 39A and 40A). In optional step 1034, the disclosure reverses the direction of brake engagement device 110 to tension engagement surface 158 against each heel cup 310. In step 1036, the disclosure articulates engagement surface 158 around at least one axis to compress each brake pedal 314 and to retract each brake arm 316 (see for example the illustrations and descriptions in relation to FIGS. 25A, 25B, 38C, 39B, 40B, 40C and 40D). In step 1038, the disclosure maintains securement of each brake arm 316 in a retracted position.

In step 1040, the disclosure rotates wall 112 to its open position to provide room for carriage 203 to perform its functions (see for example the illustrations and descriptions in relation to FIGS. 2, 3 and 27). In step 1042, the disclosure maintains wall 112 in its open position to provide room for carriage 203 to perform its functions (see for example the illustration and description in relation to FIG. 4).

In step 1044, the disclosure displaces carriage 203 to perform at least one of the following functions on each ski: cleaning, heating, waxing, scraping and brushing (see for example the illustrations and descriptions in relation to FIGS. 4, 5, 6, 7, 8, 33, 34, 35, 36A, 36B and 37). In step 1046, the disclosure disengages carriage 203 from the equipment and displaces the carriage 203 to its home position (see for example the illustration and description in relation to FIG. 32). In step 1048, the disclosure rotates wall 112 to its home position (see for example the illustration and description in relation to FIG. 26).

In step 1050, the disclosure disengages and displaces engagement surface 158 so that distance is created between engagement surface 158 and each heel cup 310. In step 1052, the disclosure articulates engagement surface 158 around at least one axis so that the front portion of engagement surface 158 rotates towards the top of each ski and twists engagement surface 158 so that the rear portion of the engagement surface 158 lifts up out of each heel cup 310 to form a negative slope with the rear portion of engagement surface 158 proximal to each heel cup 310 above the front portion of engagement surface 158 proximal to the top of each ski. In step 1054, the disclosure displaces engagement surface 158 towards home position so that engagement surface 158 articulates over each heel piece 302. In step 1056, the disclosure disengages engagement surface 158 and displaces brake engagement device 110 to its home position (see for example the illustration and description in relation to FIG. 20).

In step 1058, the disclosure displaces tip engagement device 108 so it articulates around at least one axis so that bar 120 is lifted from the top of each ski and so that bar 118 is disengaged from the sole of each ski. In step 1060, the disclosure displaces tip engagement device 108 to its home position (see for example the illustration and description in relation to FIG. 14).

In optional step 1062, the disclosure and/or a user unlocks door 215 of housing 201 if such is provided. In step 1064, a user retrieves each ski. In optional step 1066, the disclosure and/or a user closes door 215 if such is provided. In optional step 1068, the disclosure and/or a user locks door 215 if such is provided.

Figure 48:
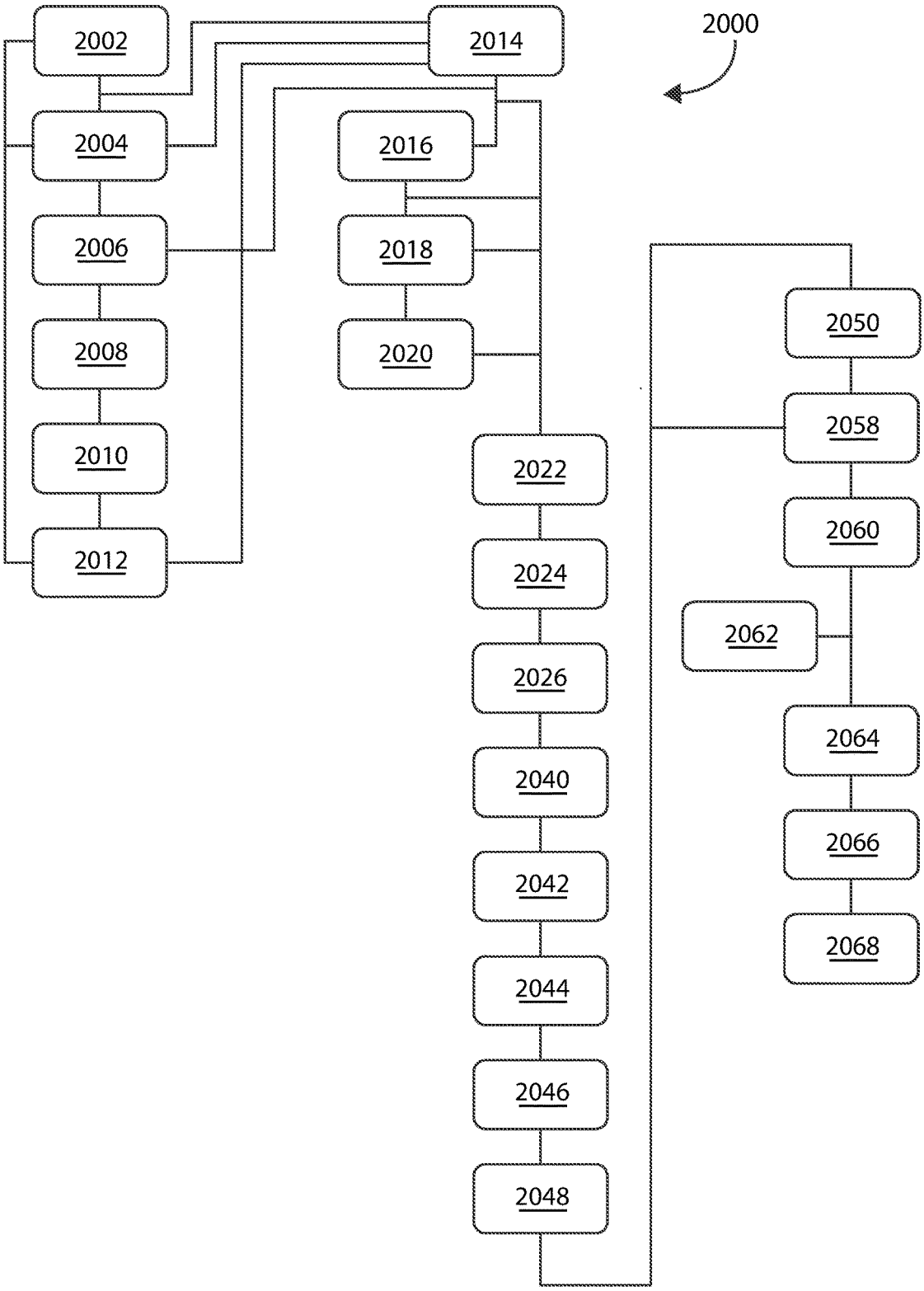
FIG. 48 depicts a flow diagram illustrating one embodiment of a method for using a tip engagement device and/or other aspects of the disclosure in accordance with at least one embodiment.

FIG. 48 is a flow diagram that depicts one embodiment of a method 2000 for using tip engagement device 108, brake engagement device 110, wall 112 and/or other aspects of the disclosure in accordance with at least one embodiment. In one or more embodiments, various embodiments of aspects of the disclosure may be used when implementing method 2000. The method 2000 for using brake engagement device 110 as illustrated flow diagram FIG. 48 may be customized, flexible and adapted to various circumstances and situations. In one or more embodiments, one or more steps in method 2000 may be deleted, skipped, added, modified, rearranged, and/or repeated. In one or more embodiments, method 2000 may be used to service equipment without brake arms present.

In optional step 2002, a user may enter information into user interface 211, such as the snow conditions, the type, make, model and size of equipment (such as whether each ski is free-heeled or telemark style skis or whether each ski has ski bindings), the type of skier and/or rider, the type of wax desired, the payment amount, type and authorization, coupon code, and/or any other information (see for example the illustrations and descriptions in relation to FIGS. 2, 46A, 46B and 46C). In optional 2004, a user may pay for the services requested. Such may be done through user interface 211 if such is provided. In optional step 2006, the disclosure may determine the appropriate wax for the conditions and/or as selected by the user. In optional step 2008, checking level of wax in the wax carriage 502 to determine if there is a sufficient amount to service each ski or each snowboard. In optional step 2010 the disclosure may supply wax carriage 502 with at least a sufficient amount of wax to wax carriage 502 to service each ski or each snowboard if needed (see for example the illustrations and descriptions in relation to FIGS. 5, 44A, 44B, 45A, 45B and 45C). In optional step 2012, the disclosure may unlock door 215 of housing 201 via system commands and/or upon the trigger of some event or signal, such as payment (see for example the illustrations and descriptions in relation to FIGS. 2, 46A, 46B and 46C).

In step 2014, a user may load at least one ski (such as pair of skis 101) onto mounting mechanism 100. In optional step 2016, the disclosure may close door 215 to housing 201 if such is provided (see for example the illustrations and descriptions in relation to FIGS. 2, 46A, 46B and 46C). In optional step 2018, the disclosure or user may lock door 215 if such is provided (see for example the illustrations and descriptions in relation to FIGS. 2, 46A, 46B and 46C). In optional step 2020 articulating engagement surface 158 around at least one axis against the top of each ski or each snowboard so as to ensure each ski and each snowboard is properly positioned and maintaining the engagement of engagement surface 158 on the top of each ski or each snowboard (see for example the illustrations and descriptions in relation to FIGS. 20 and 21).

In step 2022, the disclosure may displace tip engagement device 108 along track 202 to engage the tip of each ski or each snowboard (see for example the illustrations and descriptions in relation to FIGS. 15A and 15B). In step 2024, the disclosure may articulate tip engagement device 108 around at least one axis such that a bar 118 engages the sole of each ski with a force towards the sole of each ski or each snowboard and around at least one axis such that a bar 120 engages the top of each ski or each snowboard with a force towards the top of each ski or each snowboard, and at least reducing the camber of each ski or each snowboard and bring each ski or each snowboard into substantially a single plane (see for example the illustrations and descriptions in relation to FIGS. 16, 17A and 17B). In step 2026, the disclosure may maintain the engagement of the sole of each ski or each snowboard with a force toward the sole and maintaining the engagement of the top of each ski or each snowboard with a force toward the top.

In step 2040, the disclosure may rotate wall 112 to its open position to provide room for carriage 203 to perform its functions (see for example the illustrations and descriptions in relation to FIGS. 2, 3 and 27). In step 2042, the disclosure maintains wall 112 in its open position to provide room for carriage 203 to perform its functions.

In step 2044, the disclosure may displace carriage 203 to perform at least one of the following functions on each ski or each snowboard: cleaning, heating, waxing, scraping and brushing (see for example the illustrations and descriptions in relation to FIGS. 4, 5, 6, 7, 8, 33, 34, 35, 36A, 36B and 37). In step 2046, the disclosure disengages carriage 203 from the equipment and displaces the carriage 203 to its home position (see for example the illustration and description in relation to FIG. 32). In step 2048, the disclosure rotates wall 112 to its home position (see for example the illustration and description in relation to FIG. 26).

In optional step 2050, the disclosure disengages engagement surface 158. In step 2058, the disclosure displaces tip engagement device 108 so it articulates around at least one axis so that bar 120 is lifted from the top of each ski or each snowboard and so that bar 118 is disengaged from the sole of each ski and each snowboard. In step 2060, the disclosure displaces tip engagement device 108 to its home position (see for example the illustration and description in relation to FIG. 14).

In optional step 2062, the disclosure and/or a user unlocks door 215 of housing 201 if such is provided. In step 2064, a user retrieves each ski or each snowboard. In optional step 1066, the disclosure and/or a user closes door 215 if such is provided. In optional step 1068, the disclosure and/or a user locks door 215 if such is provided.

While the disclosure has been shown and described with reference to certain exemplary embodiments thereof, it will be understood by those skilled in the art that various changes in form and details may be made therein without departing from the spirit and scope of the disclosure as defined by the appended claims and their equivalents.

Different embodiments of the disclosure may implement the above scenario(s) and/or variations of the above scenario (s). In one or more embodiment, any of the structures, functions, and/or features of any aspect of the disclosure expressly and/or inherently described and/or illustrated herein may be combined with any of the structures, functions, and/or features of any other aspect of the disclosure expressly and/or inherently described and/or illustrated herein. In one or more embodiments, each component of the disclosures may be provided in any color.

In one or more embodiments, other modifications may be made to the embodiments illustrated in the drawings and/or otherwise disclosed herein and/or equivalents, which may include and/or have the capacity to utilize abilities, systems, devices, articles, means, functionality, features, methods and/or uses not expressly and/or impliedly described herein and/or illustrated in the drawings to this application but which may be obvious to one skilled in the art, whether developed later or known at the time of filing.

It should be understood that the present systems, apparatuses, devices, means, methods and structures are not intended to be limited to the particular forms disclosed; rather, they are to cover all combinations, modifications, equivalents and alternatives. A system, device, article, means, method or structure that is configured in a certain way may be configured in at least that way, but may also be configured in ways that are not described or illustrated. The disclosure may be configured to function with a variety of systems, devices, articles, methods, means, and structures. Different materials may be used for individual components. Different materials may be combined in a single component.

The present disclosure may be embodied in other specific forms without departing from its spirit or essential characteristics. It is appreciated that various features of the above described examples and embodiments may be mixed and matched to form a variety of other combinations and alternatives. It is also appreciated that devices, methods and systems disclosed herein should not be limited simply to snow sport equipment waxing and ski brake arms retraction devices, methods and systems. The described embodiments are to be considered in all respects as illustrative and not restrictive. Other embodiments and/or implementations are within the scope of the following claims and at least all changes which come within the meaning and range of equivalency of the claims are to be embraced within their scope. The scope of the disclosure may be indicated by the appended claims rather than by any of the foregoing description.

What is claimed is:

1. A method for retracting ski brake arms, comprising:

loading at least one ski onto a mounting mechanism to be engaged by a brake engagement device comprising an engagement surface configured to engage the at least one ski; wherein the at least one ski comprises a ski binding, wherein the ski binding comprises a heel piece; wherein the heel piece comprises: a heel cup, a brake pedal, and at least one brake arm; and wherein the brake engagement device is configured to automatically locate the heel piece;

seating the engagement surface of the brake engagement device between the heel cup and the brake pedal; and articulating the engagement surface to engage the heel cup and depress the brake pedal and secure the at least one brake arm in a retracted position by rotating the engagement surface on at least one fulcrum point provided by its engagement with the heel cup.

2. The method of claim 1, further comprising: disengaging and displacing the engagement surface so that distance is created between the engagement surface and the heel cup.

3. The method of claim 2, further comprising: articulating the engagement surface about at least one axis such that a front portion of the engagement surface rotates toward a top of the at least one ski and a rear portion of the engagement surface rotates away from the heel cup.

4. The method of claim 3, further comprising: displacing the engagement surface toward a home position.

5. The method of claim 1, further comprising: displacing the brake engagement device along a track to allow the engagement surface to engage the heel piece and to seat the engagement surface between the heel cup and the brake pedal.

6. The method of claim 5, further comprising: reversing the displacement of the brake engagement device to ensure the engagement surface is situated against the heel cup.

7. The method of claim 1, wherein the mounting mechanism comprises a wall whereon the at least one ski is loaded when the loading step of claim 1 is performed.

8. The method of claim 1, further comprising: maintaining the securement of the at least one brake arm in the retracted position.

9. A brake engagement device for retracting ski brake arms, comprising:

an engagement surface configured to engage at least one ski;

wherein the at least one ski comprises a ski binding;

wherein the ski binding comprises a heel piece;

wherein the heel piece comprises: a heel cup, a brake pedal, and at least one brake arm;

wherein the engagement surface is configured to engage the heel cup and to rotate on at least one fulcrum point provided by its engagement with the heel cup to depress the brake pedal and secure the at least one brake arm in a retracted position; and wherein the brake engagement device is configured to automatically locate the heel piece.

10. The brake engagement device of claim 9, wherein the brake engagement device is configured to move along a track in order to engage the heel piece.

11. The brake engagement device of claim 9, further comprising at least one support bar configured to engage at least one surface of the at least one ski and prevent the at least one surface of the at least one ski from rotating at least in one direction when the engagement surface depresses the brake pedal.

12. The brake engagement device of claim 9, further comprising at least one support arm pivotably configured to the engagement surface for at least aiding in the engagement surface's movement.

13. The brake engagement device of claim 9, further comprising at least one engagement arm configured to the engagement surface for at least aiding in the engagement surface's movement.

14. The brake engagement device of claim 9, wherein the brake engagement device is configured to automatically depress the brake pedal.

15. A brake engagement device for retracting ski brake arms, comprising:

an engagement surface configured to engage at least one ski;

wherein the at least one ski comprises a ski binding;

wherein the ski binding comprises a heel piece;

wherein the heel piece comprises: a heel cup, a brake pedal, and at least one brake arm;

wherein the engagement surface is configured to engage the heel cup and to rotate on at least one fulcrum point provided by its engagement with the heel cup to depress the brake pedal and secure the at least one brake arm in a retracted position; and wherein the engagement surface is configured to automatically adjust to different contours of the ski binding when the engagement surface encounters the ski binding.

16. The brake engagement device of claim 15, wherein the brake engagement device is configured to automatically rotate about at least one axis to depress the brake pedal and secure the at least one brake arm in the retracted position.

17. A brake engagement device for retracting ski brake arms, comprising:

an engagement surface configured to engage at least one ski;

wherein the at least one ski comprises a ski binding;

wherein the ski binding comprises a heel piece;

wherein the heel piece comprises: a heel cup, a brake pedal, and at least one brake arm;

wherein the engagement surface is configured to engage the heel cup and to rotate on at least one fulcrum point provided by its engagement with the heel cup to depress the brake pedal and secure the at least one brake arm in a retracted position; and wherein the brake engagement device is configured to automatically fit the engagement surface between the heel cup and the brake pedal.

18. The brake engagement device of claim 17, further comprising:

a shaft configured to the engagement surface, wherein the shaft is configured to rotate the engagement surface about at least one axis; and a sliding mechanism pivotably configured to the shaft;

wherein the sliding mechanism is configured to slide the shaft at least in two directions relative to the at least one ski to allow the brake engagement device to adapt to skis and ski bindings of various dimensions.

19. A brake engagement device for retracting ski brake arms, comprising:

an engagement surface configured to engage at least one ski;

wherein the at least one ski comprises a ski binding;

wherein the ski binding comprises a heel piece;

wherein the heel piece comprises: a heel cup, a brake pedal, and at least one brake arm;

wherein the engagement surface is configured to engage the heel cup and to rotate on at least one fulcrum point provided by its engagement with the heel cup to depress the brake pedal and secure the at least one brake arm in a retracted position; and wherein the engagement surface is configured to provide a first surface force against at least one surface of the at least one ski while a first opposing surface force is provided by a source other than the brake engagement device on at least another surface of the at least one ski.

20. A brake engagement device for retracting ski brake arms, comprising:

at least one side plate;

at least one support arm;

at least one engagement arm; and an engagement surface configured to engage at least one ski;

wherein the at least one ski comprises a ski binding;

wherein the ski binding comprises a heel piece;

wherein the heel piece comprises: a heel cup, a brake pedal, and at least one brake arm;

wherein the engagement surface is configured to engage the heel cup and to rotate on at least one fulcrum point provided by its engagement with the heel cup to depress the brake pedal and secure the at least one brake arm in a retracted position;

wherein the at least one engagement arm is configured to the engagement surface;

wherein the at least one engagement arm is pivotably configured to the at least one support arm such that the at least one engagement arm may rotate about at least one axis;

wherein the at least one support arm is pivotably configured to the at least one side plate such that the at least one support arm may rotate about an alternate axis; and wherein the at least one support arm's ability to rotate about the alternate axis and the at least one engagement arm's ability to rotate about the at least one axis allows the brake engagement device to adjust to and engage skis and ski bindings of various dimensions.

* * * * *